US010500508B2

(12) United States Patent
Hunter

(10) Patent No.: US 10,500,508 B2
(45) Date of Patent: Dec. 10, 2019

(54) WATER RIDE

(71) Applicant: PROSLIDE TECHNOLOGY INC., Ottawa, Ontario (CA)

(72) Inventor: Richard D. Hunter, Ottawa (CA)

(73) Assignee: PROSLIDE TECHNOLOGY INC., Ottawa (CA)

( * ) Notice: Subject to any disclaimer, the term of this patent is extended or adjusted under 35 U.S.C. 154(b) by 0 days.

(21) Appl. No.: 15/318,202

(22) PCT Filed: Mar. 3, 2015

(86) PCT No.: PCT/CA2015/050159
§ 371 (c)(1),
(2) Date: Dec. 12, 2016

(87) PCT Pub. No.: WO2015/188265
PCT Pub. Date: Dec. 17, 2015

(65) Prior Publication Data

US 2017/0106295 A1 Apr. 20, 2017

Related U.S. Application Data

(60) Provisional application No. 62/011,898, filed on Jun. 13, 2014.

(51) Int. Cl.
*A63G 21/18* (2006.01)
*A63G 21/10* (2006.01)
(Continued)

(52) U.S. Cl.
CPC ..... *A63G 21/18* (2013.01); *A63G 21/10* (2013.01); *A63G 21/14* (2013.01); *A63G 31/007* (2013.01)

(58) Field of Classification Search
CPC ..... A63G 21/00; A63G 21/18; A63G 31/00; A63G 31/007
(Continued)

(56) References Cited

U.S. PATENT DOCUMENTS 5,137,497 A 8/1992 Dubeta
6,743,107 B2 * 6/2004 Dubeta ..... A63G 21/02 472/116
(Continued)

FOREIGN PATENT DOCUMENTS

CA 2778601 A1 5/2011
CA 2690687 A1 7/2011
(Continued)

OTHER PUBLICATIONS

CIPO Examination Notes, supplemental information document. Reference No. 75956-206, corresponding to International Application No. PCT/CA2015/05015. 2 pp.
(Continued)

*Primary Examiner* — Kien T Nguyen
(74) *Attorney, Agent, or Firm* — Finnegan, Henderson, Farabow, Garrett & Dunner, L.L.P.

(57) ABSTRACT

A slide feature for an amusement ride adapted to carry a rider or ride vehicle sliding thereon, and a water slide comprising said slide feature are provided. The slide feature has an inrun permitting ingress of the rider or ride vehicle, an outrun permitting egress, and a sliding surface in communication with the inrun and the outrun. The sliding surface may comprise a surface substantially in the shape of a sector of a closed curve and/or may be substantially planar. The slide feature may also include an outer lip and provide that the rider or ride vehicle, at least partially urged by gravity, slides along the sliding surface from the inrun to the out run in an arcuate path at least partially bounded by the outer lip. The sliding surface may be oriented so an elevation of the rider or ride vehicle increases then decreases along the arcuate path.

34 Claims, 49 Drawing Sheets

(51) Int. Cl.
*A63G 21/14* (2006.01)
*A63G 31/00* (2006.01)

(58) Field of Classification Search
USPC ..... 472/13, 116–117, 128–129; 104/69–70
See application file for complete search history.

(56) References Cited

U.S. PATENT DOCUMENTS

| | | | | |
|---|---|---|---|---|
| 7,854,662 | B2 | 12/2010 | Braun | |
| 7,967,692 | B2 * | 6/2011 | Werner | A63G 21/18 434/44 |
| 8,197,353 | B2 * | 6/2012 | Brassard | A63G 21/18 104/69 |
| 8,226,492 | B2 * | 7/2012 | Hunter | A63G 21/18 472/116 |
| 8,360,895 | B2 | 1/2013 | Brown | |
| 2006/0194638 | A1 | 8/2006 | Hunter | |
| 2008/0153610 | A1 | 6/2008 | Braun et al. | |
| 2009/0221377 | A1 | 9/2009 | Hlynka | |
| 2011/0177872 | A1 * | 7/2011 | Hunter | A63G 21/18 472/117 |
| 2012/0100921 | A1 | 4/2012 | Brown | |
| 2012/0277011 | A1 * | 11/2012 | Hunter | A63G 21/18 472/88 |

FOREIGN PATENT DOCUMENTS

| | | | |
|---|---|---|---|
| CN | 201832417 | U | 5/2011 |
| CN | 301641950 | S | 10/2011 |
| CN | 202777765 | U | 3/2013 |
| RU | 68338 | U1 | 11/2007 |
| WO | WO2011/057395 | | 5/2011 |
| WO | WO 2012/065172 | A | 5/2012 |

OTHER PUBLICATIONS

International Preliminary Report on Patentability, issued by the International Bureau of WIPO, dated Dec. 15, 2016. 1 p.

International Search Report, issued by the Canadian Intellectual Property Office, in corresponding International Application No. PCT/CA2015/050159, dated May 11, 2015, 2 pp.

Written Opinion of the International Searching Authority, issued by the Canadian Intellectual Property Office in corresponding International Application No. PCT/CA2015/050159, dated May 11, 2015, 6 pp.

Extended European Search Report, issued by the European Patent Office in Application No. 15807312.2-1126/3154649 (PCT/CA2015050159), dated Jan. 2, 2018, 11 pages.

Search Report and Written Opinion, issued by the Singapore Intellectual Property Office, in corresponding Singapore Patent Application No. 11201610338U, dated Jan. 15, 2018, 12 pp.

Non-English and translated Official Action, issued by the Russian Federation, referencing Application No. 2017100943 (reference No. 2413-539425RU), dated Aug. 31, 2018, 13 pages.

Search Authority, Federal Institute of Industrial Property, (FIPS), issued by the Russian Federation, referencing Application No. 2017100943 (reference No. 2413-539425RU); completion of search, Jul. 30, 2018, 2 pages.

Non-English and translated second Official Action, issued by the Beijing SUNHOPE Intellectual Property Limited, in counterpart Chinese Application No. 201580036427.X dated Dec. 6, 2018, 11 pages.

Office Action, issued in corresponding Chinese Application No. 201580036427.X, from the Chinese Patent Office, dated Mar. 26, 2018.

Communication, issued from the European Patent Office, in corresponding Application No. 15 807 312.2-1156, dated Jan. 22, 2018 (7 pages).

Decision to Grant, issued from the Russian Federal Service for Intellectual Property, in corresponding Russian Application No. 2017100943, Decision to Grant, dated Jan. 29, 2019 (18 pages).

Japanese Office Action, Notice of Reasons for Rejection, issued from the Japanese Patent Office, in corresponding Application No. JP2017-517154 A. dated Jan. 26, 2019 (9 pages).

Third Official Action, issued by Beijing Sunhope Intellectual Property Limited, in counterpart Chinese Application No. 201580036427.X, dated Aug. 15, 2019, 13 pages.

* cited by examiner

WATER RIDE

FIELD

The present disclosure relates generally to amusement rides, and more specifically to water slide rides and portions thereof.

BACKGROUND

The amusement park industry is competitive and evolving. Park operators strive to offer new, innovative rides to provide exciting and thrilling experiences for patrons.

Some slide-based rides are known. For example, in conventional water slides, patrons enter the ride at a high elevation and travel to a terminal destination at a lower elevation by sliding along a chute or flume. To facilitate sliding, portions of a water slide may be lubricated with a volume of water.

In some water slides, patrons may sit or lie on a vehicle designed to contact the ride surface. In some water slides, patrons may slide along the ride without a vehicle, with their bodies in contact with the ride surface.

In U.S. Pat. No. 7,854,662 B2 to Braun et al., a water slide having at least one loop section is described. One problem with the water slide described in U.S. Pat. No. 7,854,662 B2 is that, due to the use of the loop, there is a need for an evacuation platform at the valley and as well as the apex of the loop. In addition, confining riders to such a loop may decrease the thrill of the ride.

In some commercially available water slides, such as rides sold by ProSlide Technology Inc. under the trademarks CannonBOWL™, BulletBOWL™, ProBOWL™, and BehemothBOWL™, riders are deposited from a chute into a round, horizontally-oriented bowl. Riders enter the bowl along the wall of the bowl and exit from the bottom center of the bowl.

There is a need for water rides that address the problems and disadvantages of previous rides while providing more exciting experiences for riders.

SUMMARY

According to an aspect, there is provided a slide feature for an amusement ride adapted to carry a rider or ride vehicle sliding thereon, the slide feature comprising: an inrun permitting ingress of the rider or ride vehicle, an outrun permitting egress of the rider or ride vehicle, a substantially planar sliding surface in communication with the inrun and the outrun, wherein the sliding surface comprises a surface substantially in the shape of a sector of a closed curve; and an outer lip extending from the inrun to the outrun, wherein the slide feature provides that the rider or ride vehicle, at least partially urged by gravity, slides along the sliding surface from the inrun to the outrun in an arcuate path at least partially bounded by the outer lip.

Optionally, the sliding surface is substantially planar.

Optionally, the sliding surface is oriented at a pitch angle around a pitch axis, the pitch angle being measured relative to a horizontal plane; the sliding surface is oriented at a roll angle around a roll axis, the roll angle being measured relative to the horizontal plane, the pitch axis and the roll axis are mutually perpendicular, and at least one of the pitch angle and the roll angle is nonzero.

Optionally, the pitch angle and the roll angle are selected so that an elevation of the rider or ride vehicle increases along a first portion of the arcuate path and decreases along a second portion of the arcuate path.

Optionally, each of the pitch angle and the roll angle is less than 45°.

Optionally, at least one of the pitch angle and the roll angle is 11.25°.

Optionally, each of the pitch angle and the roll angle are between 15° and 18°.

Optionally, the roll angle is 11.25° and the pitch angle is 22.5°.

Optionally, a diameter of the slide feature is between 15 feet to 25 feet.

Optionally, a radius of the sliding surface is continuously reduced from the inrun to the outrun.

Optionally, the radius of the sliding surface at the outrun is 75% of the radius of the sliding surface at the inrun.

Optionally, a radius of the sliding surface is constant from the inrun to the outrun.

Optionally, the sliding surface is uncovered.

Optionally, the slide feature comprises a cover over the sliding surface.

Optionally, the cover has at least one of a hemispherical or domed shape.

Optionally, the slide feature is adapted to carry a ride vehicle and the ride vehicle comprises a raft for seating one human or a raft for seating two humans in an inline configuration.

Optionally, a shape of the inrun and a shape of the outrun each are adapted to interface with water slide chutes having a circular or semi-circular cross-section.

Optionally, the sliding surface comprises a groove for guiding the path of the rider.

Optionally, the sliding surface comprises a flexible material with a textured surface.

Optionally, the outer lip has a substantially flat cross-section perpendicular to the sliding surface.

Optionally, the outer lip has a curved cross-section.

Optionally, an edge of the sliding surface is curved to provide a smooth transition to the outer lip.

Optionally, an edge of the sliding surface is angled to meet the outer lip.

Optionally, the edge of the sliding surface is angled at an angle between 10° and 45° relative to a central part of the sliding surface.

According to another aspect, there is provided a slide feature for an amusement ride adapted to carry a rider or ride vehicle sliding thereon, the slide feature comprising: an inrun permitting ingress of the rider or ride vehicle, an outrun permitting egress of the rider or ride vehicle, a sliding surface in communication with the inrun and the outrun, wherein the sliding surface is substantially planar; and an outer lip extending from the inrun to the outrun, wherein the slide feature provides that the rider or ride vehicle, at least partially urged by gravity, slides along the sliding surface from the inrun to the outrun in an arcuate path at least partially bounded by the outer lip, and wherein the sliding surface is oriented so that an elevation of the rider or ride vehicle increases along a first portion of the arcuate path and decreases along a second portion of the arcuate path.

Optionally, the sliding surface is oriented at a pitch angle around a pitch axis, the pitch angle being measured relative to a horizontal plane; the sliding surface is oriented at a roll angle around a roll axis, the roll angle being measured relative to the horizontal plane, the pitch axis and the roll axis are mutually perpendicular, and both the pitch angle and the roll angle are nonzero.

According to still another aspect, there is provided a slide feature for an amusement ride adapted to carry a rider or ride vehicle sliding thereon, the slide feature comprising: an inrun permitting ingress of the rider or ride vehicle, an outrun permitting egress of the rider or ride vehicle, a sliding surface in communication with the inrun and the outrun, wherein the sliding surface comprises a substantially circular or substantially elliptical surface; and an outer lip extending from the inrun to the outrun, wherein the slide feature provides that the rider or ride vehicle, at least partially urged by gravity, slides along the sliding surface from the inrun to the outrun in an arcuate path at least partially bounded by the outer lip.

According to yet another aspect, there is provided a water slide comprising a slide feature as described above.

Optionally, the water slide comprises a support structure supporting the slide feature, wherein the support structure is configured to dynamically impart movement to the slide feature.

Various aspects and features of the disclosure are described in further detail below.

BRIEF DESCRIPTION OF THE DRAWINGS

Examples of embodiments will now be described in greater detail with reference to the accompanying drawings, in which.

DETAILED DESCRIPTION

Figure 1A:
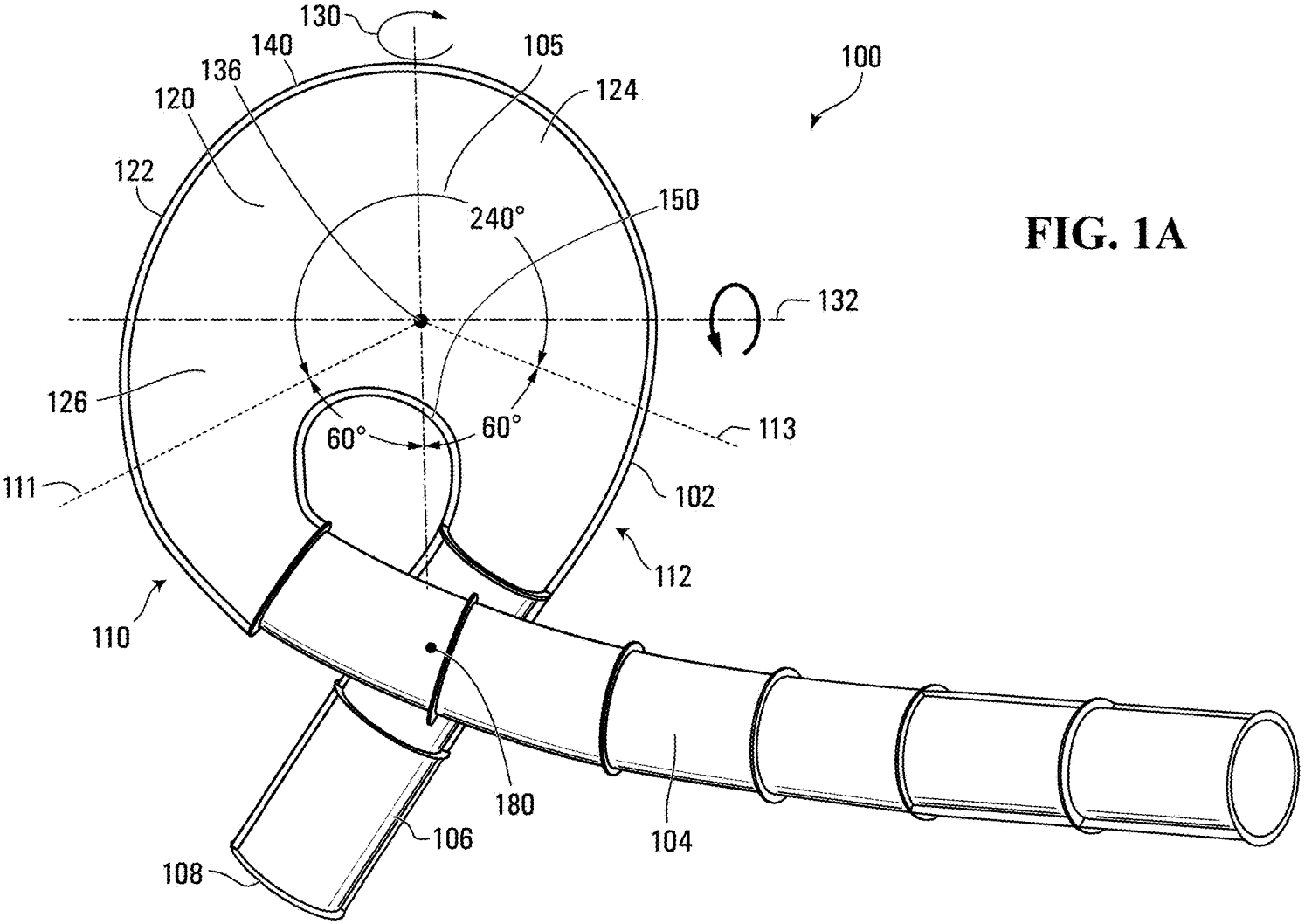
FIGS. 1A-1D show a first embodiment of the slide feature coupled to entry and exit chutes.

FIGS. 1A-1D illustrate a first embodiment of a slide feature 102 for a water slide 100, the slide feature 102 being coupled to entry chute 104 and exit chute 106 of the water slide 100. The entry chute 104 and exit chute 106 illustrated each have a closed, circular cross-section, but it should be understood that embodiments of the slide feature 102 may be used with other known water slide chutes, for example chutes having an open, semi-circular cross-section, and/or other known entry and exit features, such as funnels and vertical drops.

The slide feature 102 is adapted to carry a rider or a ride vehicle sliding thereon. In some embodiments, the slide feature 102 may be adapted to carry one or more riders and/or one or more ride vehicles sliding thereon simultaneously.

Although entry chute 104 and exit chute 106 are illustrated as having a certain length, it should be understood that entry chute 104 and exit chute 106 may continue for a shorter or a longer distance than shown and/or interface with another slide feature (not shown) or another portion of water slide 100 (also not shown). In some embodiments, riders or ride vehicles may exit the water slide through exit chute opening 108 and tumble into a pool of water (not shown) below the slide feature 102.

To facilitate sliding, the slide feature 102 may be lubricated with water. In some embodiments, a stream of water may enter the slide feature 102 from entry chute 104, the stream of water being supplied by a start tub (not shown) of the water slide. In some embodiments, the start tub may supply water at a rate of approximately 2500 U.S. gallons per minute. In other embodiments, the start tub may supply water at a rate of approximately 3000 U.S. gallons per minute. In still other embodiments, the start tub may supply water at other rates. In some embodiments, the slide feature 102 may be fitted with water jets and/or other means of supplying water, for example as an alternative to water from a start tub and/or to provide sliding surface lubrication in areas where water supplied by the start tub does not adequately lubricate the slide feature 102. In some embodiments, water may exit the slide feature 102 via exit chute 106. In other embodiments, water may be evacuated through an opening (not shown) in the slide feature 102, or other means of evacuating water that would be known to a person skilled in the art may be provided. In other embodiments, the slide feature 102 may be lubricated with other substances and/or may be formed with a material that does not require lubrication, for example a low friction material.

With reference to FIG. 1A, the slide feature 102 is depicted in plan view. The slide feature 102 comprises an inrun 110 and outrun 112, as well as a sliding surface 120 between the inrun 110 and the outrun 112. In FIG. 1A, line 111 has been drawn to define in general terms where inrun 110 transitions to sliding surface 120, and line 113 has been drawn to define in general terms where sliding surface 120 transitions to outrun 112. However, it should be understood that lines 111 and 113 could be drawn in other locations and that the transitions between inrun 110, sliding surface 120, and outrun 112 may be smooth and not apparent to riders. In the depicted embodiment, the obtuse central angle 105 between line 111 and line 113 is 240°.

In the embodiment depicted, the entry chute 104 and the exit chute 106 have a cross over point 180 where the entry chute 104 and the exit chute 106 are in proximity and cross over each other when the slide feature 102 is viewed from above.

In some embodiments, the inrun 110 may have a concave, partly concave, and/or partly helical shape, where a low point along the concave, partly concave, and/or partly helical shape of the inrun 110 may assist in guiding riders or ride vehicles entering the slide feature 102 towards an outer lip 122 of the slide feature 102. In some embodiments, the outrun 112 may have a convex or partly convex shape whose edges are tangential to, or intersect with, the exit chute 106, where a raised portion of the convex or partly convex shape may assist in guiding riders or ride vehicles exiting the slide feature 102 towards exit chute 106. In other embodiments, the inrun 110 may have a convex or partly convex shape. In other embodiments, the outrun 112 may have a concave, partly concave, and/or partly helical shape. More generally, the inrun 110 and outrun 112 may have other shapes for interfacing with the entry chute and exit chute. In some embodiments, the lowest point of the inrun 110 and/or outrun 112 may be located so that a person who stops moving or who exits a vehicle being ridden may be flushed out by water circulated within the slide feature 102.

In some embodiments, the location at which a rider or ride vehicle's path transitions between the inrun 110 and the sliding surface 120 occurs proximal to a floor 126 of the sliding surface 120 (i.e., proximal to the plane of the sliding surface 120). In other embodiments, the location at which a rider or ride vehicle's path transitions between the inrun 110 and the sliding surface 120 may occur proximal to an outer lip 122 of the slide feature. Outer lip 122, described in additional detail further below, may serve to partially bound the sliding surface 120.

In some embodiments, riders or ride vehicles may enter the inrun 110 at speeds of between 16 to 18 feet per second. In other embodiments, for example, embodiments in which the entry chute 104 may be designed to provide acceleration, riders or ride vehicles may enter the inrun 110 at higher speeds than 18 feet per second. For instance, in some example embodiments, riders or ride vehicles may enter the inrun 110 at between 22 to 24 feet per second. It should be understood, however, that other embodiments may be configured so that riders or ride vehicles may enter the inrun 110 at other speeds.

The sliding surface 120 may be in a shape that is substantially based on, or derived from, a sector of a closed curve. For example, the sliding surface 120 may be in the shape of a sector of a circle (also referred to as a circular sector) or of a sector of an ellipse (also referred to as an elliptical sector). A sector of a closed curve may be defined by the area formed by two line segments drawn between the centroid or geometric center of a closed curve and the perimeter of the closed curve. Although the sliding surface 120 may in some embodiments comprise a surface substantially in the shape of a sector of a smooth closed curve to facilitate a comfortable ride experience for riders, in other embodiments, the sliding surface 120 may comprise a surface substantially in the shape of a sector of a closed curve having some non-smooth portions. For example, the sliding surface 120 may comprise a surface substantially in the shape of a sector of a piecewise smooth closed curve, where a piecewise smooth closed curve is defined as a closed curve consisting of the union of several individual smooth curves, where the areas in which the individual smooth curves meet may not be smooth.

In alternative embodiments, the sliding surface 120 may be based on, or derived from, other shapes. In some embodiments, the sliding surface 120 may comprise a substantially circular or substantially elliptical surface. In some embodiments, it may be desirable that the sliding surface 120 and/or the slide feature 102 as a whole has a shape that visually suggests to riders and/or other viewers the idea of a dinner saucer and/or of an unidentified flying object (UFO). In some embodiments, for example embodiments where the sliding surface 120 comprises a surface substantially in the shape of a sector of a closed curve, to facilitate providing a shape for the slide feature 102 that may suggest a dinner saucer and/or a UFO, the sliding surface 120 may have one or more portions that extend beyond a portion of the sliding surface 120 substantially in the shape of a sector of a closed curve. In other embodiments where the sliding surface 120 comprises a surface substantially in the shape of a sector of a closed curve, the surface substantially in the shape of a sector of a closed curve may be adjacent to surfaces of the slide feature 102 that are primarily decorative rather than being intended for sliding. In some embodiments, the surfaces of the slide feature 102 that are primarily decorative may be located between the inrun 110 and the outrun 112 and opposite the outer lip 122.

In some embodiments, the shape of the sliding surface 120 may not include a portion of the center of a closed curve. That is, a central portion of the slide feature 102 may have an open aperture towards the center of the sliding surface 120. In some embodiments, an opening or openings may also be located in other areas of the sliding surface 120.

The embodiment depicted in FIG. 1A has a substantially planar sliding surface 120. However, it should be understood that other sliding surfaces are contemplated in other embodiments, including sliding surfaces that are not substantially planar. For example, the sliding surface 120 may have a curved or wave-like cross-section. In some embodiments, the sliding surface 120 may have a substantially or partially helical profile. In some embodiments, the sliding surface 120 may have an uneven or textured surface. In some embodiments, sliding surface 120 may be convex or concave, in whole or in part.

In the embodiment depicted in FIG. 1A, located along an outer circumferential edge of the slide feature 102 is an outer lip 122 extending from the inrun 110 to the outrun 112. Outer lip 122 is described in additional detail further below.

Also identified in FIG. 1A are a roll axis 130 and a pitch axis 132, the roll axis 130 and the pitch axis 132 being mutually perpendicular. Each of the roll axis 130 and pitch axis 132 is illustrated surrounded by arrows indicating the direction in which a positive rotation along each axis would tilt the slide feature 102. In the depicted embodiment, each of the roll axis 130 and pitch axis 132 lies along a horizontal plane 190 (not shown in FIG. 1A; depicted in FIGS. 1B-1D) passing through a portion of the sliding surface 120, the horizontal plane 190 being parallel to a ground surface (not shown) beneath the slide feature 102. However, in some embodiments, each of the roll axis 130 and pitch axis 132 may have a different location, thereby permitting the sliding surface 120 to have any orientation in three-dimensional space relative to the ground surface beneath the slide feature 102. Further, in the depicted embodiment, the intersection point of the roll axis 130 and the pitch axis 132 is shown located at a point 136 proximal to a center portion of the slide feature. In some embodiments, the intersection point of the roll axis 130 and the pitch axis 132 may have another location.

It should be understood that the words "roll axis" and "pitch axis" are arbitrary identifiers, and that other names could be applied to these axes. For example, the identifiers "roll axis" and "pitch axis" could be switched. That is, the words "roll axis" could be used to refer to the pitch axis 132, and the words "pitch axis" could be used to refer to the roll axis 130.

An apex 140 is labeled in FIG. 1A indicating a location at which riders or ride vehicles may, in the depicted embodiment, reach a highest elevation while sliding around the slide feature 102. In some embodiments, the apex may have another location or may not be defined. For example, the apex may be undefined in embodiments where the sliding surface 120 is oriented parallel to the horizontal plane 190, or in embodiments where the sliding surface 120 is oriented so that riders or ride vehicles have a continuously decreasing elevation while sliding around the slide feature 102.

An optional inner lip 150 is depicted extending between the inrun 110 and the outrun 112 opposite the outer lip 122 as a safety feature for preventing riders or ride vehicles from sliding out of the slide feature 102. Alternatively, railings, nets, or other structures may be provided in place of, or in addition to, the optional inner lip 150 to prevent riders or ride vehicles from sliding out of the slide feature 102.

In some embodiments, the slide feature 102 may be configured so that a rider or ride vehicle traveling down the water slide 100 enters the slide feature 102 from the entry chute 104 via the inrun 110. At least partially urged by gravity, the rider or ride vehicle slides along the sliding surface 120 from the inrun 110 to the outrun 112 in an arcuate path at least partially bounded by the outer lip 122, and then exits the slide feature 102 via the exit chute 106. In some embodiments, the arcuate path may be a substantially circular arc.

In some embodiments, because the arcuate path traveled by riders or ride vehicles (including the apex 140 of the arcuate path and a lowest point, or valley, of the arcuate path) is located within the boundaries of a slide feature 102 having a sliding surface 120 comprising a surface that is substantially in the shape of a sector of a closed curve, no evacuation platform or other evacuation provision, for the evacuation of water and/or dirt and/or for the evacuation of riders, may be required in order to safely use the slide feature 102 as part of a water slide 100.

To control the ride path of a rider or ride vehicle so that the rider or ride vehicle slides along the sliding surface 120 from the inrun 110 to the outrun 112 in an arcuate path, the radius of the sliding surface may be continuously reduced from the inrun 110 to the outrun 112. (The radius of the sliding surface may be measured relative to a point 136 proximal to a center portion of the slide feature 102, where this center portion may be a geometric center of the slide feature 102, a radial center of an arcuate path traveled by a rider or ride vehicle, or another centrally located portion of the slide feature 102.) Such a continuously reducing radius may cause centripetal or centrifugal forces to urge the rider or ride vehicle towards the outer lip 122. In some embodiments, the radius of the sliding surface at line 113 where the sliding surface 120 meets the outrun 112 may be approximately 75% of the radius of the sliding surface at line 111 where the inrun 110 meets the sliding surface 120. Other embodiments may provide for the sliding surface 120 to have a constant or expanding radius from the inrun 110 to the outrun 112.

In some embodiments, it may be desirable that the inrun 110 compounds (i.e., transitions) from a large radius to a smaller radius relative to point 136 in order to urge the rider or ride vehicle towards the outer lip 122 as the rider or ride vehicle enters the slide feature 102. In some embodiments, it may be desirable that the outrun 112 compounds in a similar manner in order to urge the rider or ride vehicle into the exit chute 108. In some embodiments, the inrun 110 and/or the outrun 112 may compound in the opposite manner, namely from a smaller radius to a large radius relative to point 136.

In some embodiments, it may be desirable to increase or maximize the centripetal forces acting upon a rider or ride vehicle by gradually reducing radii (measured relative to point 136) of parts of entry chute 104 and/or inrun 110 leading into the slide feature 102. Such a configuration may affect the speed at which riders begin traveling along sliding surface 120. In other embodiments, it may be desirable to gradually increase radii (measured relative to point 136) of parts of exit chute 106 and/or outrun 112 leading out of the slide feature 102. Such a configuration may affect the speed at which riders exit the slide feature 102. In some embodiments, designs such as these may facilitate providing a fast, sweeping experience for riders.

Figure 1B:
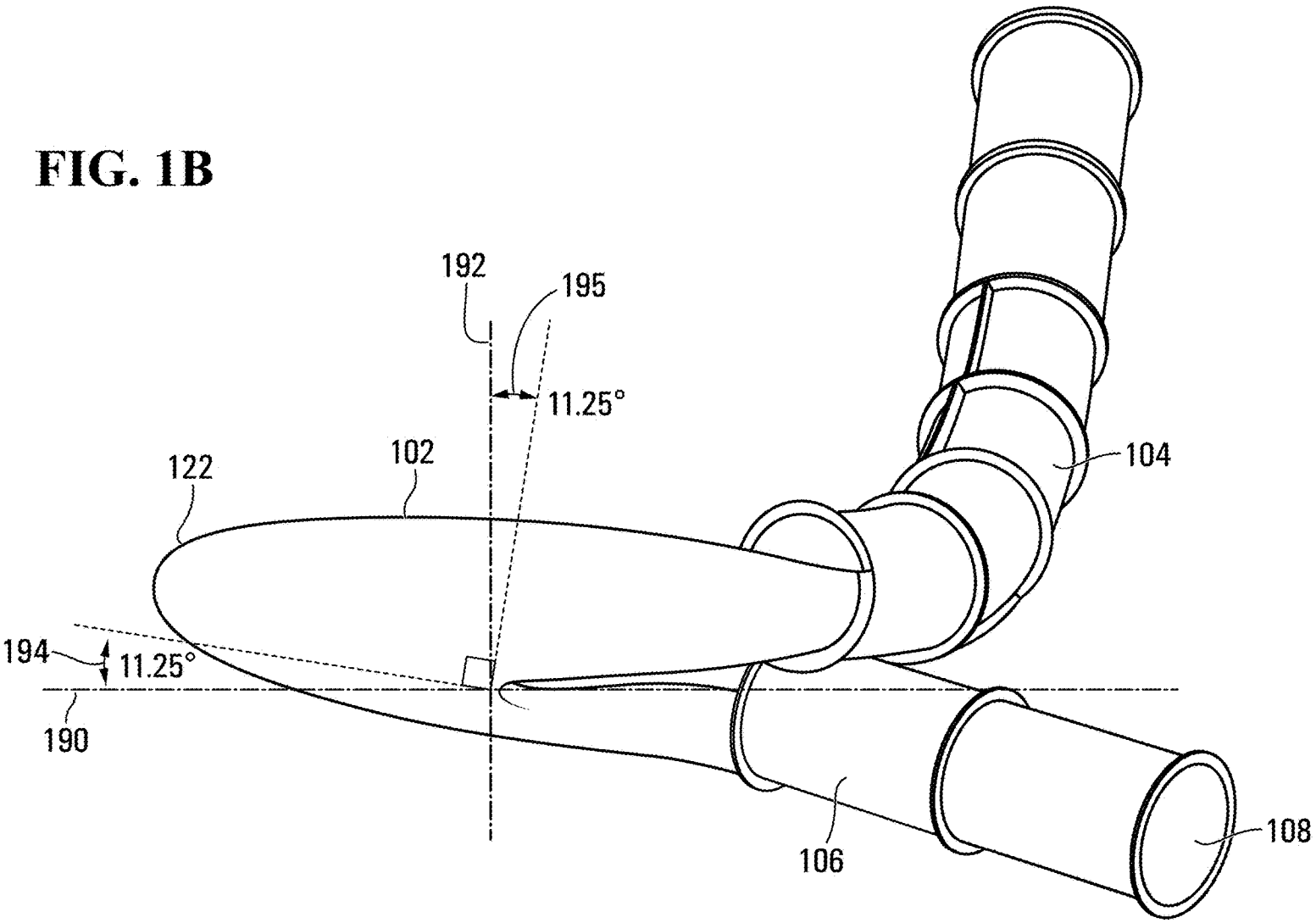
Figure 1C:
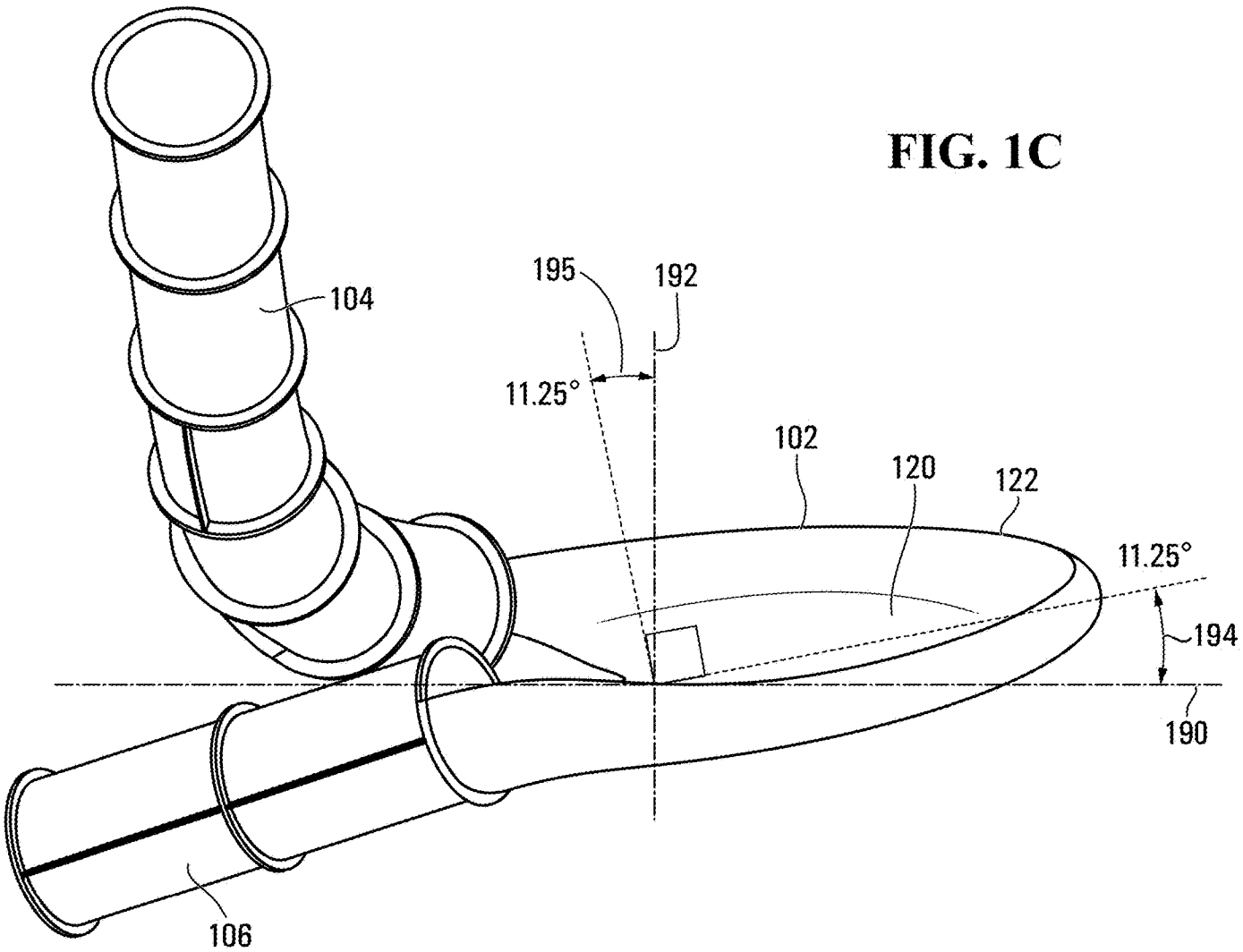
Figure 1D:
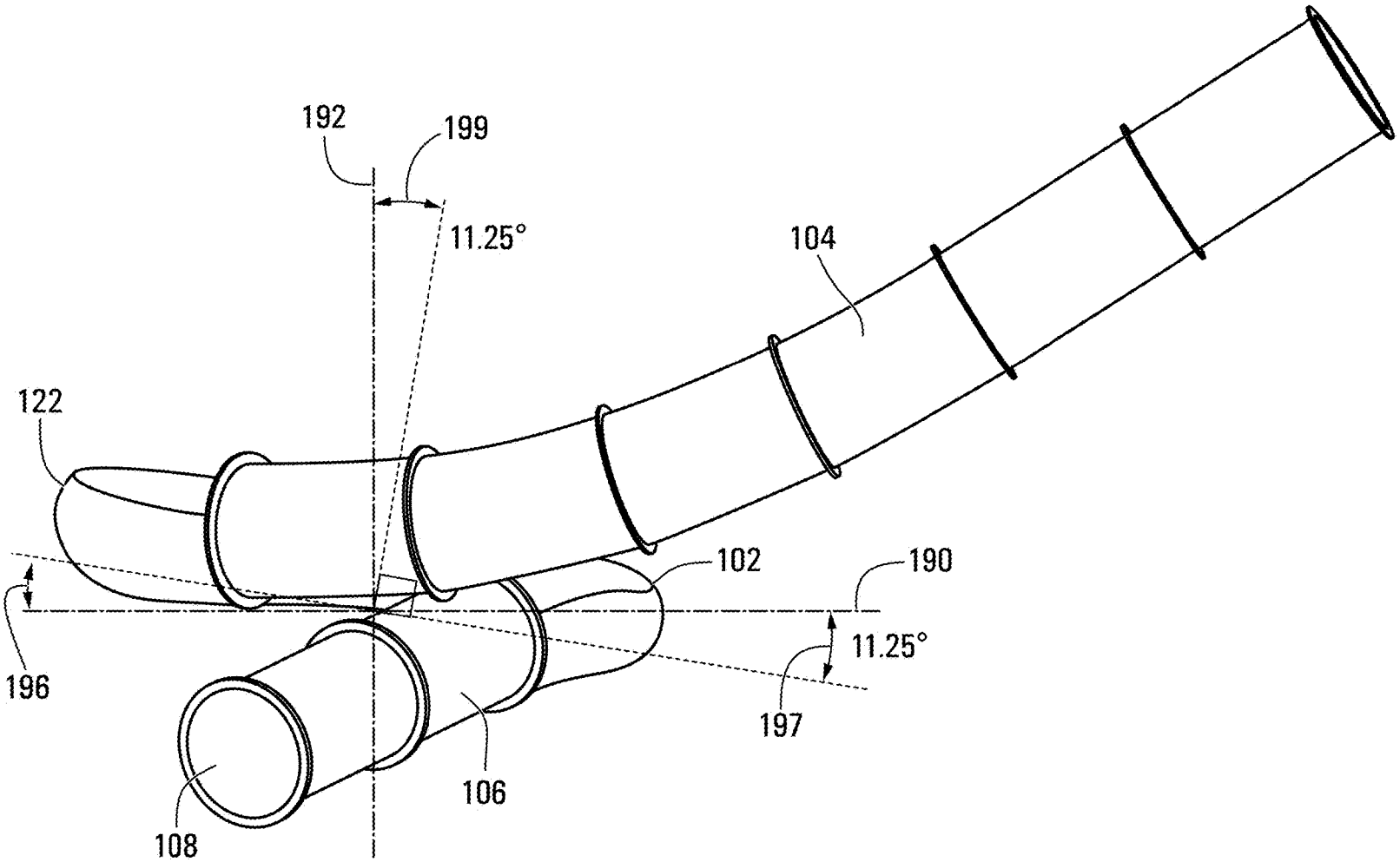

FIGS. 1B-1D depict the slide feature 102 of FIG. 1A from three side elevational views. The slide feature 102 is shown inclined relative to horizontal plane 190 and vertical axis 192. In FIGS. 1B and 1C, the sliding surface 120 is depicted inclined at a pitch angle 194 relative to the horizontal plane 190 (i.e., in each of FIGS. 1B and 1C, the pitch axis 132, not shown in these figures, is parallel to the viewing direction from which these figures are drawn). Also illustrated is an angle 195 measured between vertical axis 192 and a right angle taken from pitch angle 194. In FIG. 1D, the sliding surface 120 is depicted inclined at a roll angle 196 relative to the horizontal plane 190 (i.e., in FIG. 1D, the roll axis 130, not shown in this figure, is parallel to the viewing direction from which this figure is drawn). Also illustrated is an angle 199 measured between vertical axis 192 and a right angle taken between vertical axis 192 and a right angle taken from roll angle 196. Also illustrated is an angle 197 measured between the horizontal plane 190 and a right angle taken from angle 199. In the embodiment depicted in FIGS. 1B-1D, both of the roll angle 196 and the pitch angle 194 are equal and measure 11.25°. However, it should be understood that the roll angle 196 and the pitch angle 194 illustrated in FIGS. 1B-1D are intended to depict an example embodiment and that other roll and pitch angles may be selected. For example, in some embodiments, the roll angle 196 and the pitch angle 194 may not be equal.

In some embodiments, the roll angle 196 and the pitch angle 194 may be selected so that an elevation of the rider or ride vehicle sliding along the sliding surface 120 increases along a first portion of the rider or ride vehicle's path and decreases along a second portion of the rider or ride vehicle's path. Apex 140 may be the point at which the first portion of the rider or ride vehicle's path ends and the second portion of the rider or ride vehicle's path begins. Riders may experience a zero-gravity sensation along at least one axis in the vicinity of the apex 140. This zero-gravity sensation may be due to the rider or ride vehicle's elevation increasing along the first portion of the rider or ride vehicle's path and then decreasing along the second portion of the rider or ride vehicle's path.

In some embodiments, the roll angle 196 and the pitch angle 194 may be selected so that an elevation of the rider or ride vehicle sliding along the sliding surface 120 remains substantially constant. In some embodiments, at least one of the roll angle 196 or the pitch angle 194 may be zero relative to the horizontal plane 190. In some embodiments, either a portion of the sliding surface 120 or the entirety of the sliding surface 120 may be substantially parallel to the horizontal plane 190.

In some embodiments, the roll angle 196 and the pitch angle 194 may be selected so that an elevation of the rider or ride vehicle sliding along the sliding surface 120 either continuously decreases or is continuously nonincreasing along the length of the rider or ride vehicle's path. In some embodiments, at least one of the roll angle 196 or the pitch angle 194 may be negative (i.e., angled downwards) when measured relative to the horizontal plane 190.

Each of the roll angle 196 and the pitch angle 194 may be adjusted to provide a more or less thrilling ride experience. In some typical embodiments, each of the roll angle 196 and the pitch angle 194 may be less than or equal to 45°. In some typical embodiments, each of the roll angle 196 and the pitch angle 194 may be in the range of 15° to 18°. In other typical embodiments, each of the roll angle 196 and the pitch angle 194 may be in the range of 20° to 25°. In an exemplary embodiment, each of the roll angle 196 and the pitch angle 194 may be 11.25°. In another exemplary embodiment, the roll angle 196 may be 11.25° and the pitch angle 194 may be 22.5°. In another exemplary embodiment, each of the roll angle 196 and the pitch angle 194 may be less than 5°. In some conceivable embodiments, each of the roll angle 196 and the pitch angle 194 may be less than or equal to 80°.

The diameter of the slide feature 102 may also be adjusted to provide a more or less thrilling ride experience. In some typical embodiments, the diameter of the slide feature 102, as measured at the widest point across the sliding surface 120, may be in the range of 15 feet to 25 feet. In other embodiments, the diameter of the slide feature 102 may be larger than 25 feet. In some conceivable embodiments, the diameter of the slide feature 102 may be smaller than 15 feet.

In an embodiment, human riders may travel through the slide feature 102 while sitting atop, or lying down upon, mobile ride vehicles. Some contemplated ride vehicles include rafts designed to seat or otherwise accommodate one or more riders, tubes designed to seat a single rider, and double inline tubes designed to seat two riders. Other amusement vehicles that would be known to a person skilled in the art, including tubes capable of accommodating more than two riders, are also contemplated. In some embodiments, riders may travel through the slide feature 102 without a ride vehicle and with their bodies in contact with the sliding surface 120.

In some embodiments, riders or ride vehicles may be urged through the slide feature 102 by the influence of gravitational forces. In alternative embodiments, the movement of riders or ride vehicles through the slide feature 102 may be at least partially assisted by other acting forces, including but not limited to forces created by water jets or forces applied to, and/or applied by, a ride vehicle. For example, in some embodiments a linear induction motor may be used to accelerate a ride vehicle through portions of the slide feature 102.

In the embodiment illustrated in FIGS. 1A-1D, the outer lip 122 has a curved cross-section. In an embodiment, the curved cross-section of the outer lip 122 may be based on the cross-section of a 54 inch diameter flume. In some embodiments, the outer edge 124 of the sliding surface 120 is curved to provide a smooth transition between the sliding surface 120 and the outer lip 122. In such embodiments, a rider or ride vehicle may at least partially slide along some portions of the sliding surface 120 that are curved to meet the outer lip 122. In other embodiments, the outer edge 124 of the sliding surface 120 may be angled upwards (or banked upwards) relative to the central part of the sliding surface 120 to meet the outer lip 122. In such embodiments, a rider or ride vehicle may at least partially slide along some of the angled portions of the sliding surface 120. In some embodiments where the outer edge 124 of the sliding surface 120 is banked upwards, the outer edge 124 may be banked upwards at an angle between 10° and 45° relative to the central part of the sliding surface 120. In some embodiments, the outer lip 122 may have a substantially flat cross-section perpendicular to the sliding surface 120, thereby preventing a rider or ride vehicle from riding up on any portion of the outer lip 122. Alternatively, in some embodiments, a rider or ride vehicle may ride completely or primarily along the surface of outer lip 122 (as opposed to riding along sliding surface 120), for either a portion or the entirety of the rider or ride vehicle's travel through slide feature 102. In some embodiments, a smooth transition between outer lip 122 and the outer edge 124 of the sliding surface 120 may facilitate the rider or ride vehicle transitioning from traveling along portions of the sliding surface 120 to traveling along outer lip 122, or transitioning from traveling along outer lip 122 to traveling along portions of the sliding surface 120.

In the embodiment illustrated in FIGS. 1A-1D, the substantially planar sliding surface 120 has a generally flat surface. Some riders or ride vehicles which do not enter the slide feature 102 with sufficient momentum, or riders or ride vehicles which exceed a body weight threshold or a particular range of body weights, may slide across an interior portion of the sliding surface 120 rather than traveling from the inrun 110 to the outrun 112 in an arcuate path proximal to the length of the outer lip 122. In some embodiments, the slide feature 102 may be configured with means for causing riders or ride vehicles to slide across an interior portion of the sliding surface 120 rather than traveling from the inrun 110 to the outrun 112 in an arcuate path proximal to the length of the outer lip 122. For example, in some embodiments, water jets and/or linear induction motors may be mounted to the slide feature 102 that, when activated, create a force or forces whose action urges riders or ride vehicles away from the outer lip 122 and/or towards an interior portion of the sliding surface 120.

In some embodiments, the substantially planar sliding surface 120 may have a shaped groove for at least partially guiding the path of riders or ride vehicles from the inrun 110 to the outrun 112.

In some embodiments, single human riders weighing between 50 and 375 pounds sitting atop a ride vehicle and/or a pair of human riders weighing between 100 and 600 pounds combined sitting atop a ride vehicle may slide along the sliding surface 120 from the inrun 110 to the outrun 112 as contemplated, i.e., in an arcuate path at least partially bounded by the outer lip 122. However, it should be understood that other embodiments capable of accommodating differing configurations of riders and/or ride vehicles having different weight parameters are also contemplated.

FIGS. 2A-2D illustrate another embodiment of a slide feature 202 for a water slide 200, the slide feature 202 being coupled to entry chute 204 and exit chute 206 of the water slide 200 and having a sliding surface 220 inclined at a greater pitch angle than the embodiment depicted in FIGS. 1A-1D. The embodiment depicted in FIGS. 2A-2D also differs from the embodiment depicted in FIGS. 1A-1D in that, for example, sliding surface 220 is more generally elliptical in shape than sliding surface 120, and a cross-section of outer lip 222 has a greater degree of curvature than outer lip 122.

Figure 2A:
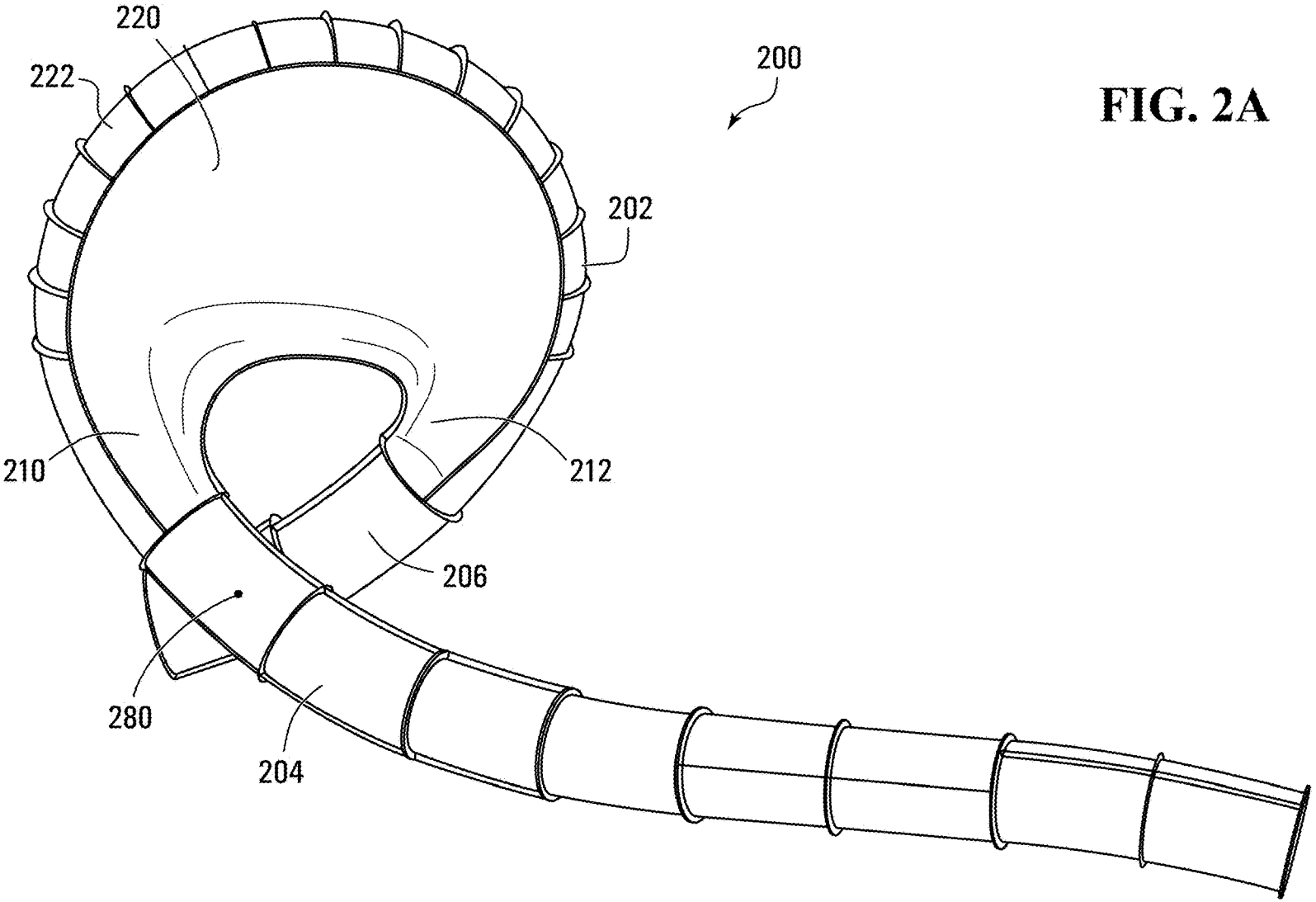
FIGS. 2A-2D show another embodiment of the slide feature coupled to entry and exit chutes.

With reference to FIG. 2A, the slide feature 202 is depicted in plan view. The slide feature comprises an inrun 210 and outrun 212, the outer lip 222, and the sliding surface 220 between the inrun 210 and the outrun 212. In the embodiment depicted, the entry chute 204 and the exit chute 206 have a cross over point 280 where the entry chute 104 and the exit chute 206 are in proximity and cross over each other when the slide feature 202 is viewed from above.

Figure 2B:
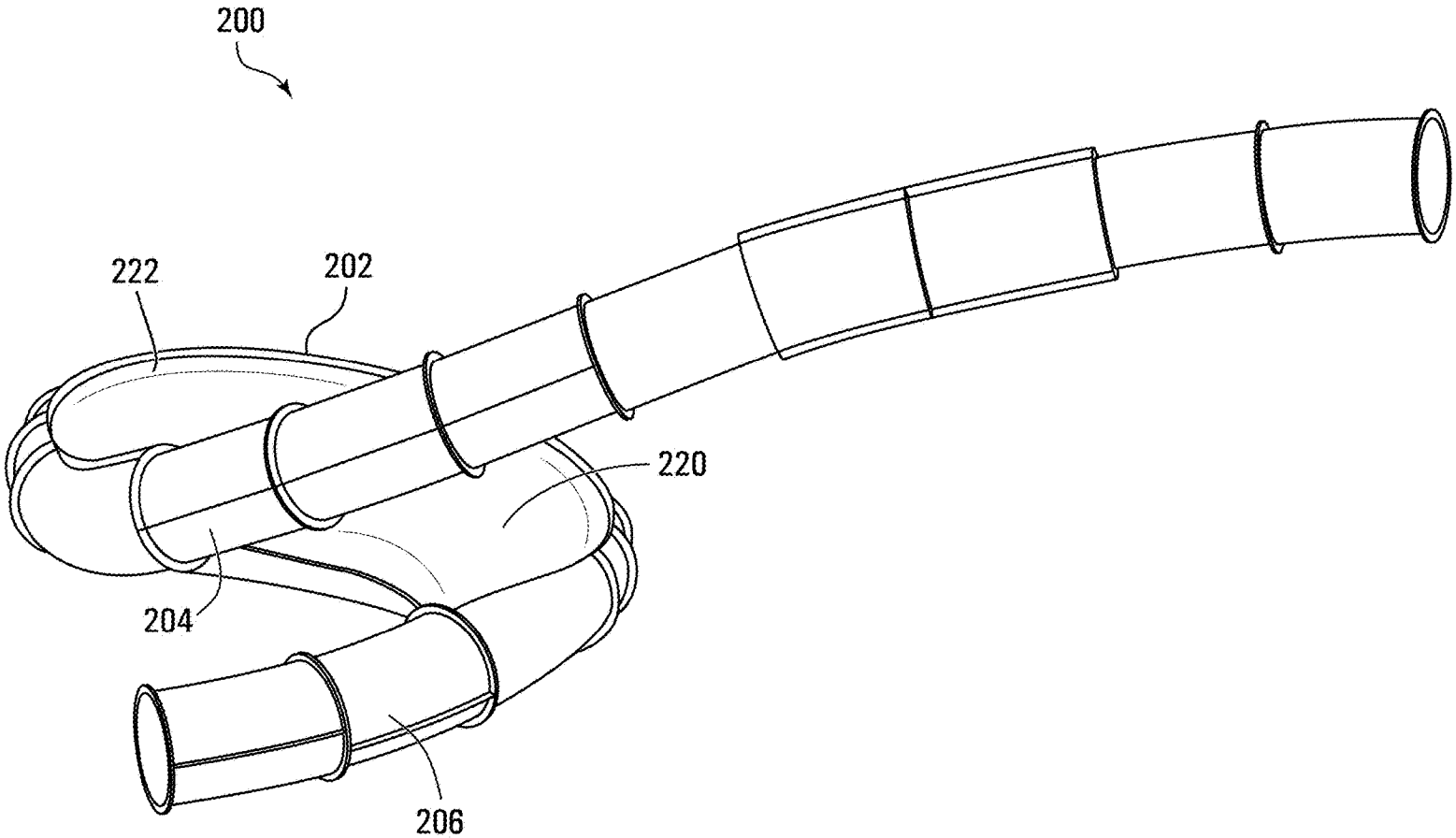
Figure 2C:
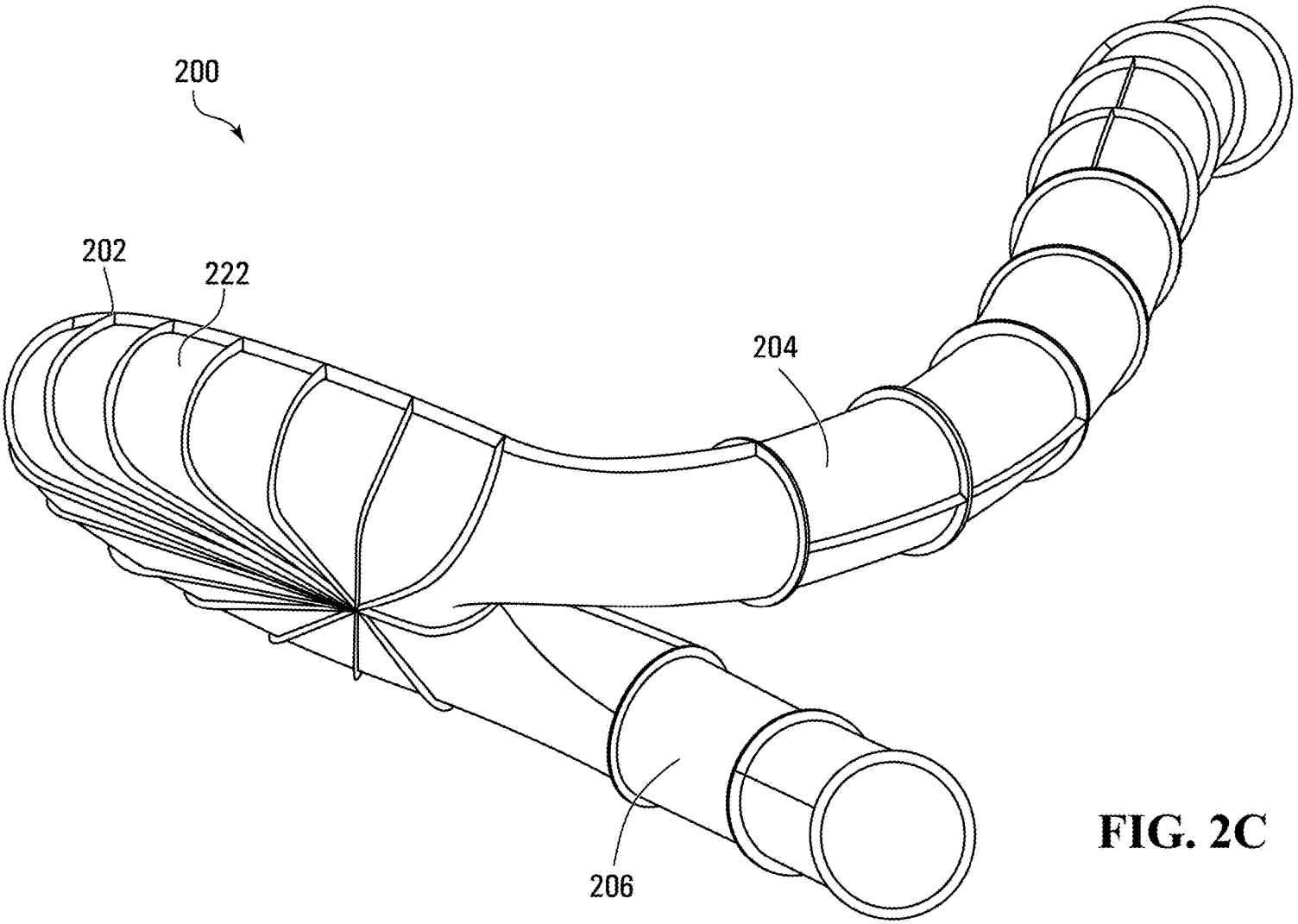
Figure 2D:
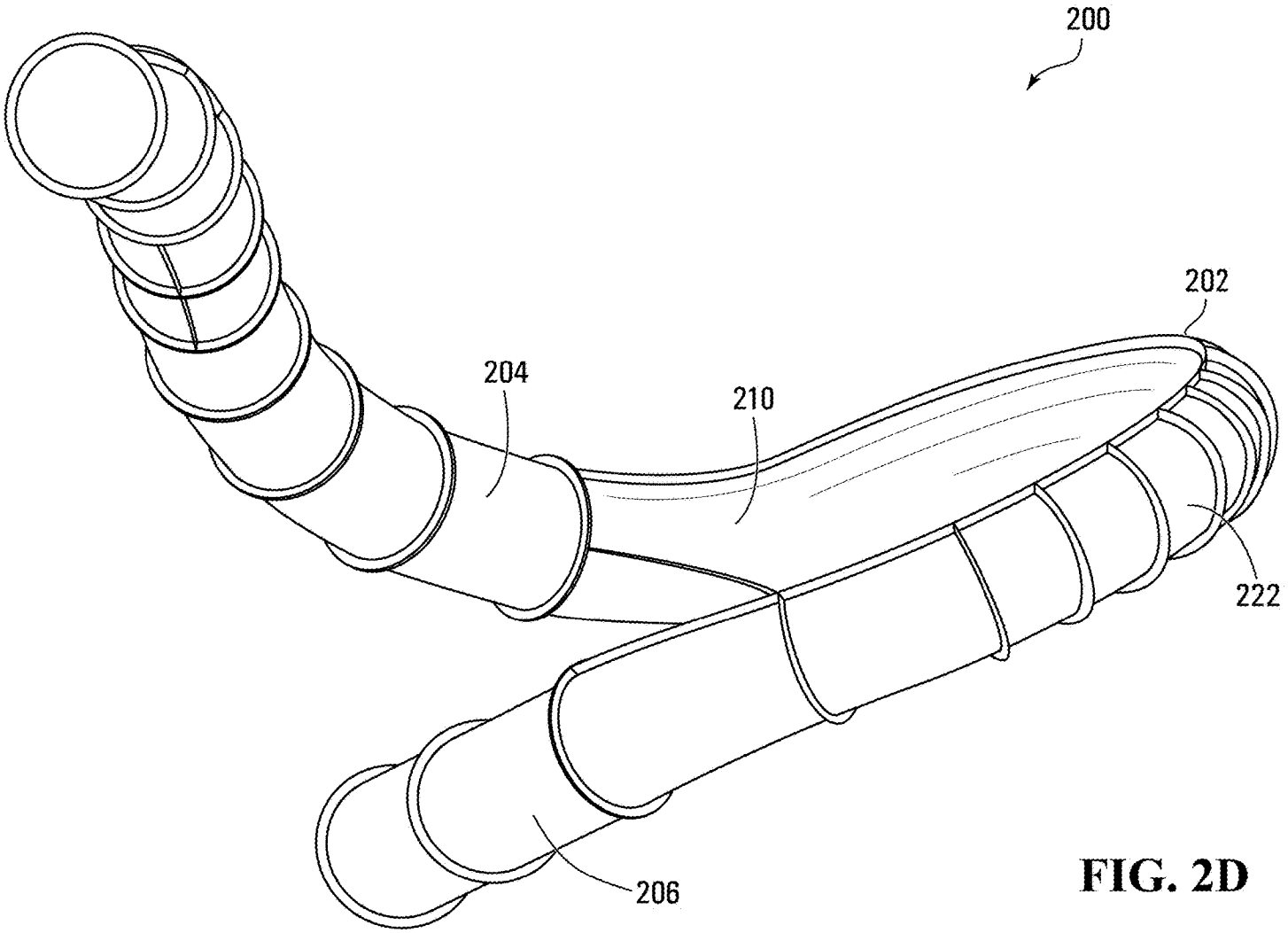
Figure 3A:
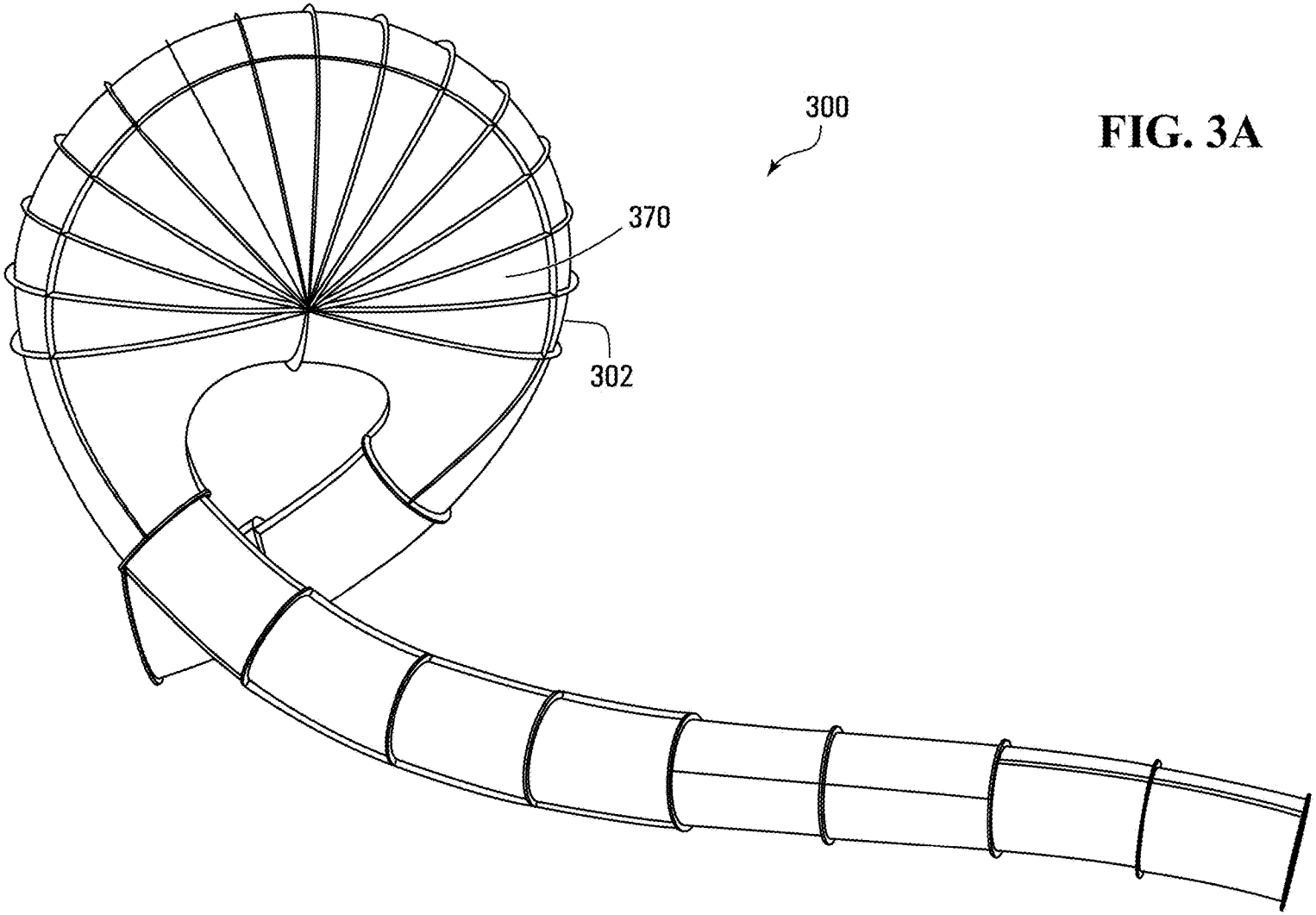
FIGS. 3A-3D show a variation of the slide feature of FIGS. 2A-2D in which the sliding surface is covered.
Figure 3B:
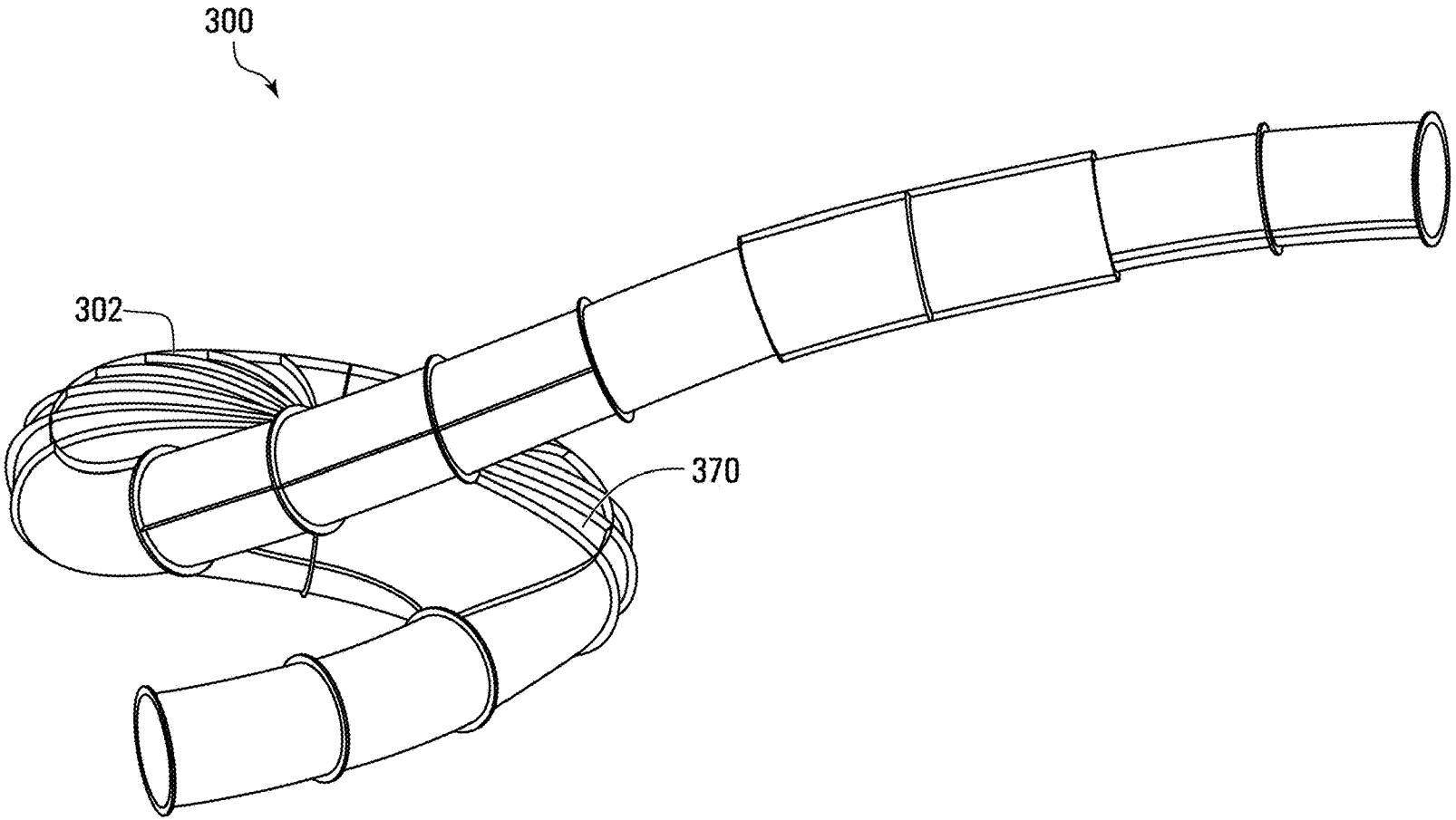
Figure 3C:
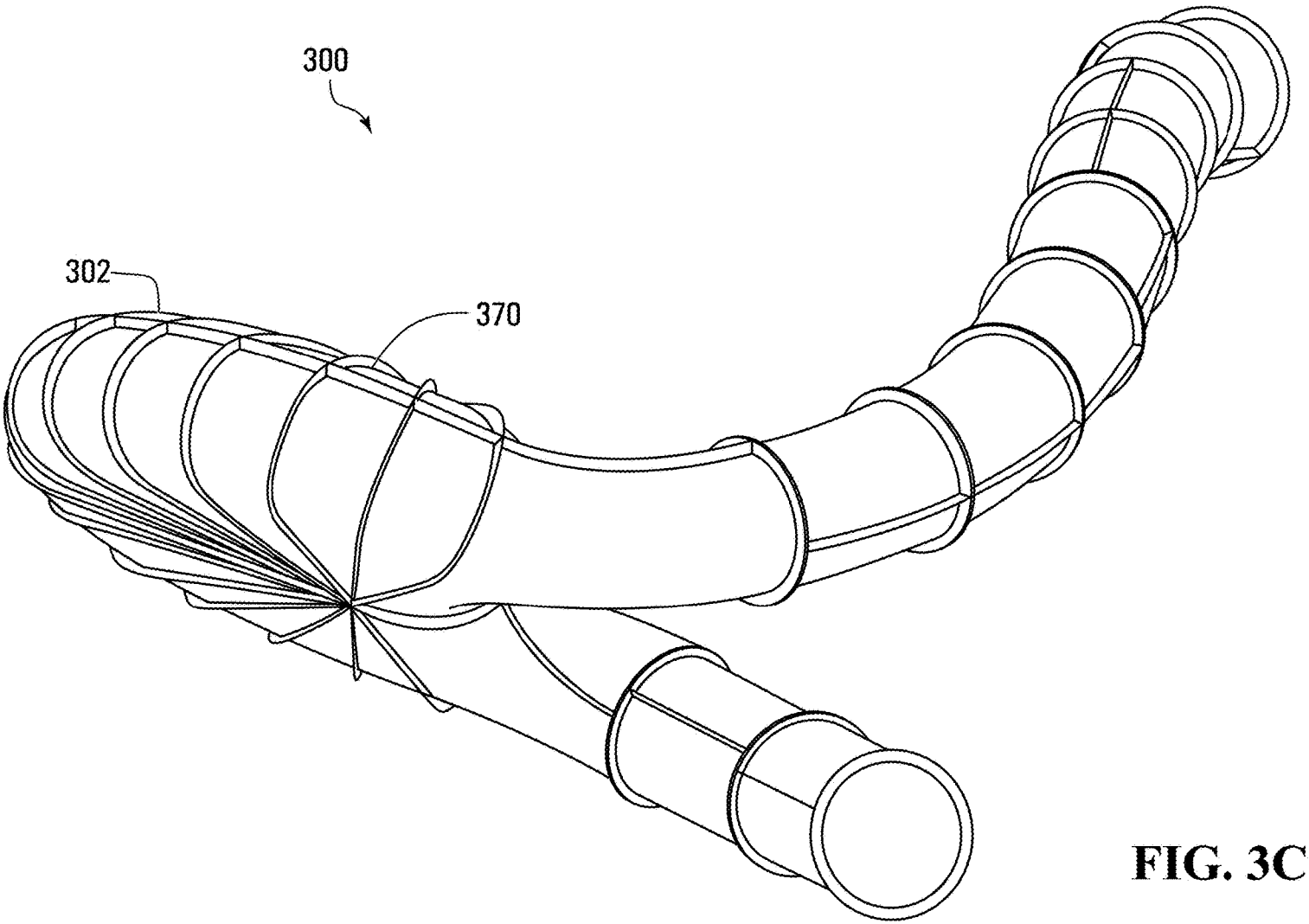
Figure 3D:
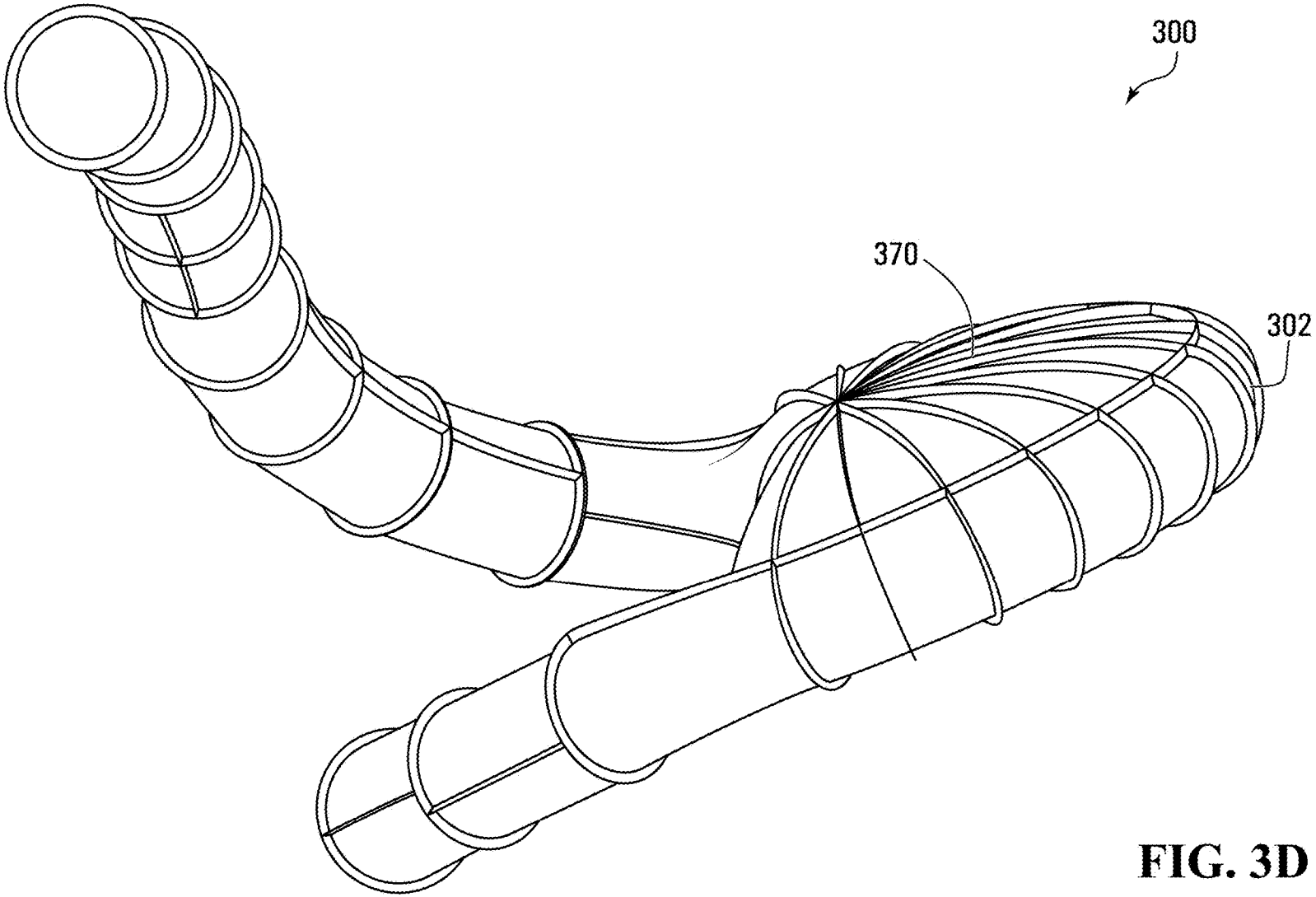

FIG. 2B depicts the slide feature 202 of FIG. 2A from a front elevational view. FIGS. 2C and 2D depict the slide feature 202 of FIG. 2A from two side elevational views.

FIGS. 3A-3D illustrate a variation 302 of the slide feature of FIGS. 2A-2D for a waterslide 300 comprising a cover 370 over the sliding surface. In the embodiment shown, the cover 370 has a gently curved domed shape and fully encloses the interior of the slide feature 302. However, it should be understood that other cover shapes and profiles are contemplated. In some embodiments, a cover 370 may be provided that may not fully enclose the interior of the slide feature 302.

Figure 4A:
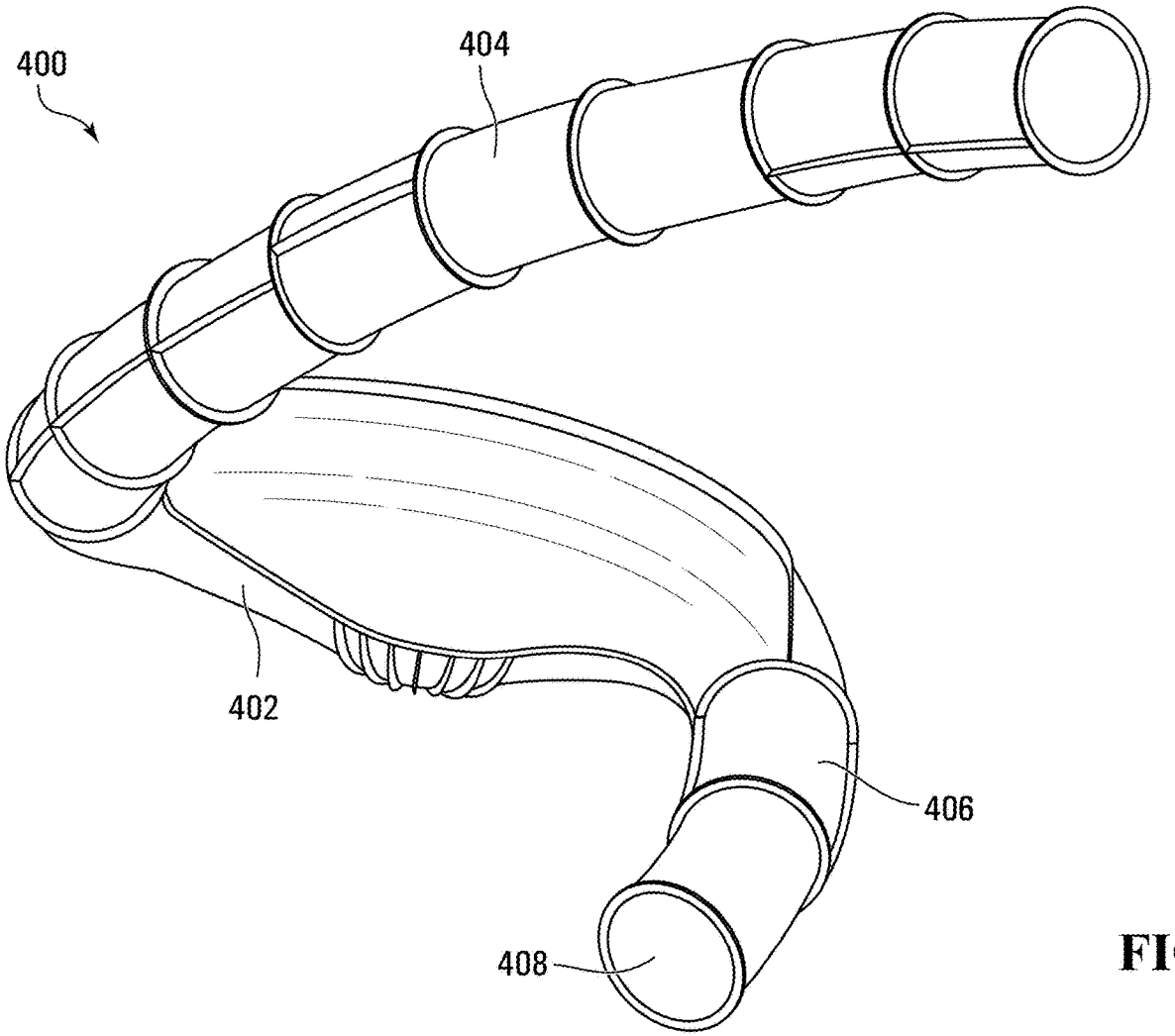
FIGS. 4A-4C show another embodiment of a slide feature coupled to entry and exit chutes in which the entry and exit chutes do not cross over each other.
Figure 4B:
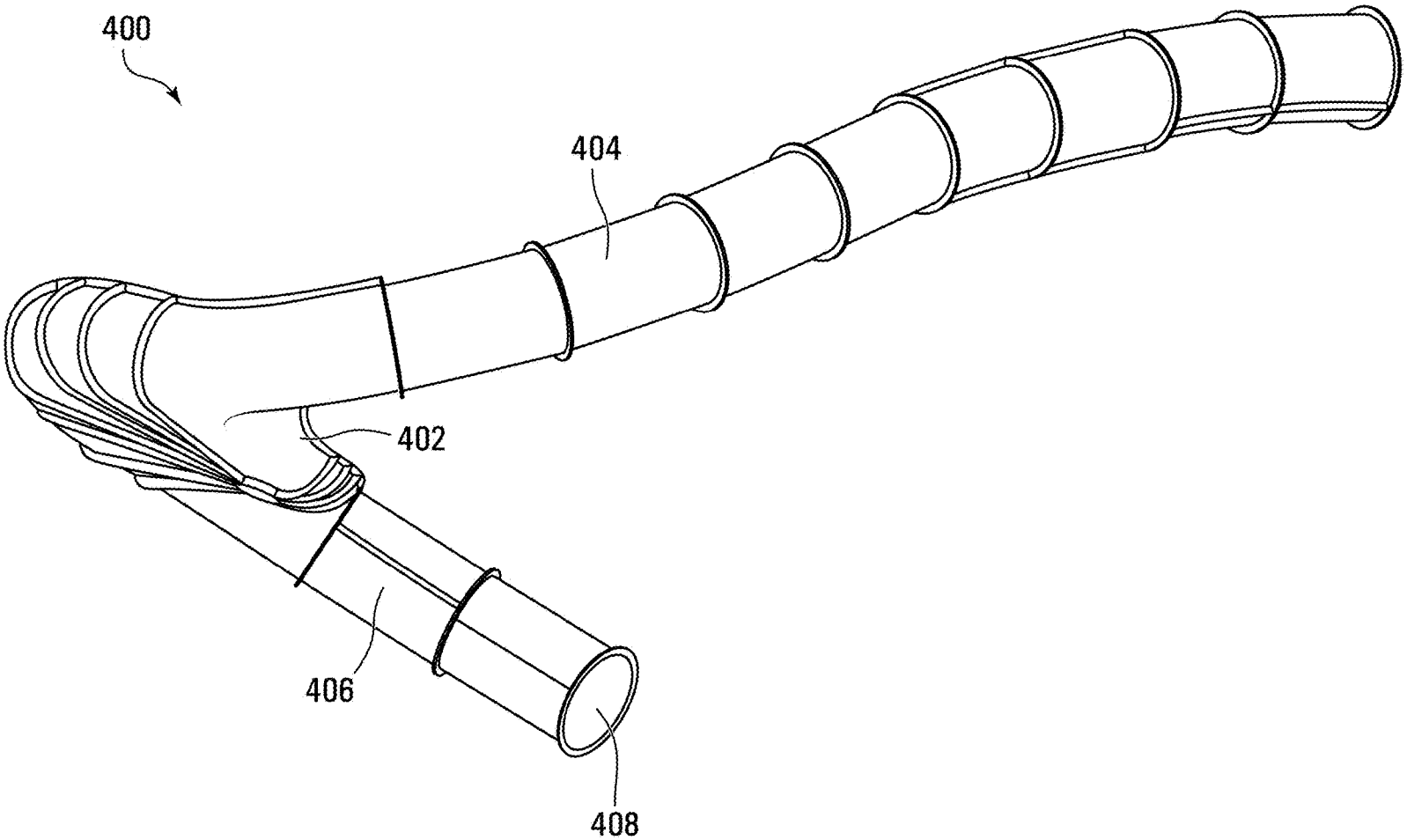
Figure 4C:
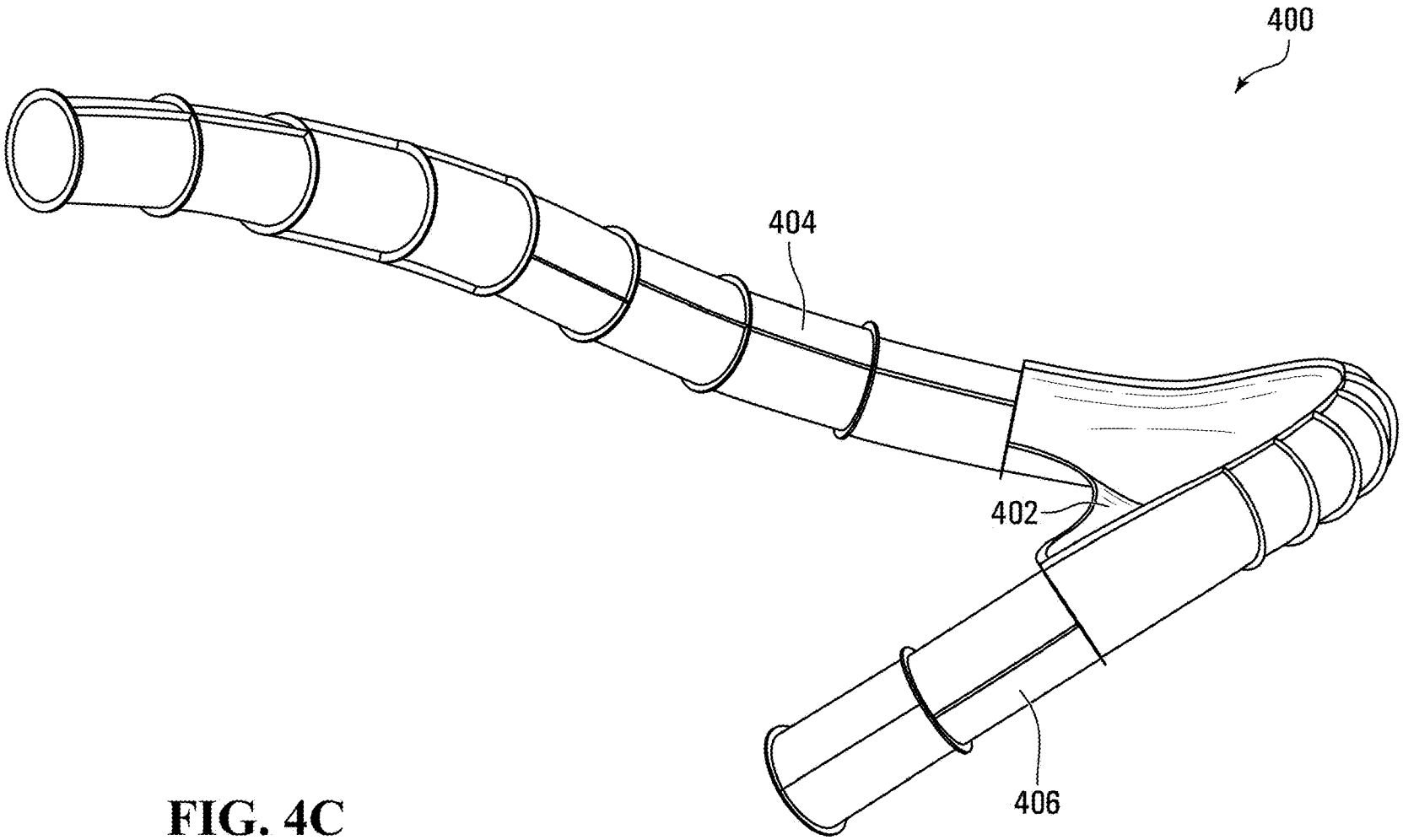

FIGS. 4A-4C illustrate another embodiment of a slide feature 402 for a water slide 400, the slide feature 402 being coupled to entry chute 404 and exit chute 406 of the water slide. In the embodiment shown, riders or ride vehicles travel in a roughly 180 degree arc around the interior of the slide feature 402.

With reference to FIG. 4A, the slide feature 402 is depicted in front elevational view. In the embodiment depicted, the entry chute 404 and exit chute 406 are not proximal to each other. In the embodiment shown, there is also no cross over point in which entry chute 404 crosses over exit chute 406. Riders or ride vehicles may exit the water slide 400 through exit chute opening 408 and tumble into a pool of water below (not shown). In other embodiments, exit chute 406 may continue for some distance and/or interface with another slide feature or another portion of water slide 400.

FIGS. 4B and 4C depict the slide feature 402 of FIG. 4A from two side elevational views.

FIGS. 5A-5J illustrate embodiments of a slide feature including associated structural supports and/or coverings.

Figure 5A:
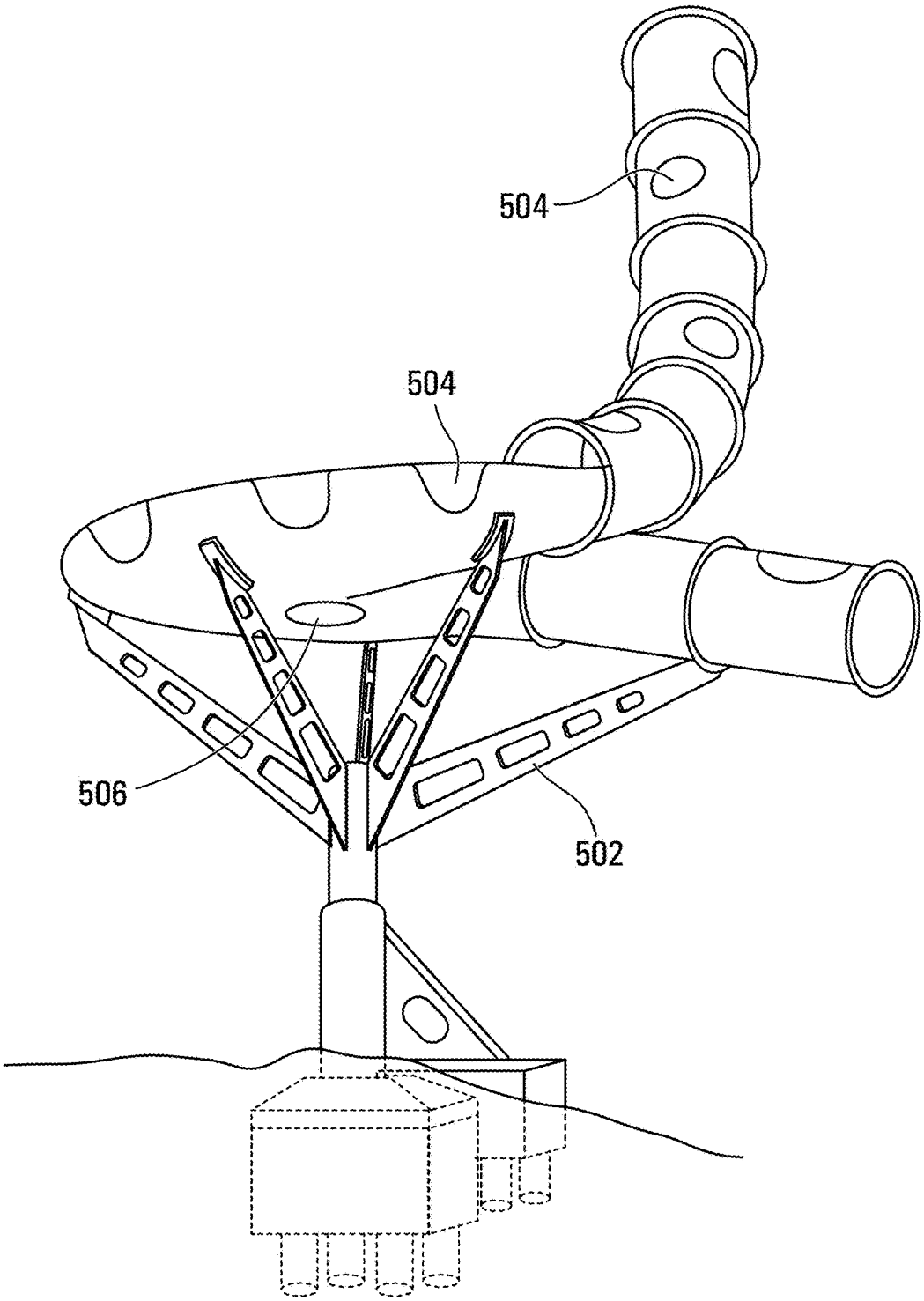
FIGS. 5A-5J show alternative embodiments of the slide feature including associated structural supports and/or coverings.

With reference to FIG. 5A, an embodiment of a slide feature supported by structural supports 502 is illustrated in a perspective view. The structural supports 502 may be constructed from painted galvanized steel. In the illustrated embodiment, the entry chute, slide feature, and exit chute include portholes 504, which are windows integrated into the surface of the entry chute, slide feature, and exit chute. In the illustrated embodiment, some portholes 504 are circular in shape and other portholes 504 are semi-circular in shape. In the illustrated embodiment, the semi-circular portholes 504 are located along an outer lip of the slide feature, and the circular portholes 504 are located along the surface of the entry chute and exit chute. It should be understood however that other locations for the portholes 504 and other porthole shapes are possible. In the illustrated embodiment, the slide feature also includes a base disc 506, which is a disc-shaped window integrated into a central portion of a bottom surface of the slide feature. It should be understood however that one or more windows having other shapes and/or locations may be substituted for base disc 506.

The portholes 504 and/or base disc 506 may, in some embodiments, be made of acrylic or Lexan®, although it should be understood that other materials are also contemplated. The portholes and/or base disc may, in some embodiments, be transparent, translucent, and/or illuminated at certain times, for example at dusk and/or at night. In some embodiments, illumination may be provided via light emitting diodes (LEDs). In some embodiments, the illumination sources may be solar powered. In some embodiments, open apertures may be substituted for some or all portholes 504 and/or for base disc 506. An interior lip, wall, railing, net, or other structure around such an open aperture may be provided to prevent riders or ride vehicles from exiting the slide feature via the open aperture.

Figure 5B:
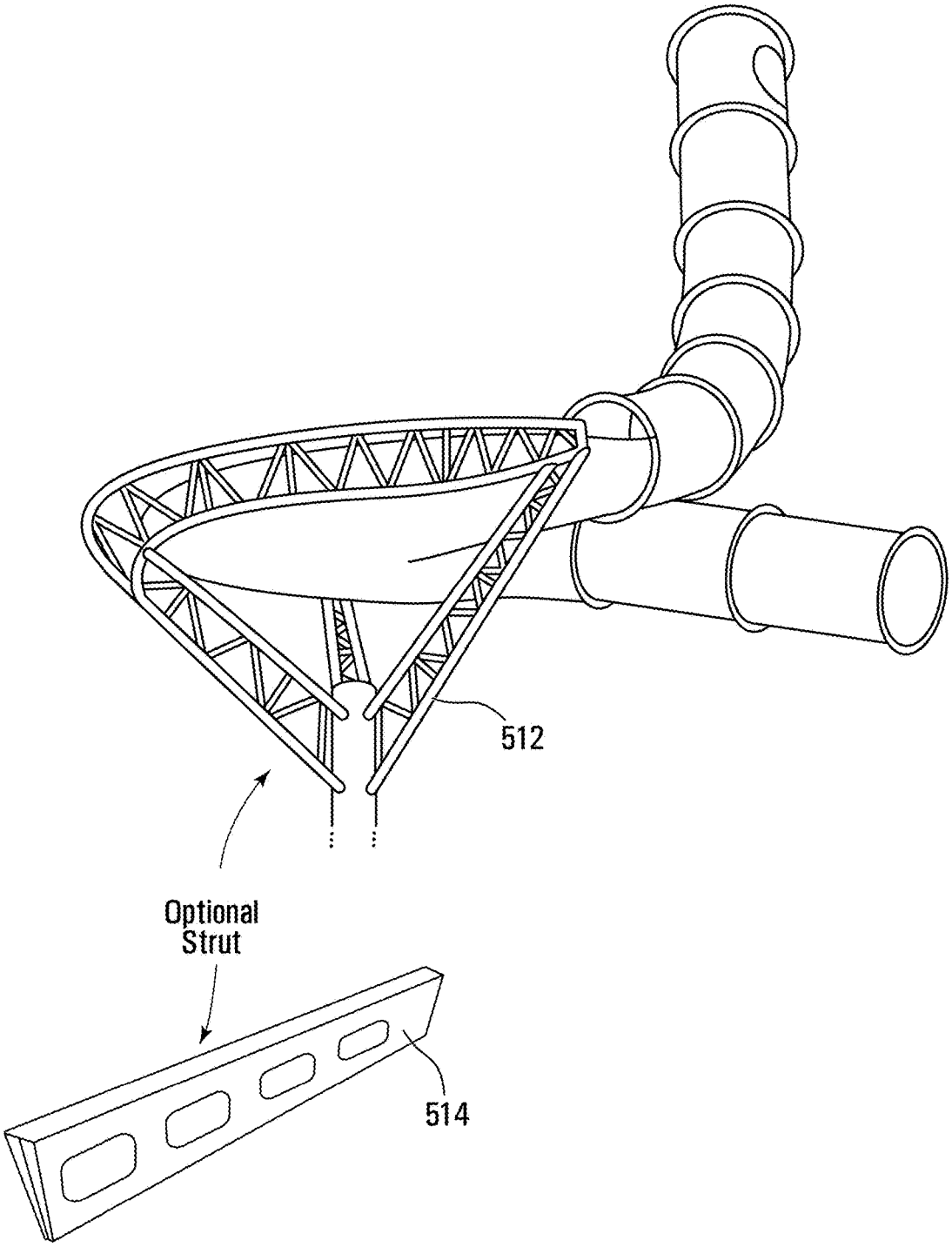
Figure 5C:
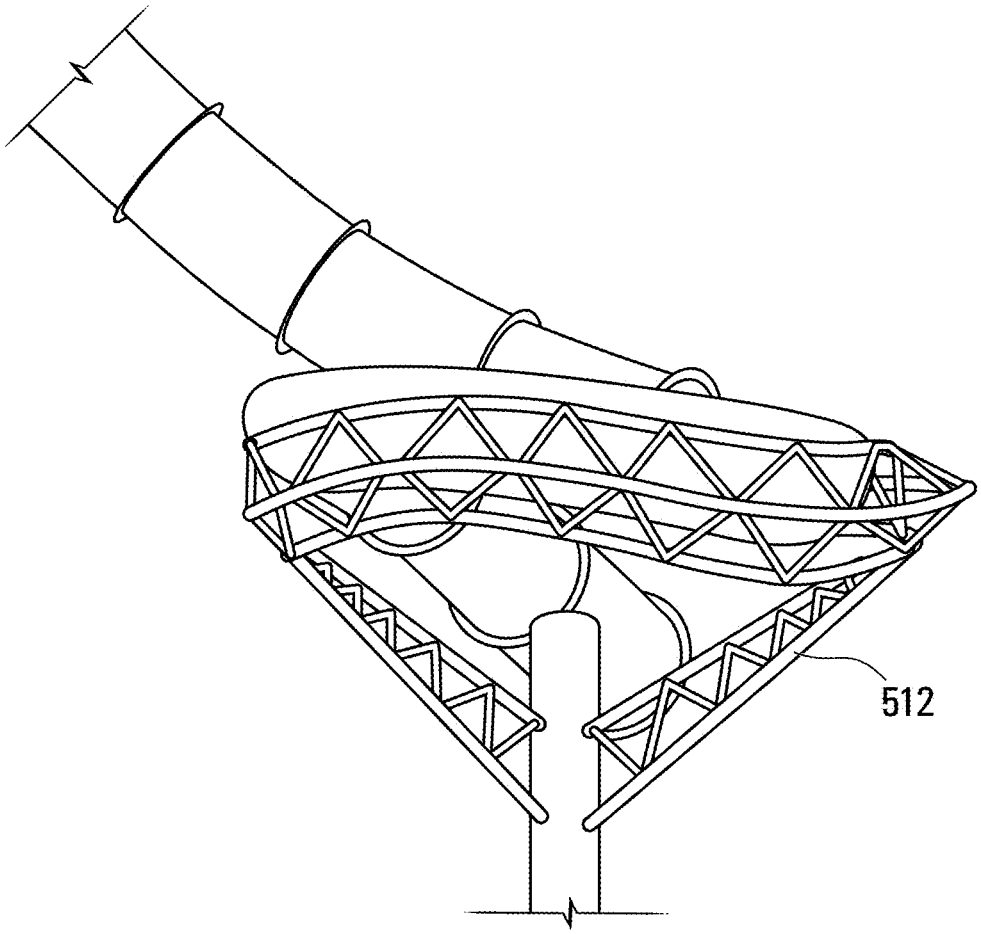

FIGS. 5B and 5C are two perspective views of another embodiment of a slide feature. The slide feature is supported by a full space frame 512, which is a truss-like rigid structure constructed from interlocking struts in a geometric pattern. In some embodiments, the space frame may be a Triodetic® space frame manufactured by Triodetic Corporation. In some embodiments, some portions of the space frame 512 may optionally be replaced by struts 514.

Figure 5D:
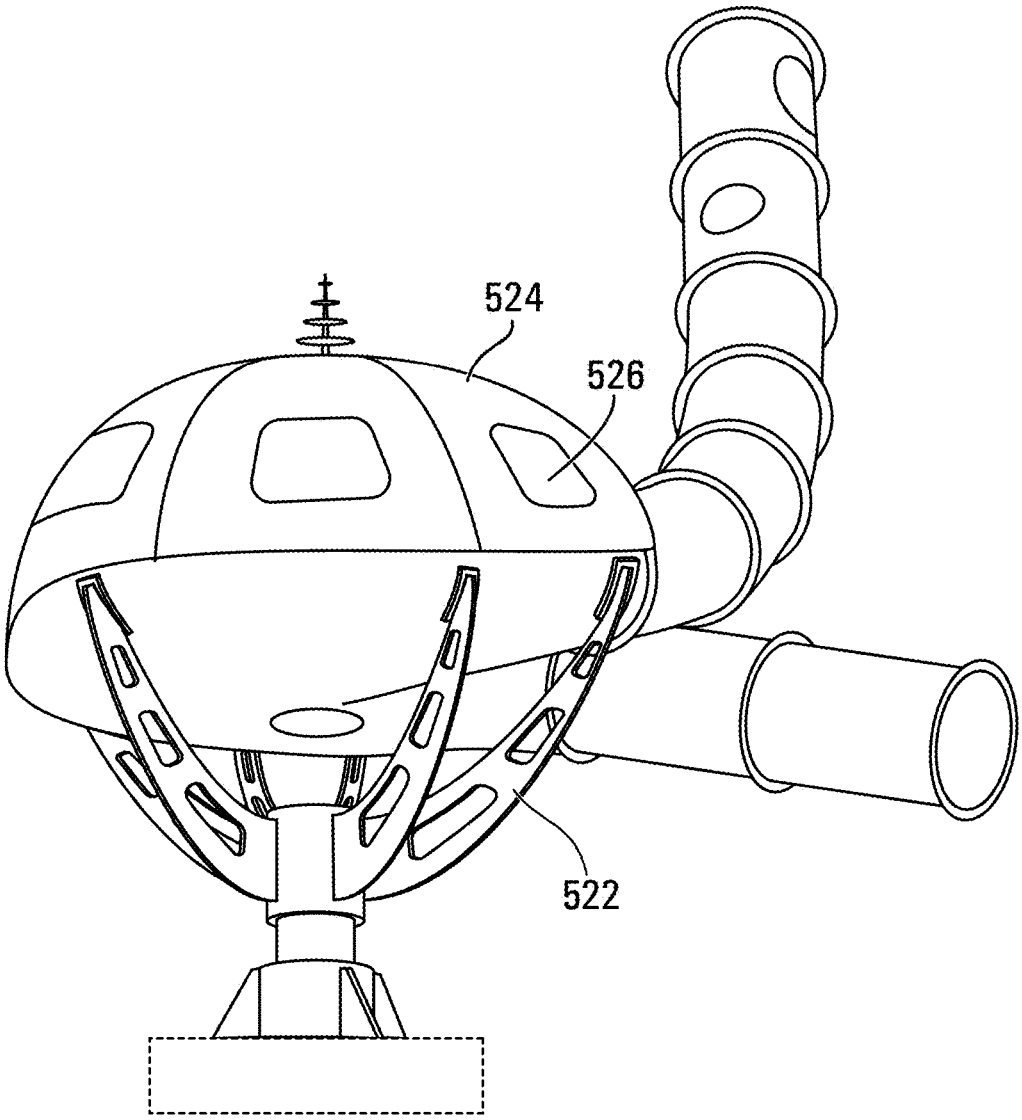

FIG. 5D is a perspective view of an embodiment of a slide feature supported by structural supports 522 and comprising a cover 524 over the sliding surface. In the illustrated embodiment, the cover 524 has a hemispherical shape above the sliding surface and includes windows 526 disposed around the circumference of the cover 524. Windows 526 may have properties similar to the portholes discussed earlier with respect to the embodiment illustrated in FIG. 5A. In other embodiments, the cover 524 may have a different shape and/or may not include windows 526.

Figure 5E:
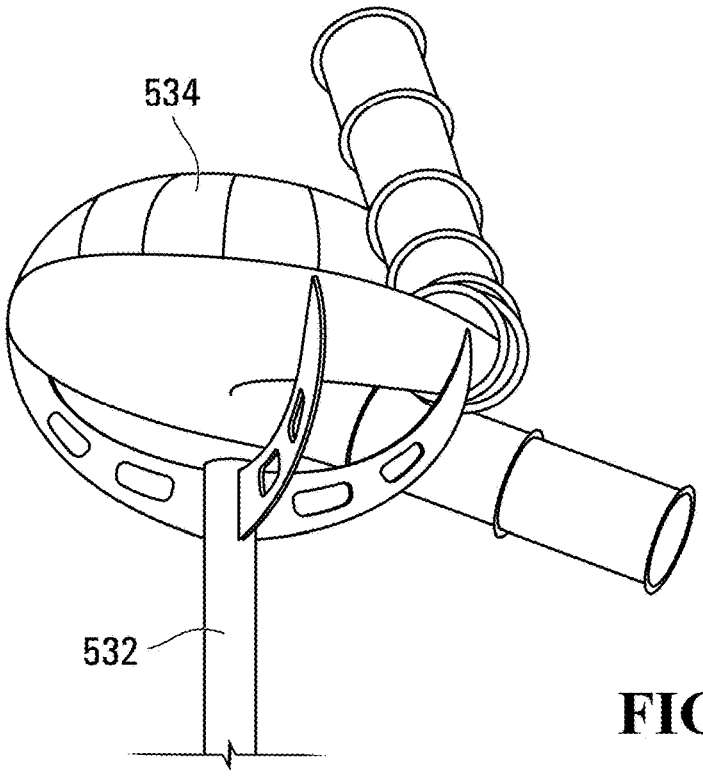

FIG. 5E is a perspective view on an embodiment of a slide feature supported by structural supports 532 and comprising a mesh cover 534 over the sliding surface. In the illustrated embodiment, the mesh cover has a domed shape. In other embodiments, the mesh cover may be optional or may have a different shape. In the embodiment depicted, the structural supports 532 have a physical design that bears some resemblance to supports for a gyroscope, but it should be understood that a variety of other physical designs for providing structural support to the slide feature are also contemplated.

Figure 5F:
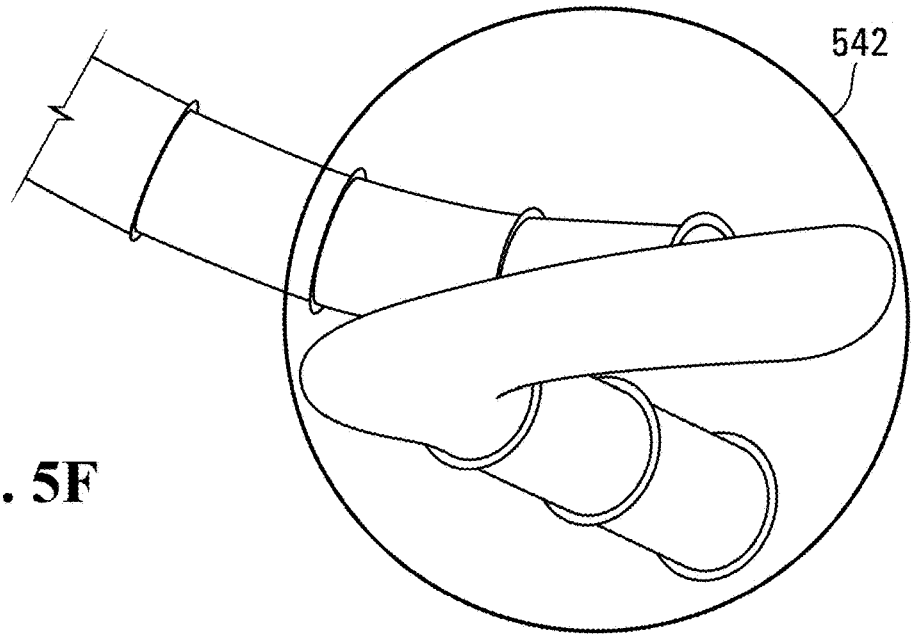

FIG. 5F is a perspective view of an embodiment of a slide feature surrounded by a cover 542 having a spherical shape shown in schematic. In some embodiments, cover 542 may be opaque, and in other embodiments cover 542 may be transparent, translucent, and/or include non-opaque surfaces, for example windows. Due to the spherical shape of cover 542, the slide feature may visually appear to an exterior viewer to permit riders and/or ride vehicles to travel around the interior of a sphere, although the path taken by riders and/or ride vehicles when travelling through the slide feature is determined by the shape of the slide feature.

Figure 5G:
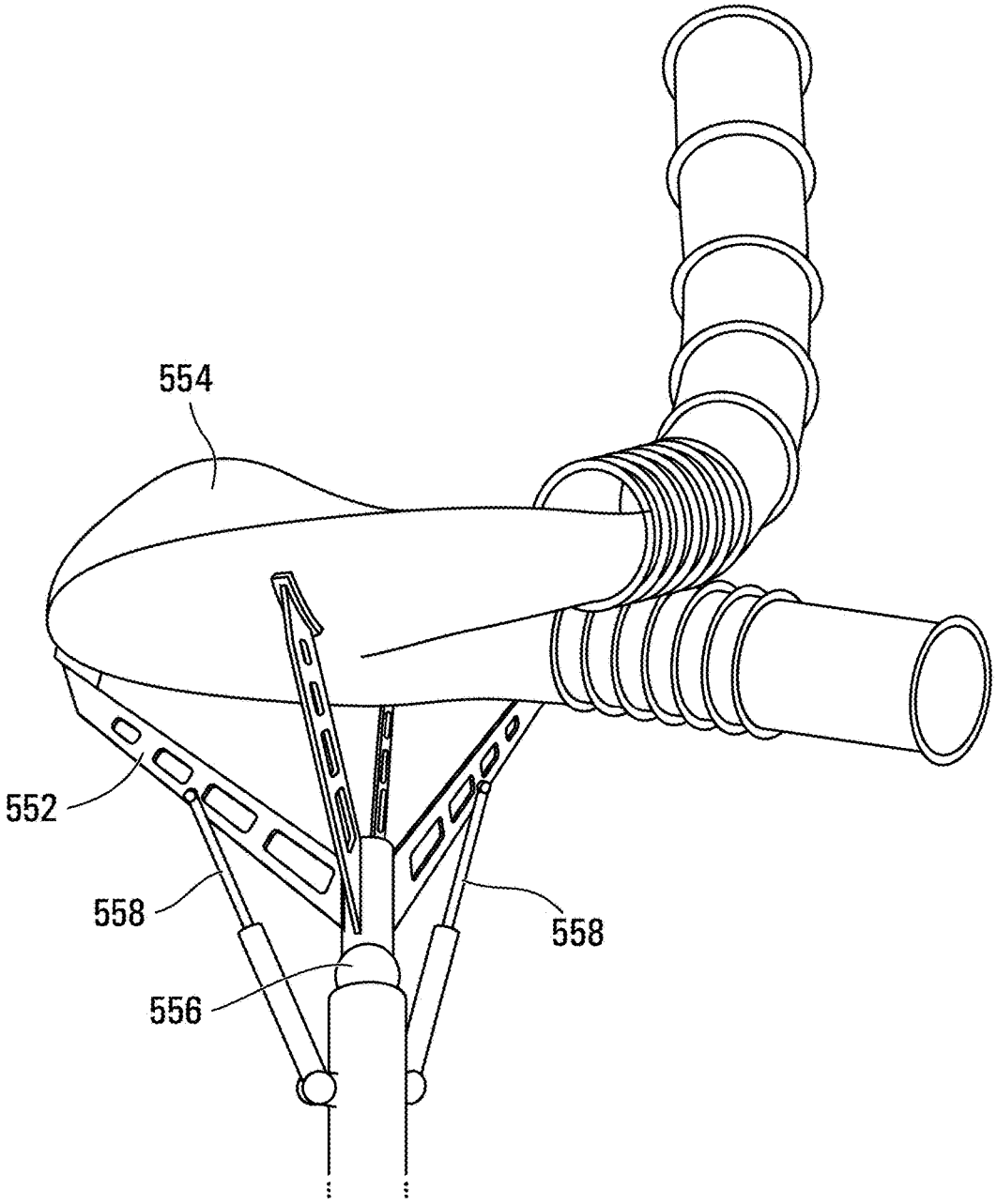

FIG. 5G is a perspective view of an embodiment of a slide feature in which structural supports 552 supporting the slide feature may pivot around a joint 556. The structural supports are also connected to hydraulic pistons 558. In some embodiments, the hydraulic pistons may be configured to dynamically impart movement to the slide feature. In some embodiments, the joint 556 and/or hydraulic pistons 558 may be configured to dynamically impart movement to the slide feature and the hydraulic pistons 558 may also function as movement dampeners. Dynamic movements imparted by the joint 556 and/or the hydraulic pistons 558 may be software driven. Embodiments making use of dynamic movements may in some cases be referred to as "animatronic", "dynamic", or "full-motion" embodiments. Also shown in FIG. 5G is an extended (or riser) portion 554 of the outer lip, which extends above a portion of the outer lip and may, in some embodiments, provide an additional margin of safety for riders or ride vehicles. More specifically, the extended portion 554 may, in some circumstances, help to guard against the possibility that some sliding motions of riders or ride vehicles may cause the riders or ride vehicles to exit the interior of the slide feature. In some embodiments, the extended portion 554 may allow for the outer lip of the slide feature to have a lesser radius of curvature than if the extended portion 554 was not present.

Figure 5H:
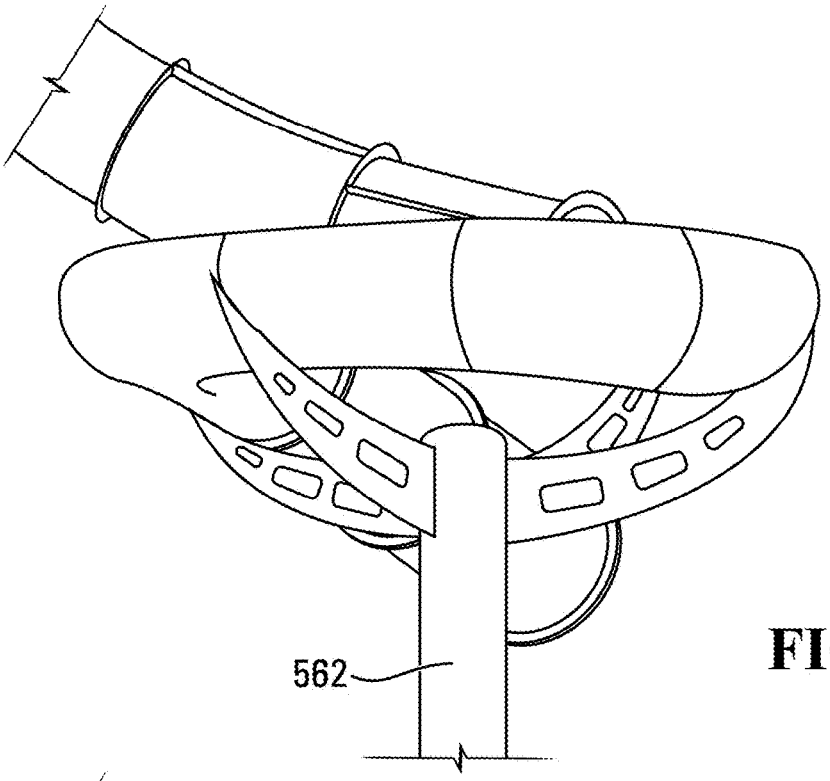
Figure 5I:
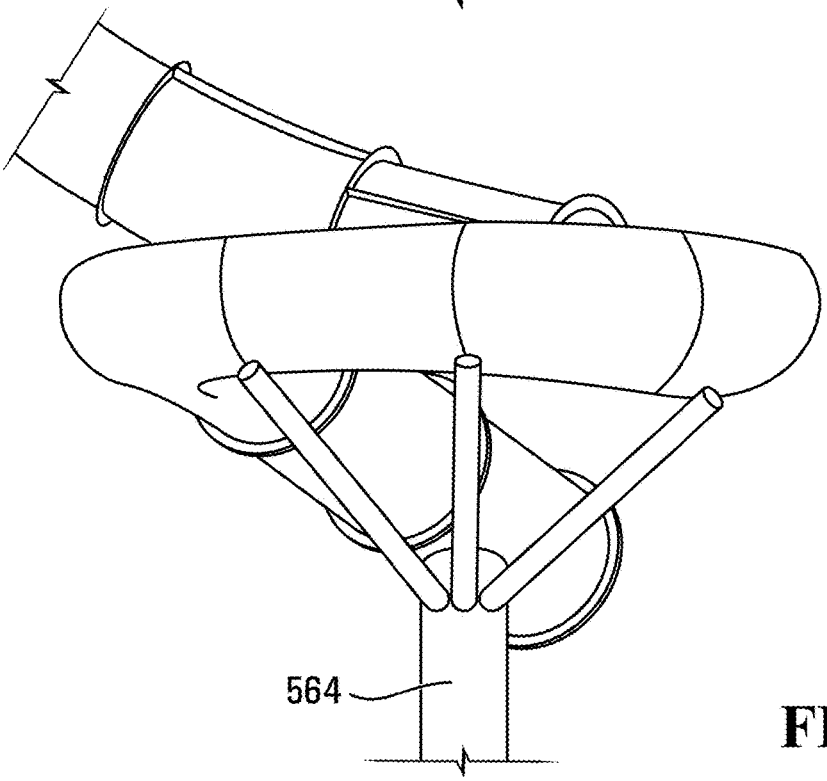

FIGS. 5H and 5I are perspective views of embodiments of the slide feature supported by differing types of structural supports 562, 564. In the embodiment shown in FIG. 5H, the structural supports 562 comprise a central vertical support having a cylindrical shape and struts extending from the central vertical support. In the embodiment shown in FIG. 5I, the structural supports 564 comprise a central vertical support having a cylindrical shape and additional cylindrical supports extending from the central vertical support. It should be understood that the illustrated structural supports 562, 564 are examples, and that other types of structural supports are possible.

Figure 5J:
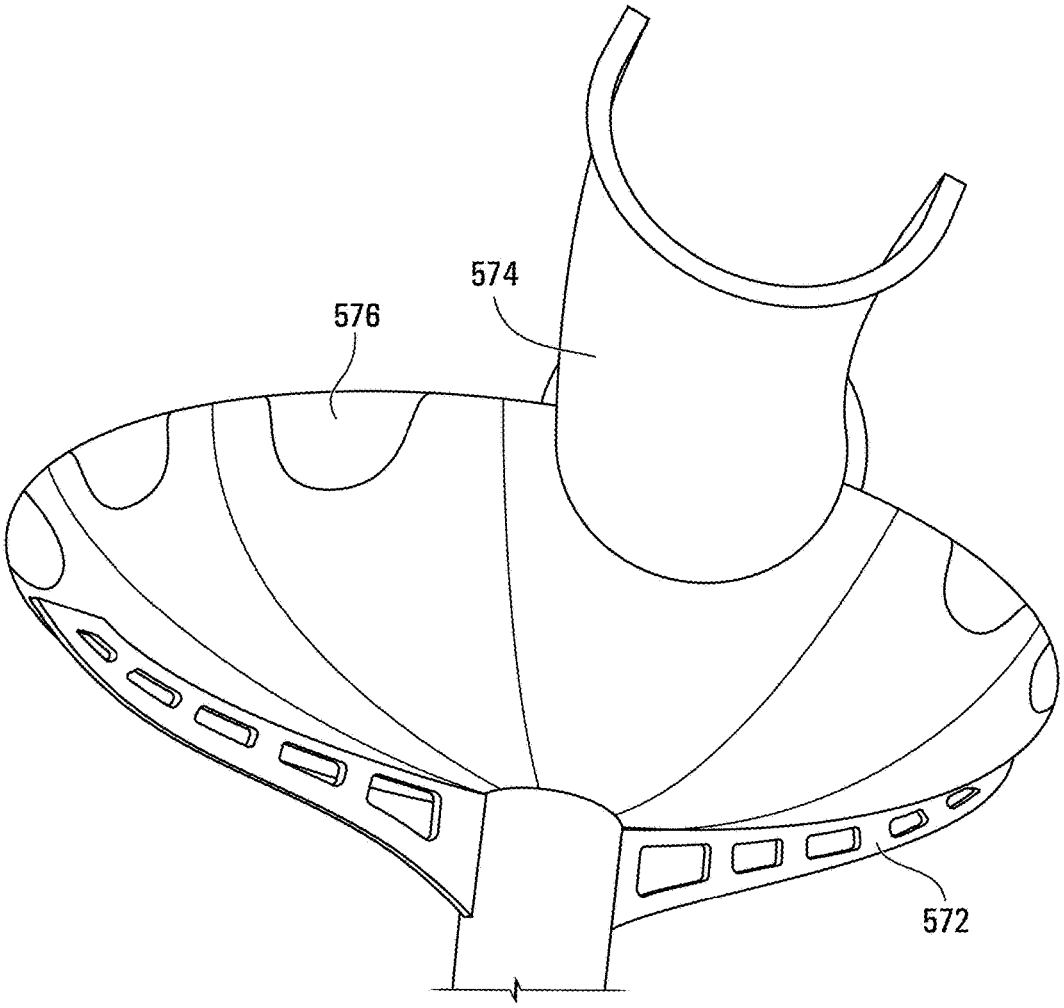

FIG. 5J is a perspective view of an embodiment of the slide feature supported by structural supports 572 of the type illustrated in FIG. 5H, the slide feature having a semi-circular exit chute 574 and semi-circular portholes 576 disposed around the circumference of the slide feature.

Figure 6A:
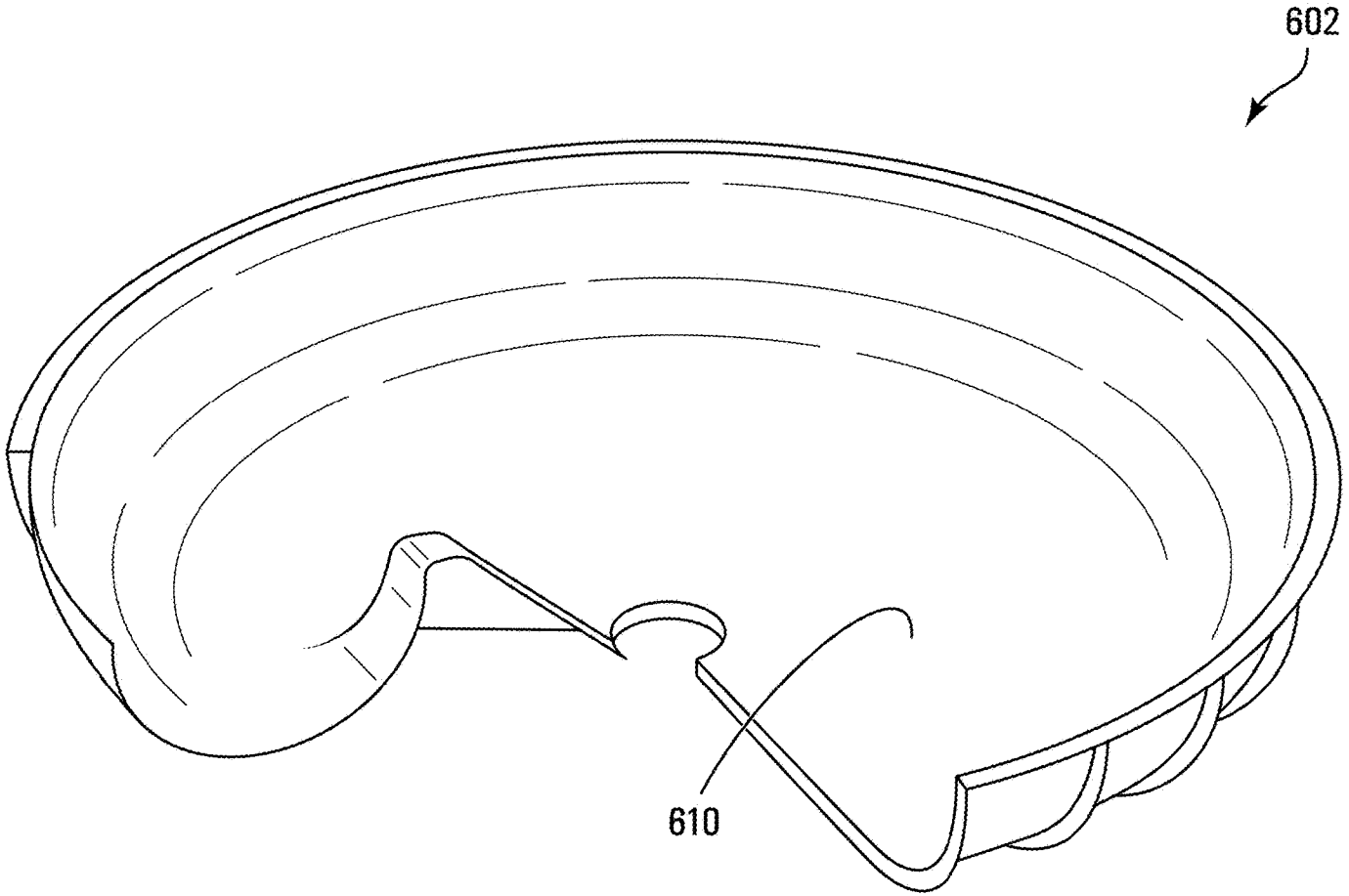
FIGS. 6A-6B show alternative embodiments of the slide feature.
Figure 6B:
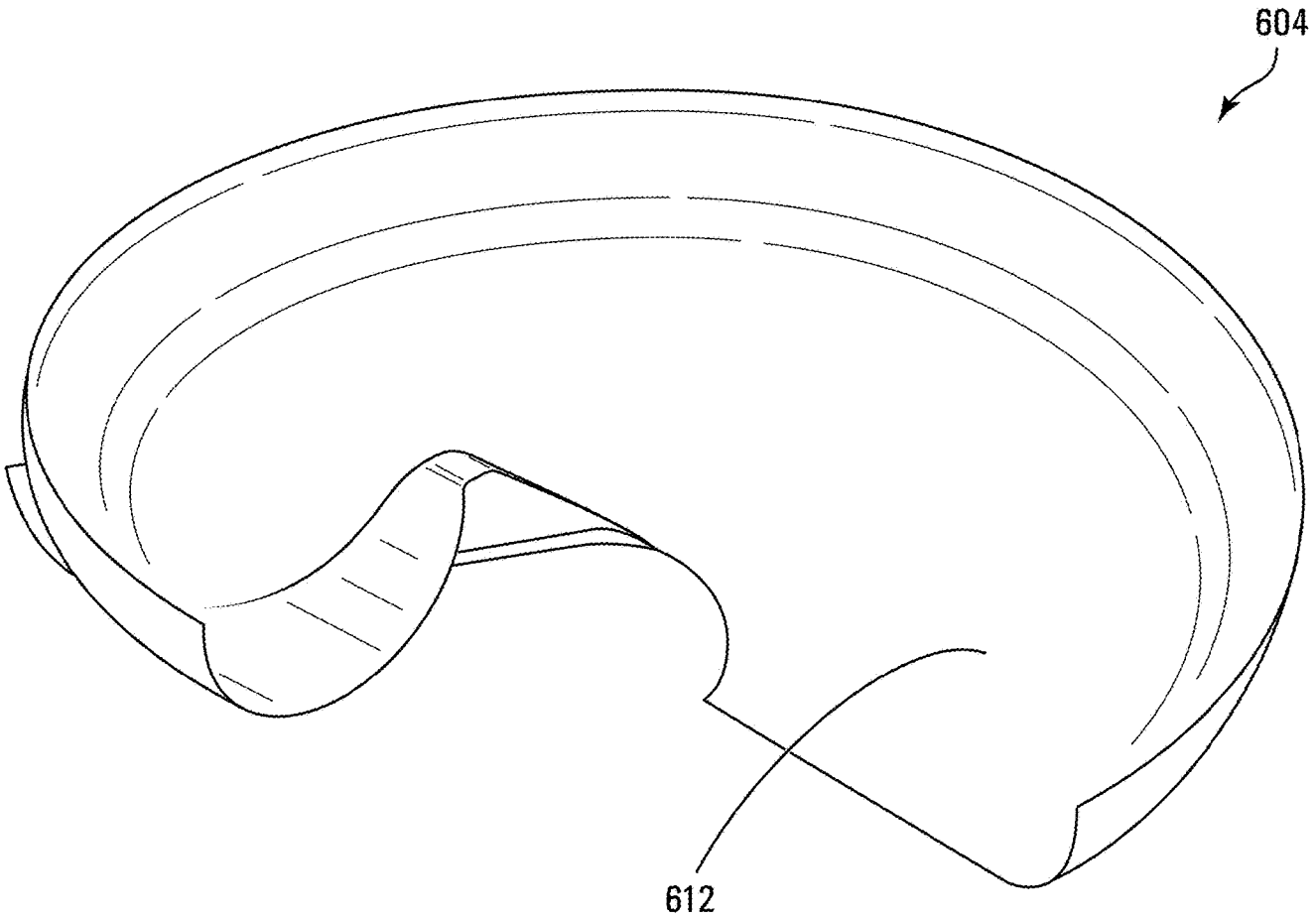

Referring now to FIGS. 6A and 6B, depicted are two embodiments of the slide feature 602, 604 shown in perspective views. In the embodiment illustrated in FIG. 6A, the sliding surface 610 is generally flat. In the embodiment illustrated in FIG. 6B, the sliding surface 612, while still substantially planar, has a partially helical profile.

Figure 7:
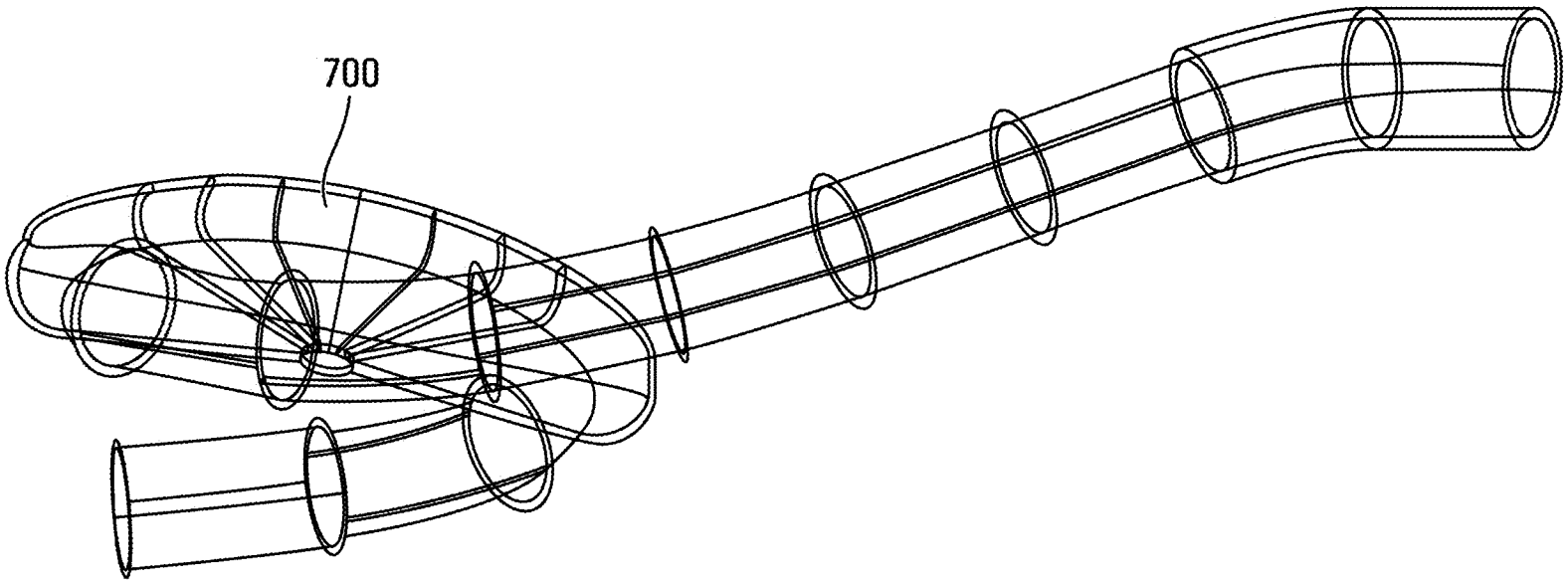
FIG. 7 shows another embodiment of the slide feature in wireframe perspective view.

FIG. 7 illustrates in wireframe perspective view another embodiment of a slide feature 700.

Figure 8:
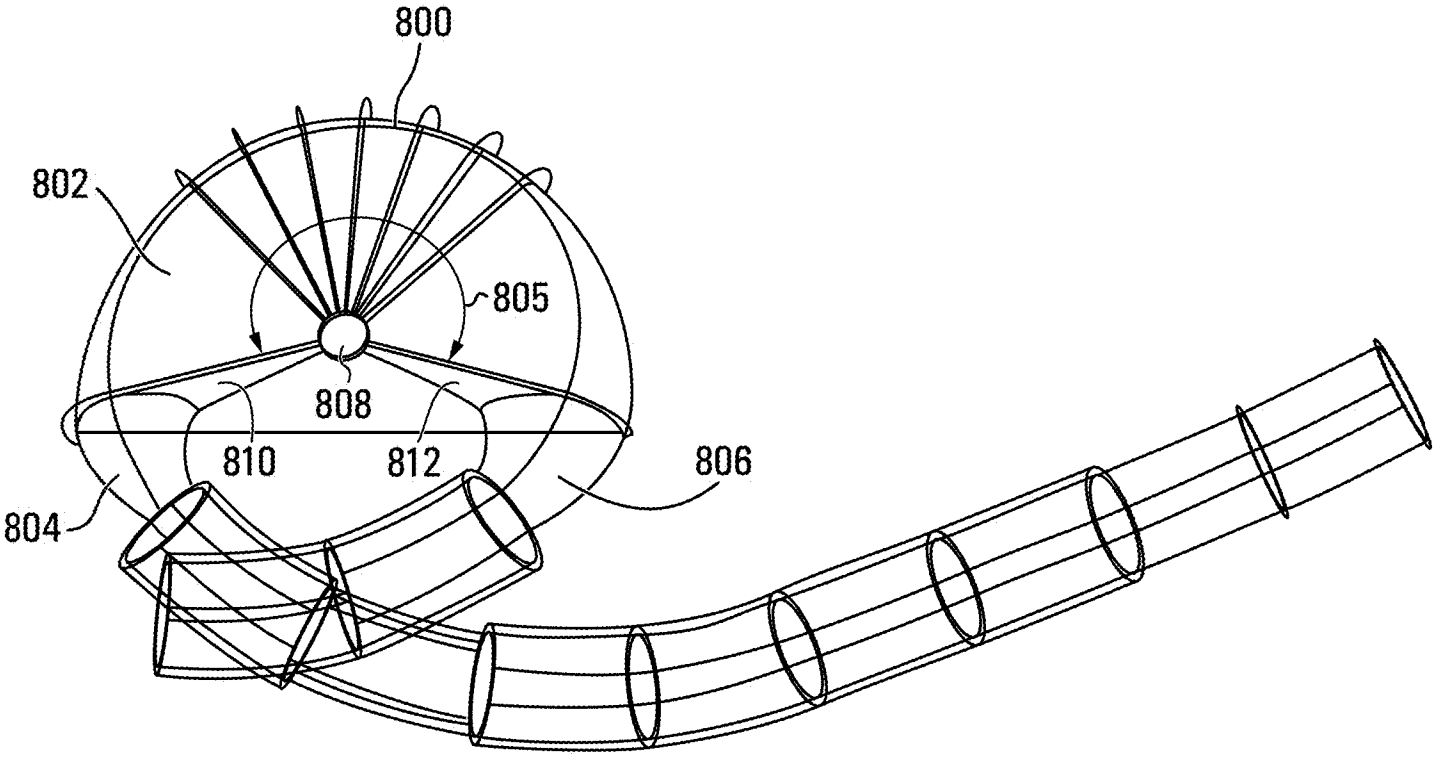
FIG. 8 shows another embodiment of the slide feature in wireframe plan view.

FIG. 8 illustrates in wireframe plan view still another embodiment of a slide feature 800. As illustrated, sliding surface 802 between inrun 804 and outrun 806 is substantially shaped as a circular sector, but the obtuse central angle 805 of this circular sector is more acute than, for example, the obtuse central angle 105 of the embodiment of a slide feature illustrated in FIG. 1A. Circular base disc 808 may, in some embodiments, be transparent, translucent, and/or illuminated at certain times. In some embodiments, an open aperture may be substituted for base disc 808. As illustrated, walls 810 and 812 function to prevent riders or ride vehicles from exiting the slide feature except via outrun 806. In some embodiments, walls 810 and 812 may not be present or may be substituted with other barriers.

Figure 9A:
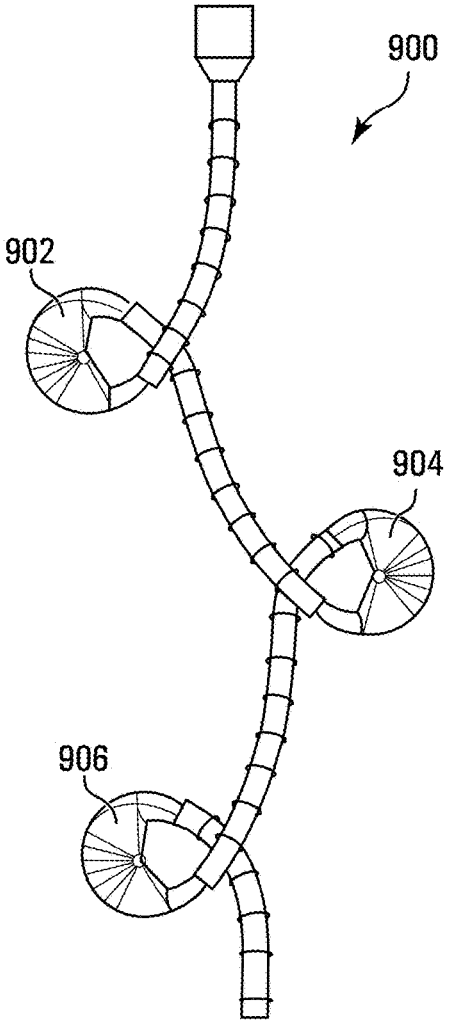
FIGS. 9A-9C show an embodiment of a water slide comprising multiple slide features.
Figure 9B:
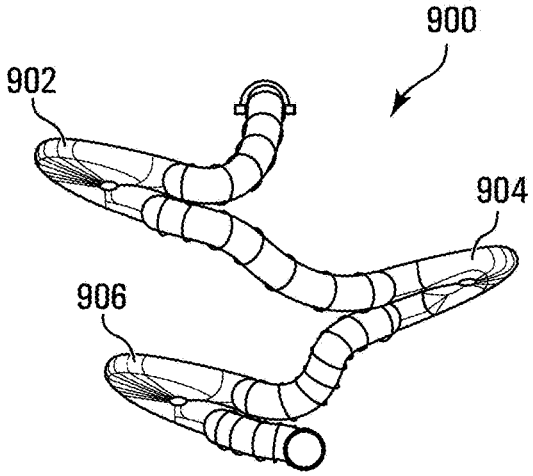
Figure 9C:
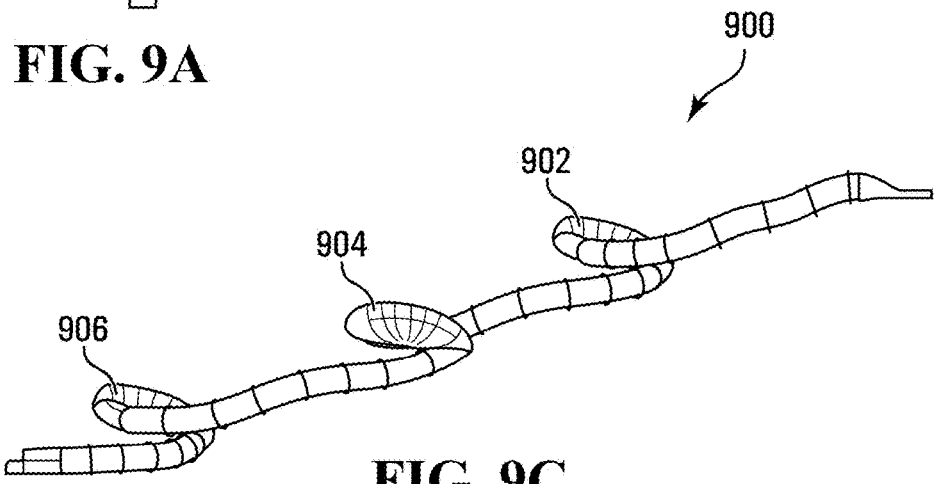

Referring now to FIGS. 9A-9C, illustrated is an embodiment of a water slide 900 comprising multiple slide features 902, 904, 906 connected by flumes. FIG. 9A shows water slide 900 in plan view, FIG. 9B shows water slide 900 in front elevational view, and FIG. 9C shows water slide 900 in side elevational view. In the embodiment depicted, riders or ride vehicles exit each slide feature 902, 904, 906 in a generally similar direction to the direction in which they entered the slide feature 902, 904, 906. Alternatively, in some embodiments, a slide feature may be configured so that riders or ride vehicles exit a slide feature 902, 904, 906 in a direction independent from the direction in which they enter the slide feature 902, 904, 906. In some embodiments, the direction at which riders or ride vehicles exit a slide feature 902, 904, 906 relative to the direction at which riders or ride vehicles enter the slide feature 902, 904, 906 may be controlled by altering the shape(s) of the inrun and/or outrun. In some embodiments, multiple slide features 902, 904, 906 may be connected without intervening flumes.

Figure 10:
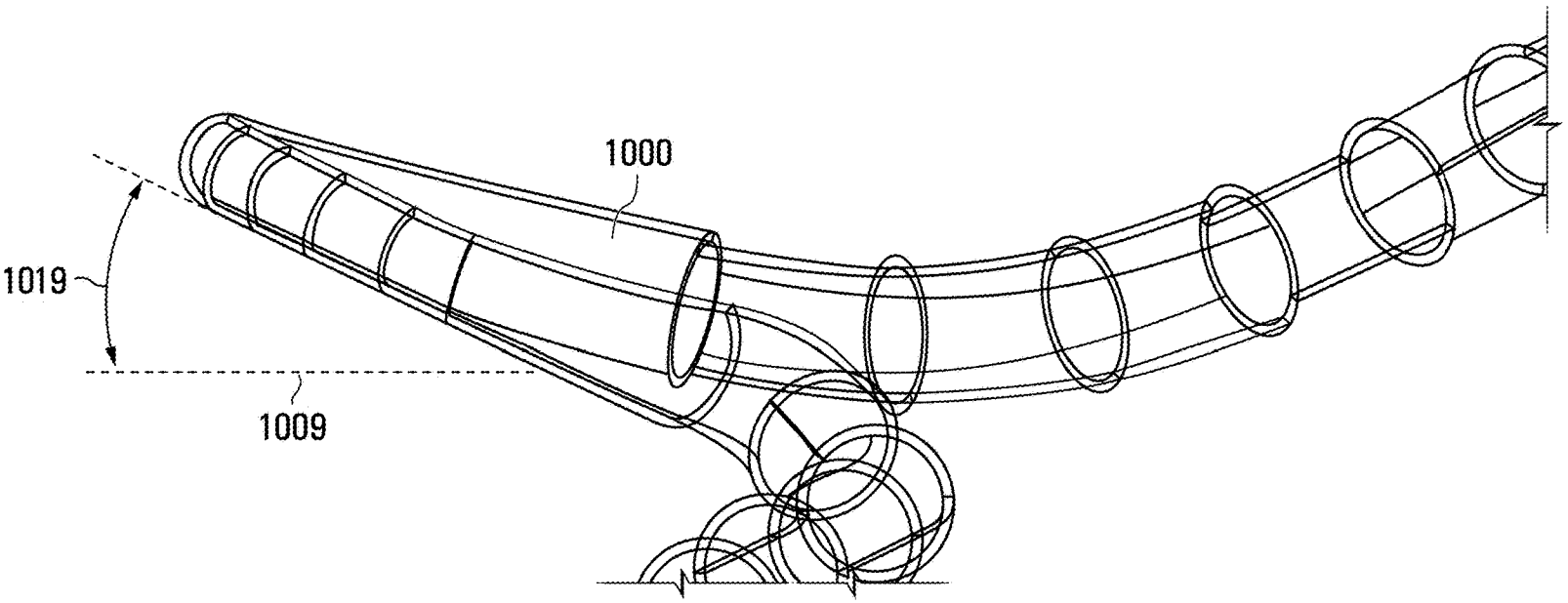
FIG. 10 shows another embodiment of the slide feature in wireframe perspective view.

FIG. 10 illustrates in wireframe perspective view yet another embodiment of a slide feature 1000, in which the sliding surface is inclined at a greater pitch angle 1019 relative to a horizontal plane 1009 than the embodiment of a slide feature illustrated in FIG. 1B.

Figure 11A:
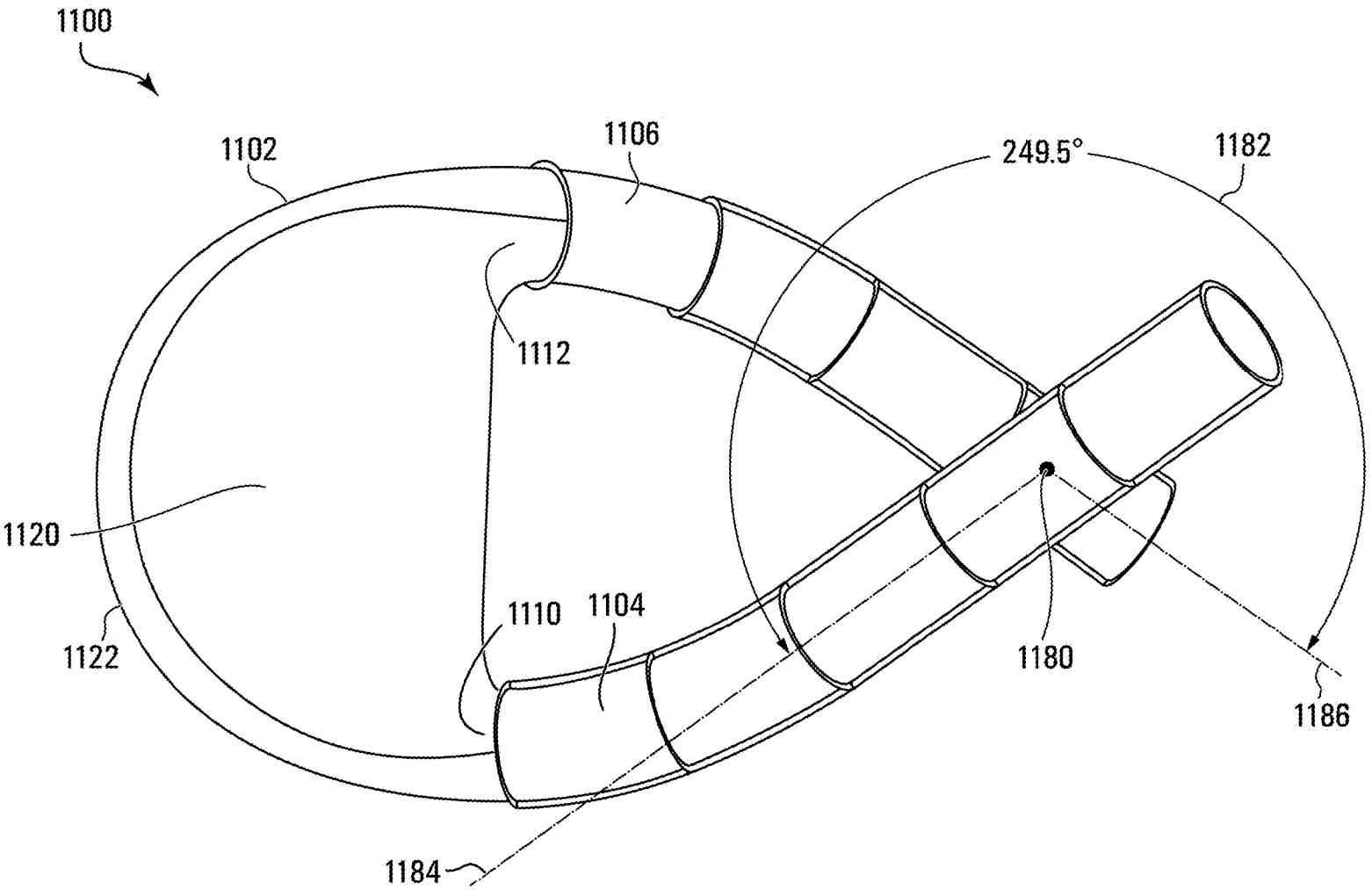
FIGS. 11A-11B show another embodiment of the slide feature coupled to entry and exit chutes in which there is a reduced angle between the entry and exit chutes.
Figure 11B:
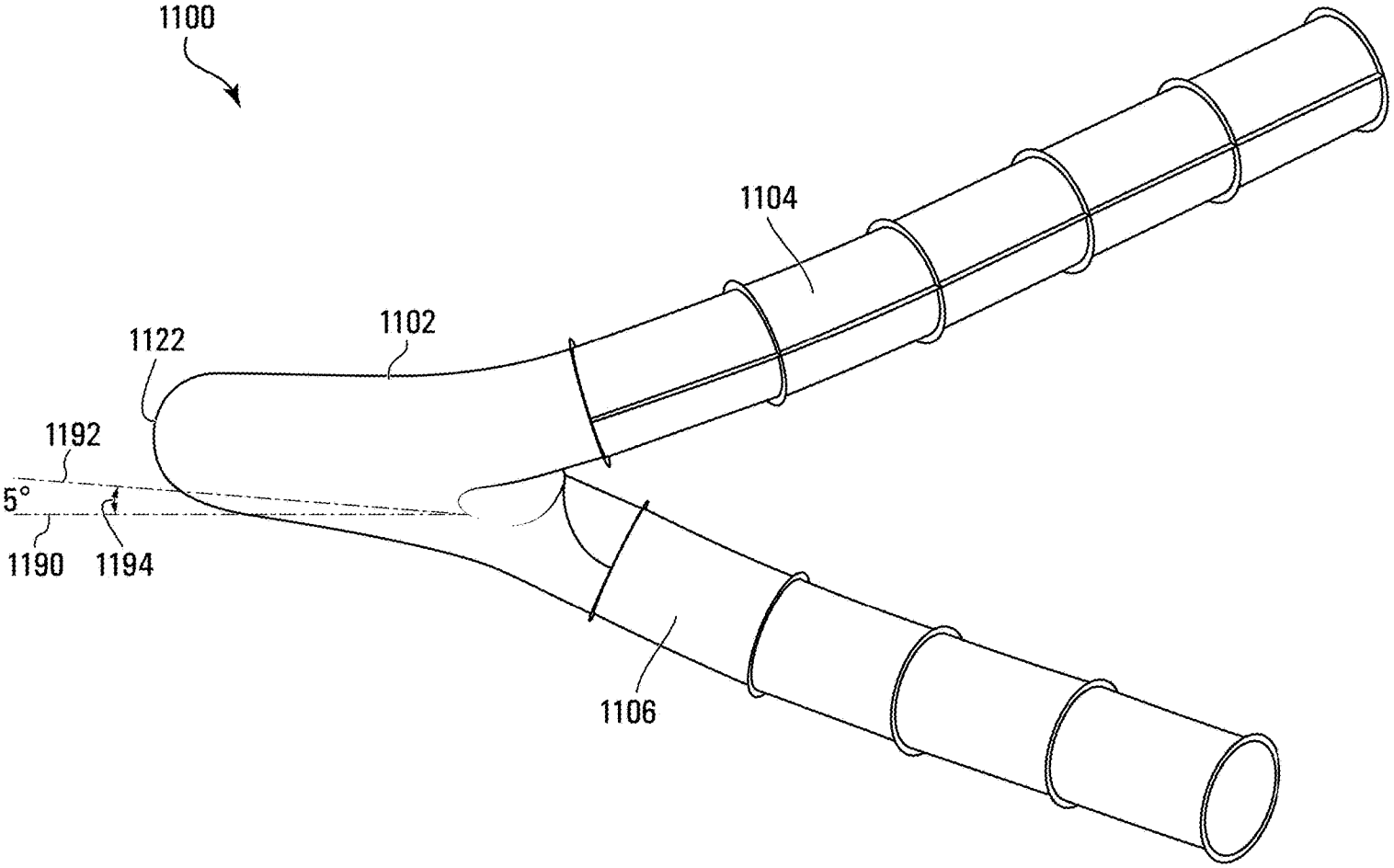

Referring now to FIGS. 11A and 11B, illustrated is another embodiment of a slide feature 1102 for a water slide 1100, the slide feature 1102 being coupled to entry chute 1104 and exit chute 1106 of the water slide 1100, and the slide feature 1102 having a reduced angle between the entry chute 1104 and exit chute 1106.

With reference to FIG. 11A, the slide feature 1102 is depicted in plan view. The slide feature 1102 comprises an inrun 1110 and outrun 1112, an outer lip 1122, and a sliding surface 1120 between the inrun 1110 and the outrun 1112. When viewed in plan view, there is a point 1180 where the entry chute 1104 and the exit chute 1106 visually, but not physically, intersect. In the embodiment depicted, the obtuse angle 1182 between a line 1184 tangent to the entry chute 1104 at point 1180 and a line 1186 tangent to the exit chute 1106 at point 1180 is 249.50°. However, it should be understood that obtuse angle 1182 is intended to be illustrative and that other angles are contemplated. In particular, in some exemplary embodiments, the angle 1182 may be less than 249.50°. In other exemplary embodiments, the angle 1182 may be between approximately 250° and 265°. In other embodiments, the angle 1182 may be greater than 265°.

For the purpose of describing the relationship between how a rider or ride vehicle enters and exits the slide feature 1102, it may also be appropriate to utilize different points of reference other than point 1180. For example, it may be convenient and/or instructive to refer to the obtuse angle between a line tangent to the inrun 1110 and a line tangent to the outrun 1112. In some embodiments, such an angle may be 249.50°. In other embodiments, such an angle may be less than or greater than 249.50°.

FIG. 11B depicts the slide feature 1102 of FIG. 11A from a side elevational view. The slide feature 1102 is shown inclined relative to horizontal plane 1190. In particular, in the illustrated embodiment, pitch angle 1194 relative to the horizontal plane 1190 is 5°. That is, from the viewing direction of FIG. 11B, an angle between a line segment 1192 taken along the sliding surface 1120 of the slide feature 1102 and the horizontal plane 1190 is 5°. However, it should be understood that other pitch angles are contemplated, for example as set out earlier in this specification.

Figure 12A:
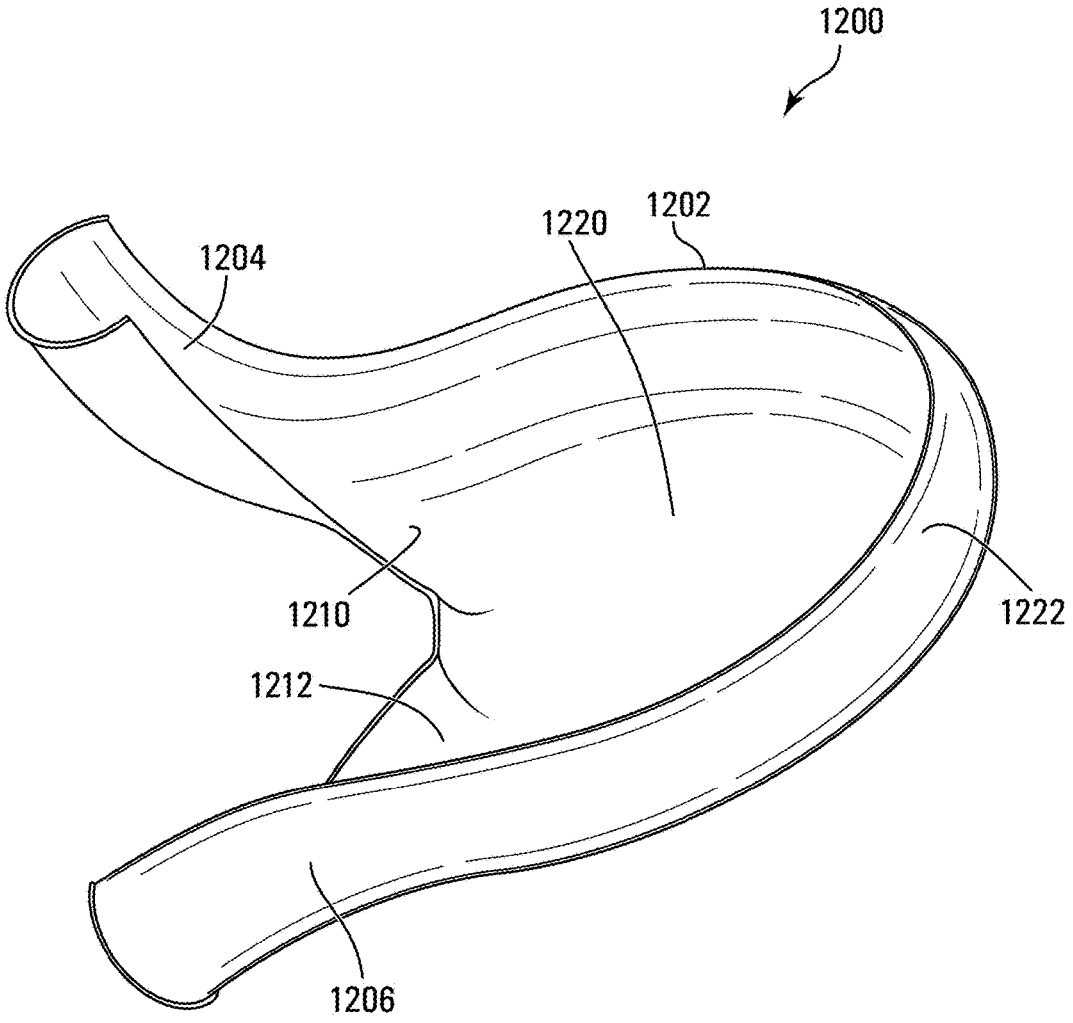
FIGS. 12A-12C show another embodiment of the slide feature having an increased size to accommodate larger ride vehicles and a roll angle of approximately 33.75°.
Figure 12B:
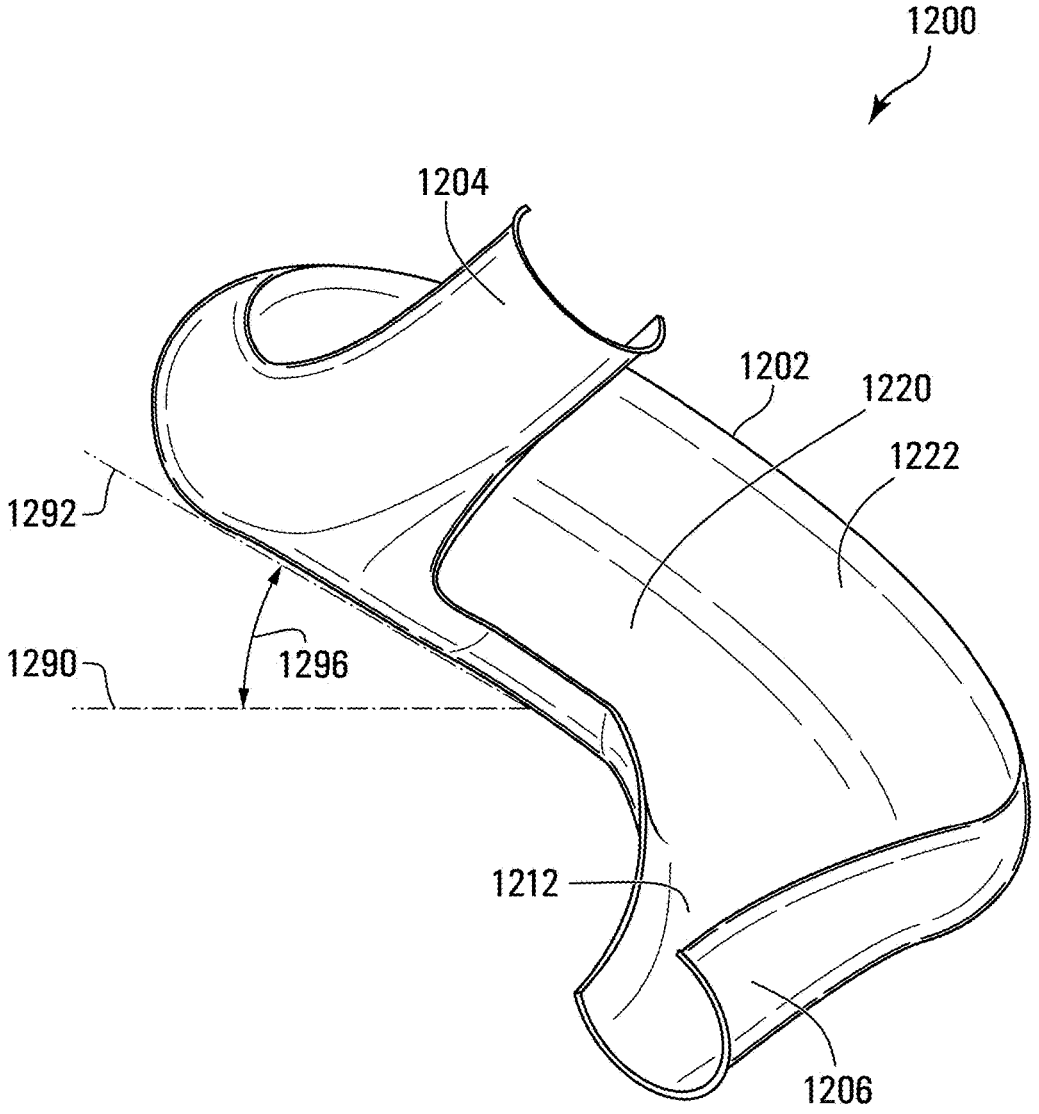
Figure 12C:
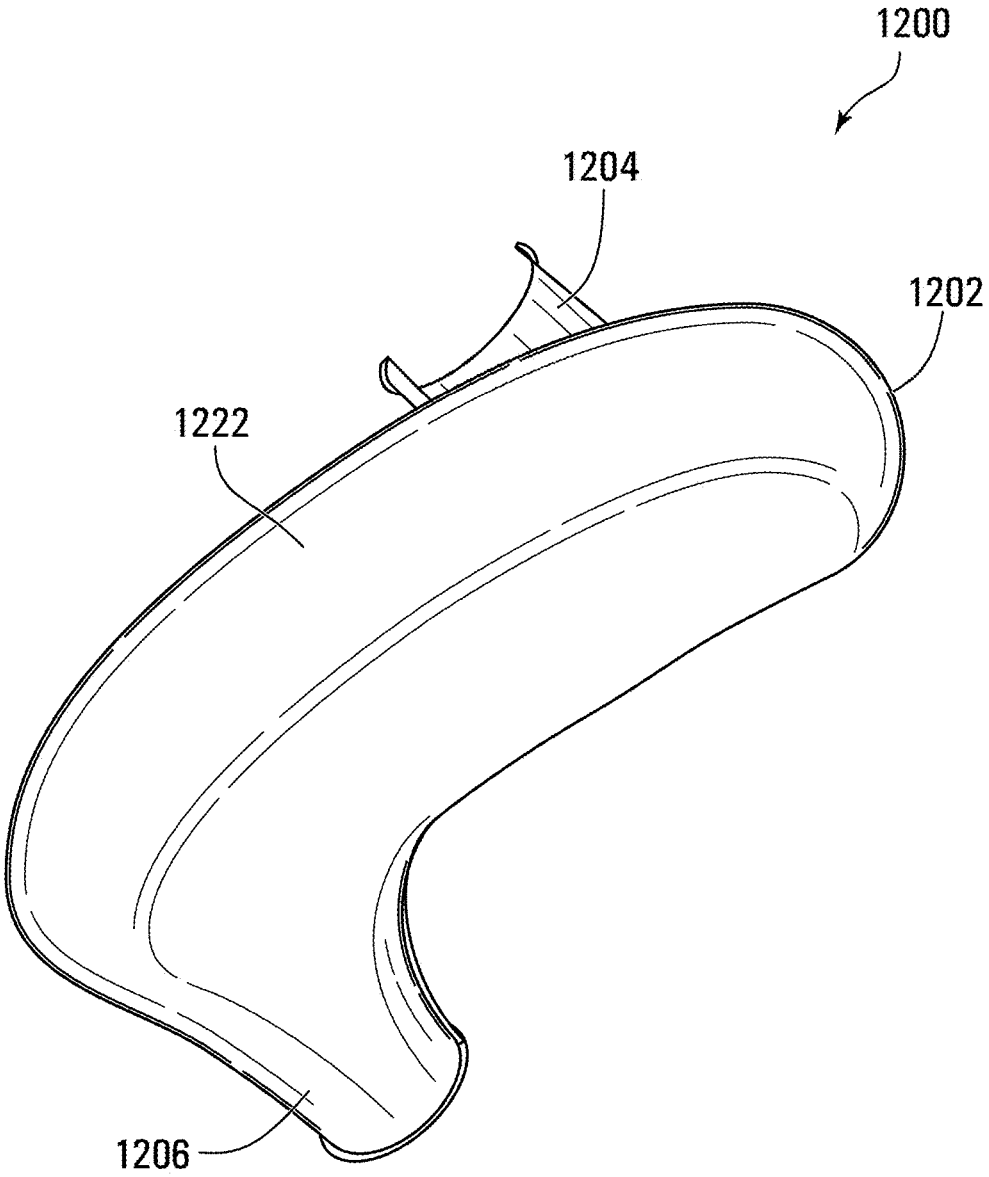

Referring now to FIGS. 12A to 12C, illustrated is another embodiment of a slide feature 1202 for a water slide 1200, the slide feature 1202 being coupled to entry chute 1204 and exit chute 1206 of the water slide.

With reference to FIG. 12A, the slide feature 1202 is depicted from a side elevational view. The slide feature 1202 comprises an inrun 1210 and outrun 1212, an outer lip 1222, and a sliding surface 1220 between the inrun 1210 and the outrun 1212. In the illustrated embodiment, relative dimensions of the slide feature 1202, including the width of inrun 1210, the width of outrun 1212, the radius of sliding surface 1220, and the height of outer lip 1222 have been increased relative to the embodiment depicted in FIGS. 1A-1D to accommodate larger ride vehicles.

FIGS. 12B and 12C depict the slide feature 1202 of FIG. 12A from two other side elevational views. In FIG. 12B, the slide feature 1202 is shown inclined relative to horizontal plane 1290. In particular, in the illustrated embodiment, roll angle 1296 relative to the horizontal plane 1290 is approximately 33.75°. That is, from the viewing direction of FIG. 12B, an angle 1296 between a line segment 1292 taken along the sliding surface of the slide feature 1202 and the horizontal plane 1290 is approximately 33.75°. However, it should be understood that other roll angles are contemplated, for example as set out earlier in this specification. It can also be seen from FIG. 12B that, in the depicted embodiment, entry chute 1204 and exit chute 1206 are not in proximity to each other. Additionally, in the embodiment shown in FIGS. 12A to 12C, entry chute 1204 and exit chute 1206 do not cross over each other. In alternate possible embodiments (not shown) where entry chute 1204 and/or exit chute 1206 may be extended in length, depending on the manner and configuration in which entry chute 1204 and/or exit chute 1206 would have their lengths extended through three-dimensional space, entry chute 1204 and/or exit chute 1206 may or may not cross over each other when the slide feature 1202 is viewed in plan view.

Figure 13:
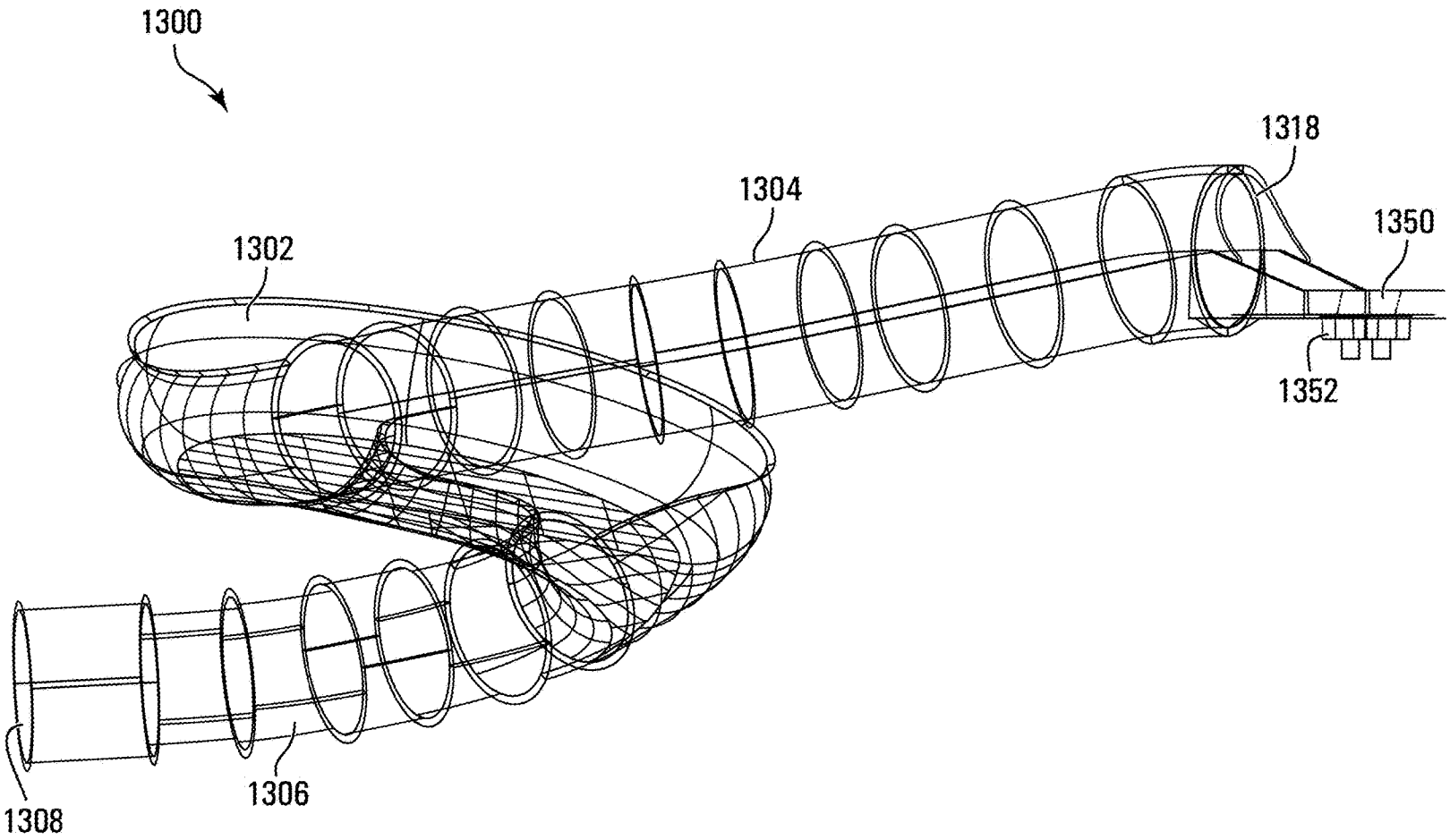
FIG. 13 shows in wireframe elevational view another embodiment of the slide feature mounted for testing purposes.

FIG. 13 illustrates in wireframe elevational view another embodiment of a slide feature 1302 for a water slide 1300, the slide feature being coupled to entry chute 1304 and exit chute 1306 of the water slide. In the embodiment shown, the slide feature 1302 has been mounted in a testing configuration, in which entry chute 1304 is secured to start platform 1350 via securing means 1352. Start platform 1350 is supported above ground by a supporting structure (not shown). For testing purposes, riders, dummy replicas of riders, and/or ride vehicles may enter the water slide 1300 from start platform 1350 via entry chute opening 1318, travel through the water slide 1300, including through slide feature 1302, and then exit via exit chute opening 1308. Although a configuration intended for testing purposes is depicted in FIG. 13, it should be understood that the depicted slide feature 1302 could also be installed in a water park for use by water park patrons.

Figure 14A:
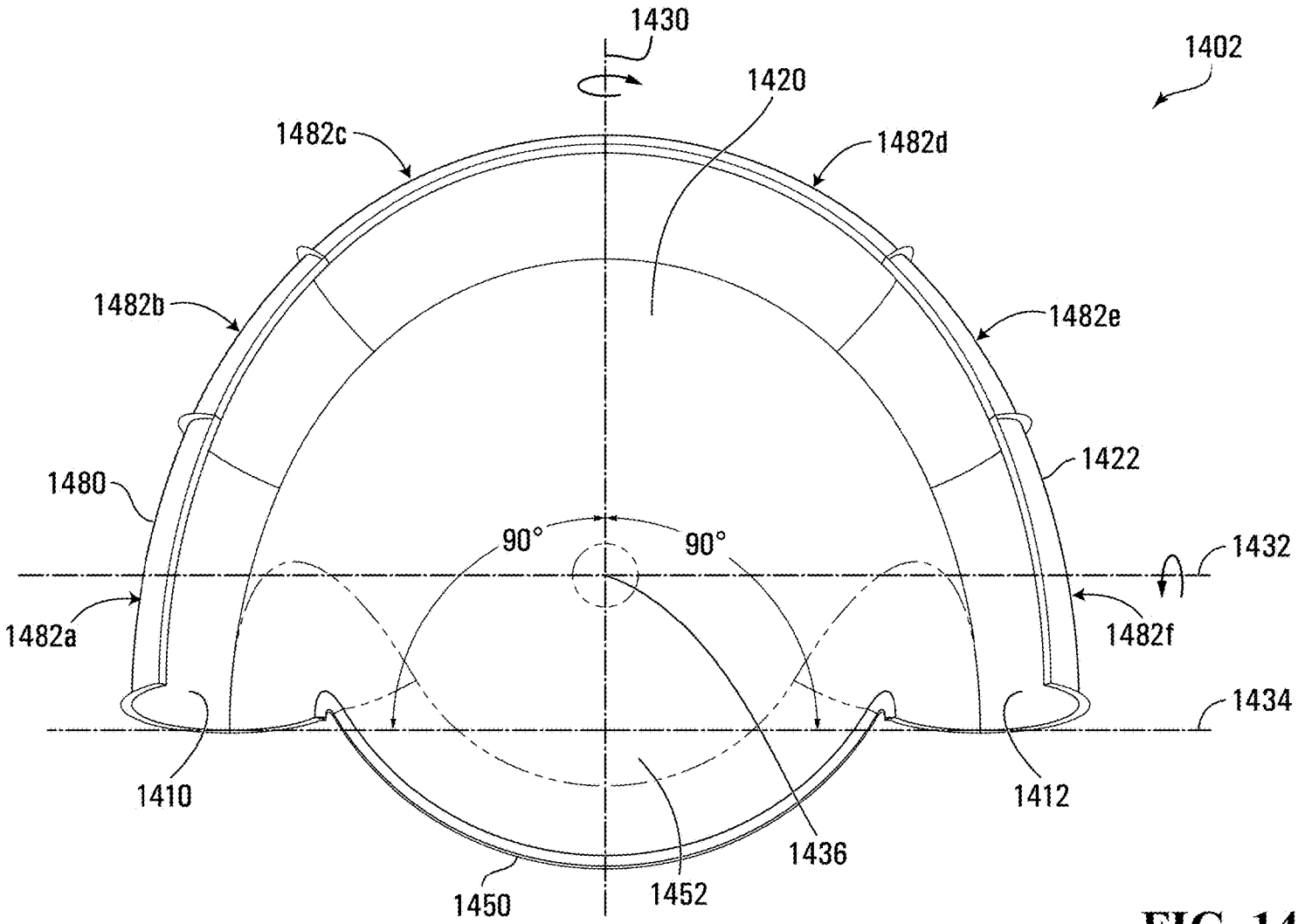
FIGS. 14A-14C show another embodiment of the slide feature having a compounded outer radius.
Figure 14B:
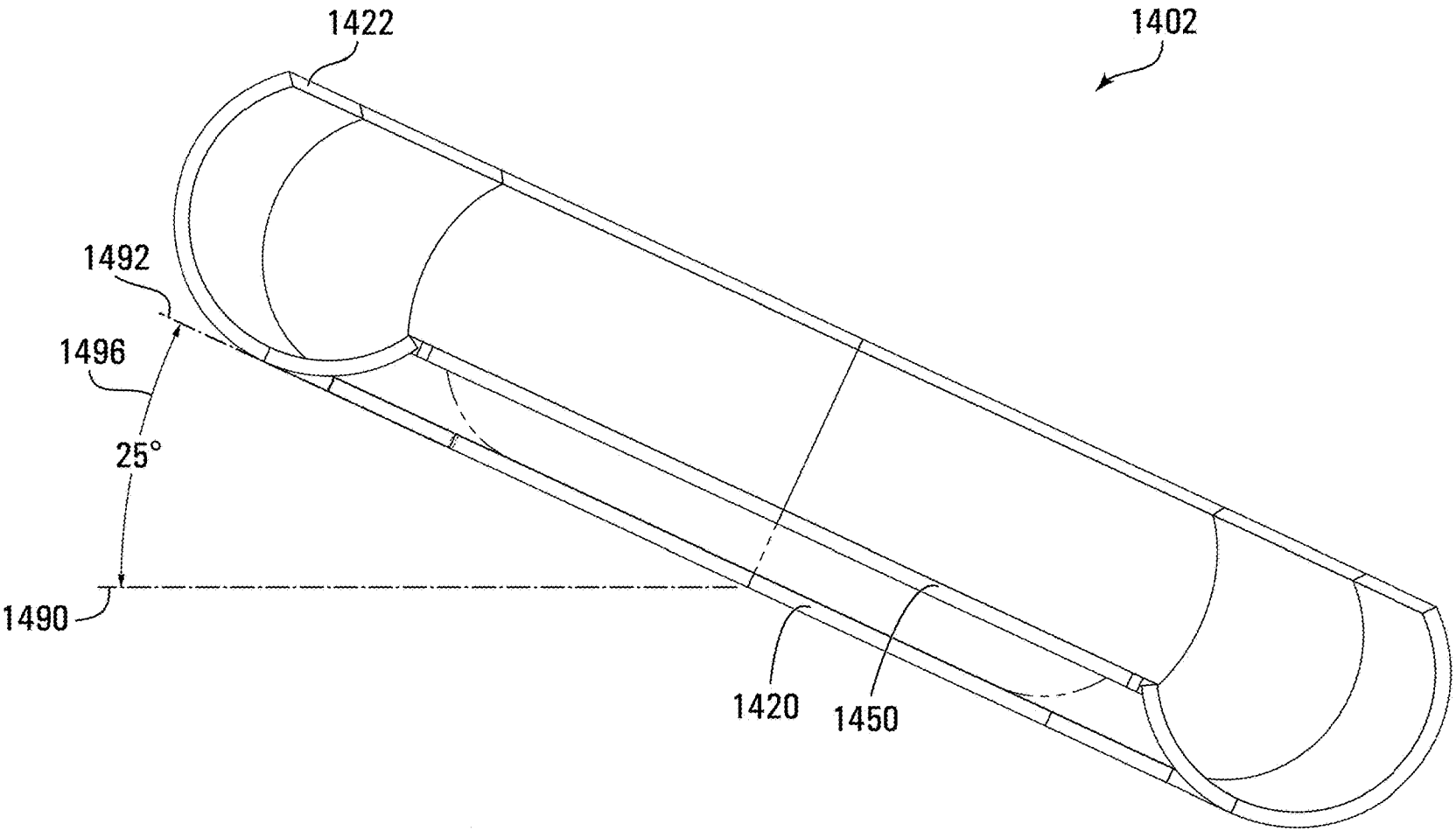
Figure 14C:
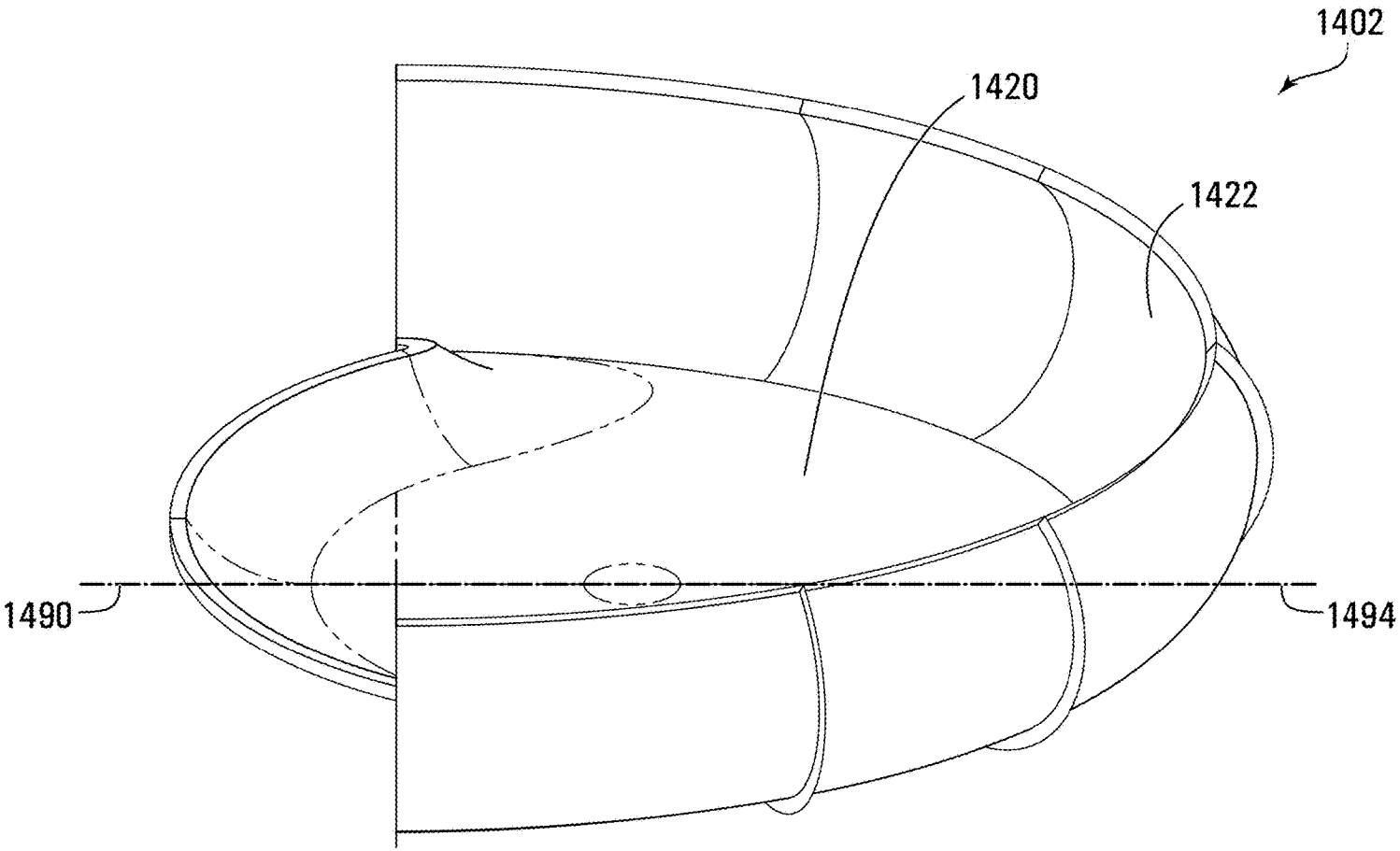

Referring now to FIGS. 14A to 14C, illustrated is another embodiment of a slide feature 1402, the slide feature 1402 having a compounding outer radius.

With reference to FIG. 14A, the slide feature 1402 is depicted in plan view. The slide feature 1402 comprises an inrun 1410 and an outrun 1412, an outer lip 1422 extending from the inrun 1410 to the outrun 1412, and a sliding surface 1420 between the inrun 1410 and the outrun 1412. An inner lip 1450 also extends from the inrun 1410 to the outrun 1412 on the side of the slide feature opposite the outer lip 1422. Between sliding surface 1420 and inner lip 1450 is an inner core portion 1452.

In the embodiment depicted, the outer lip 1422 has a compounding outer radius with respect to a point 1436 proximal to a center portion of the slide feature 1402. A compounding outer radius, unlike a constant outer radius, varies in length around the outer lip 1422 of the slide feature 1402. The outer radius may be longest proximal to the inrun 1410 and to the outrun 1412, and may be shortest halfway along the outer lip 1422 between the inrun 1410 and the outrun 1412, with smooth transitions inbetween. Although FIG. 14A is not drawn to scale, in a typical embodiment, the outer radius measured at each of points 1482*a*, 1482*b*, 1482*c*, 1482*d*, 1482*e*, and 1483*f* may be 30 feet, 20 feet, 15 feet, 15 feet, 20 feet, and 30 feet, respectively. It should be understood that other dimensions are possible, and that in some embodiments the outer radius may not compound all the way around the outer lip 1422 of the slide feature 1402. For example, in some embodiments the outer radius may compound only proximal to the inrun 1410 and/or proximal to the outrun 1412. In the configuration depicted in FIG. 14A, the compounding outer radius may serve to keep riders or ride vehicles "loaded" along the outer lip 1422 as the riders or ride vehicles travel through the slide feature 1402. Smooth (rather than abrupt) transitions in the compounding outer radius may also facilitate rider comfort as the riders or ride vehicles travel through the slide feature 1402.

In some embodiments, an average outer radius of the slide feature 1402 may be approximately 54, 36, or 27 feet. These respective sizes may also be expressed as an outer diameter of 108, 72, or 54 feet, respectively. In other embodiments, a maximum or minimum outer radius of the slide feature 1402 may be approximately 54, 36, or 27 feet.

In the embodiment depicted in FIGS. 14A to 14C, the outer lip 1422 has a reduced height measured relative to the sliding surface 1420. For example the, the height of the outer lip 1422 is reduced relative to the embodiments depicted in FIGS. 11A to 11B and 12A to 12C. Reducing the height of the outer lip 1422 may reduce the "flume feel" of the slide feature 1402. That is, reducing the height of the outer lip 1422 may contribute to, or accentuate, a sensation experienced by riders as they transition from traveling within a flume to traveling within the comparatively open slide feature 1402, thereby potentially adding or contributing to a psychological thrill factor. In some embodiments, reducing the height of the outer lip 1422 may assist in ensuring that riders or ride vehicles travel completely or primarily on the sliding surface 1420, rather than sliding partially or completely along the inner surface of the outer lip 1422. Although one particular height and profile for the outer lip 1422 is depicted in FIGS. 14A to 14C, it should be understood that other heights and profiles of the outer lip 1422 are possible.

Also, in the embodiment depicted, the inner lip 1450 and the inner core portion 1452 have a curved shape revolved around the point 1436 proximal to the center portion of the slide feature 1402. The curved shape of the inner lip 1450 and inner core portion 1452 may assist in visually emphasizing that the slide feature 1402 as a whole has a shape that may suggest to riders and/or other viewers the idea of a dinner saucer and/or of an unidentified flying object (UFO). In some embodiments, inner core portion 1452 may have a shape that is primarily decorative, and may not be intended for sliding. In the embodiment shown, the height of the inner lip 1450 is relatively shallow compared to the height of the outer lip 1422, thereby increasing visibility for riders travelling within the slide feature 1402. The curved shape of the inner lip 1450 and inner core portion 1452, as well as the shallowness of the inner lip 1450 may also assist in reducing the "flume feel" of the slide feature 1402, thereby potentially adding or contributing to a psychological thrill factor for riders. Although one particular shape for the inner core portion 1452 and one particular height and profile for the inner lip 1450 are depicted in FIGS. 14A to 14C, it should be understood that other shapes, heights, and profiles for the inner core portion 1452 and the inner lip 1450 are possible. In some embodiments, inner core portion 1452 and/or the inner lip 1450 may be omitted.

Also identified in FIG. 14A are a roll axis 1430 and a pitch axis 1432, the roll axis 1430 and the pitch axis 1432 being mutually perpendicular. Each of the roll axis 1430 and pitch axis 1432 is illustrated surrounded by arrows indicating the direction in which a positive rotation along each axis would tilt the slide feature 1402. In the depicted embodiment, each of the roll axis 1430 and pitch axis 1432 lies along a horizontal plane passing through a portion of the sliding surface 1420, the horizontal plane being parallel to a ground surface beneath the slide feature 1402. However, in some embodiments, each of the roll axis 1430 and pitch axis 1432 may have a different location, thereby permitting the sliding surface 1420 to have any orientation in three-dimensional space relative to the ground surface beneath the slide feature 1402. Further, in the depicted embodiment, the intersection point of the roll axis 1430 and the pitch axis 1432 is shown located at the point 1436 proximal to a center portion of the slide feature 1402. In some embodiments, the intersection point of the roll axis 1430 and the pitch axis 1432 may have another location.

Further identified in FIG. 14A is a line 1434 intersecting with end portions of inrun 1410 and outrun 1412. In the depicted embodiment, a rider or ride vehicle travels in a 180° revolution through the slide feature 1402, measured relative to end portions of inrun 1410 and outrun 1412. It should be understood that other angles of revolution are possible. In one example embodiment of the slide feature 1402, the angle of revolution may be 170°.

FIGS. 14B and 14C depict an example configuration of the slide feature 1402 of FIG. 14A from two side elevational views. In FIG. 1B, the roll axis 1430, not shown, is parallel to the viewing direction from which the figure is drawn. In FIG. 14C, the pitch axis 1432, not shown, is parallel to the viewing direction from which the figure is drawn. In FIGS. 14B and 14C, the slide feature 1402 is shown inclined at a roll angle 1496 of 25° relative to horizontal plane 1490 as measured from a line 1492 parallel to sliding surface 1420. The slide feature 1402 is shown with no inclination around the pitch axis 1432, i.e., with a pitch angle of zero relative to horizontal plane 1490 as measured from a line 1494 along sliding surface 1420. Because the pitch angle is zero, horizontal plane 1490 and line 1494 are collinear in FIG. 14C. However, it should be understood that the pitch and roll angles illustrated in FIGS. 14B and 14C are intended to depict an example embodiment and that other pitch and roll angles may be selected.

Some embodiments having a roll angle only (i.e., a non-zero roll angle and a pitch angle of zero) may reduce or eliminate uphill portions of the slide feature 1402, for example reducing or eliminating portions of the sliding surface 1420 that may have a negative (uphill) gradient. Configurations of the slide feature 1402 with fewer or no uphill portions may reduce or eliminate a need to configure the slide feature 1402 with water evacuation means. Configurations of the slide feature 1402 with fewer or no uphill portions may also improve the performance of inrun 1410 by urging riders or ride vehicles entering the slide feature 1402 to maintain contact with outer lip 1422.

In particular, embodiments featuring a combination of a roll angle only with an angle of revolution of 180° or less may allow uphill portions of the slide feature 1402 to be substantially eliminated. Such embodiments may substantially eliminate the possibility of water pooling before, during, or after the slide feature 1402, thereby substantially eliminating a need to configure the slide feature 1402 with water evacuation means. It should be understood, however, that other embodiments of the slide feature 1402 are contemplated which may include water evacuation means that would be known to a person skilled in the art.

FIGS. 15A-15D illustrate another embodiment of a slide feature 1502 for a water slide 1500, the slide feature 1502 being coupled to entry chute 1504 and exit chute 1506 of the water slide. The slide feature 1502 comprises an inrun 1510 and an outrun 1512, an outer lip 1522 extending from the inrun 1510 to the outrun 1512, and a sliding surface 1520 between the inrun 1510 and the outrun 1512. An inner lip 1550 also extends from the inrun 1510 to the outrun 1512 on the side of the slide feature 1502 opposite the outer lip 1522.

Figure 15A:
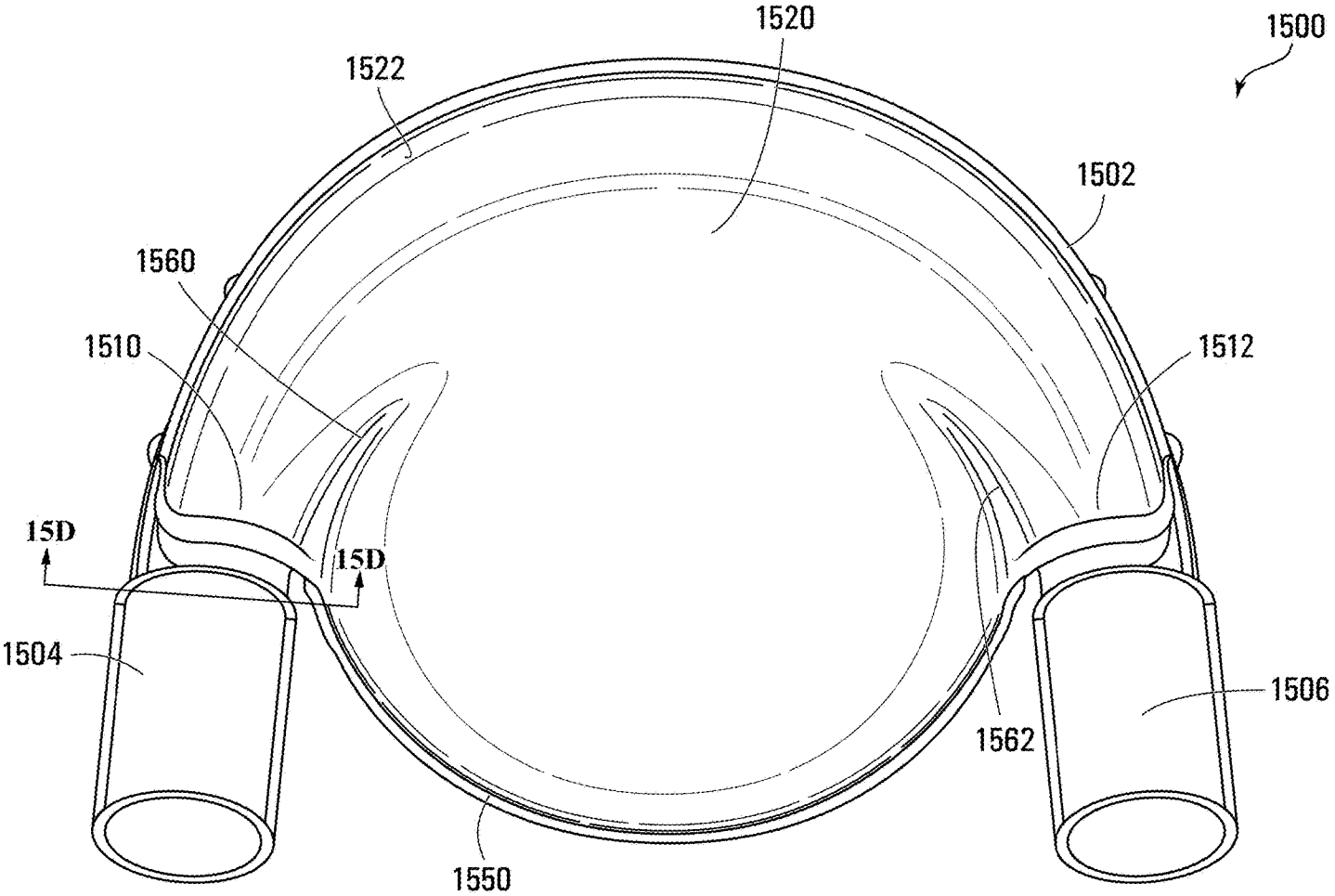
FIGS. 15A-15D show another embodiment of the slide feature having smooth guide surfaces proximal to the inrun and outrun.
Figure 15B:
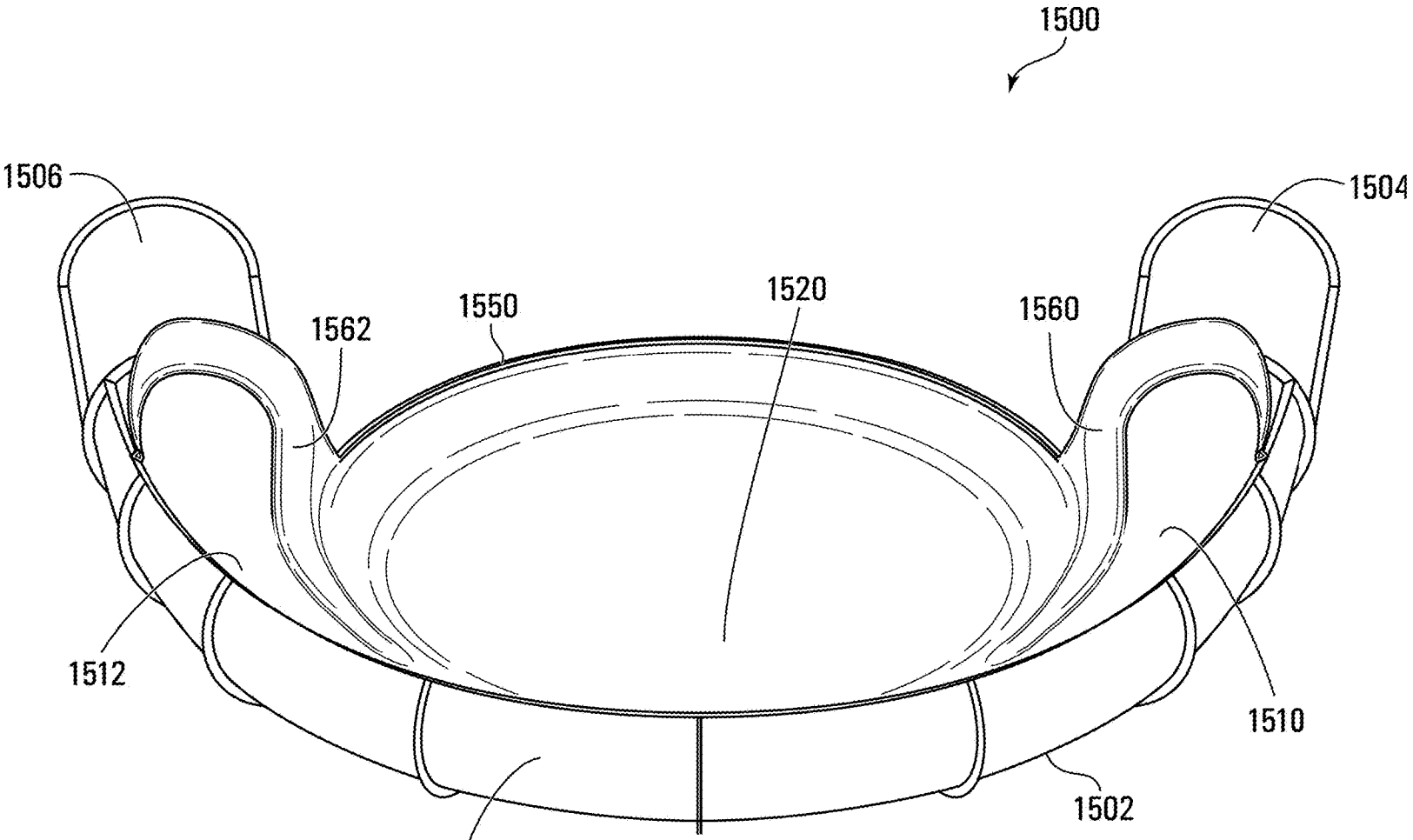
Figure 15C:
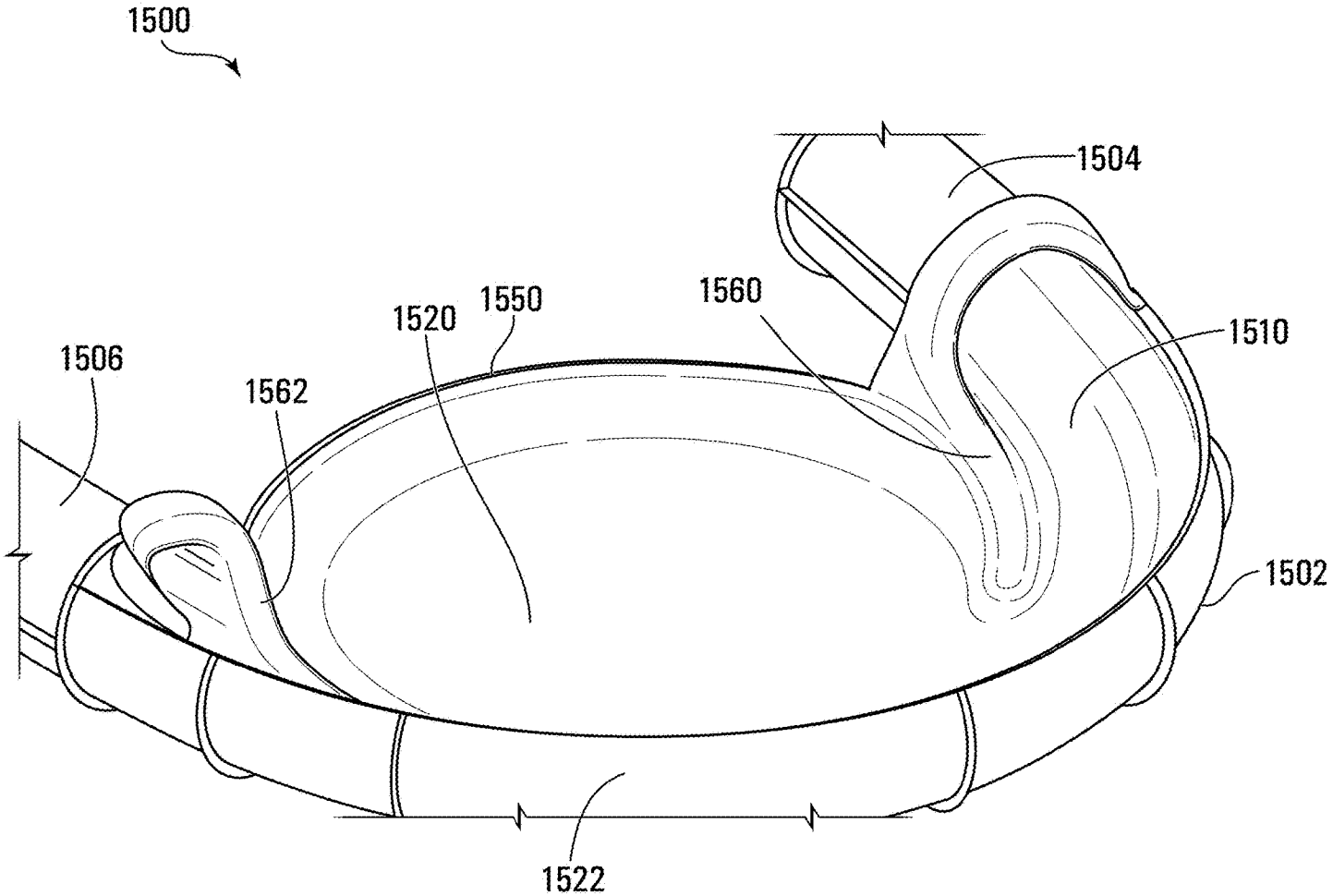

With reference to FIGS. 15A to 15C, the slide feature 1502 is depicted from three different perspective views. In the depicted embodiment, the slide feature 1502 comprises a smooth, raised guide surface 1560 proximal to the inrun 1510 and another smooth, raised guide surface 1562 proximal to the outrun 1512. Guide surface 1560 may facilitate guiding riders or ride vehicles from entry chute 1504 to inrun 1510 and then to sliding surface 1520. Guide surface 1562 may facilitate guiding riders or ride vehicles from sliding surface 1520 to outrun 1512 and then to exit chute 1506. As illustrated in FIGS. 15B and 15C, guide surfaces 1560, 1562 may also extend up and at least partially around the openings of entry chute 1504 and exit chute 1506, thereby potentially reducing the likelihood that riders or ride vehicles can come into contact with ridges or other potentially unsafe surfaces when entering or exiting the slide feature 1502.

Figure 15D:
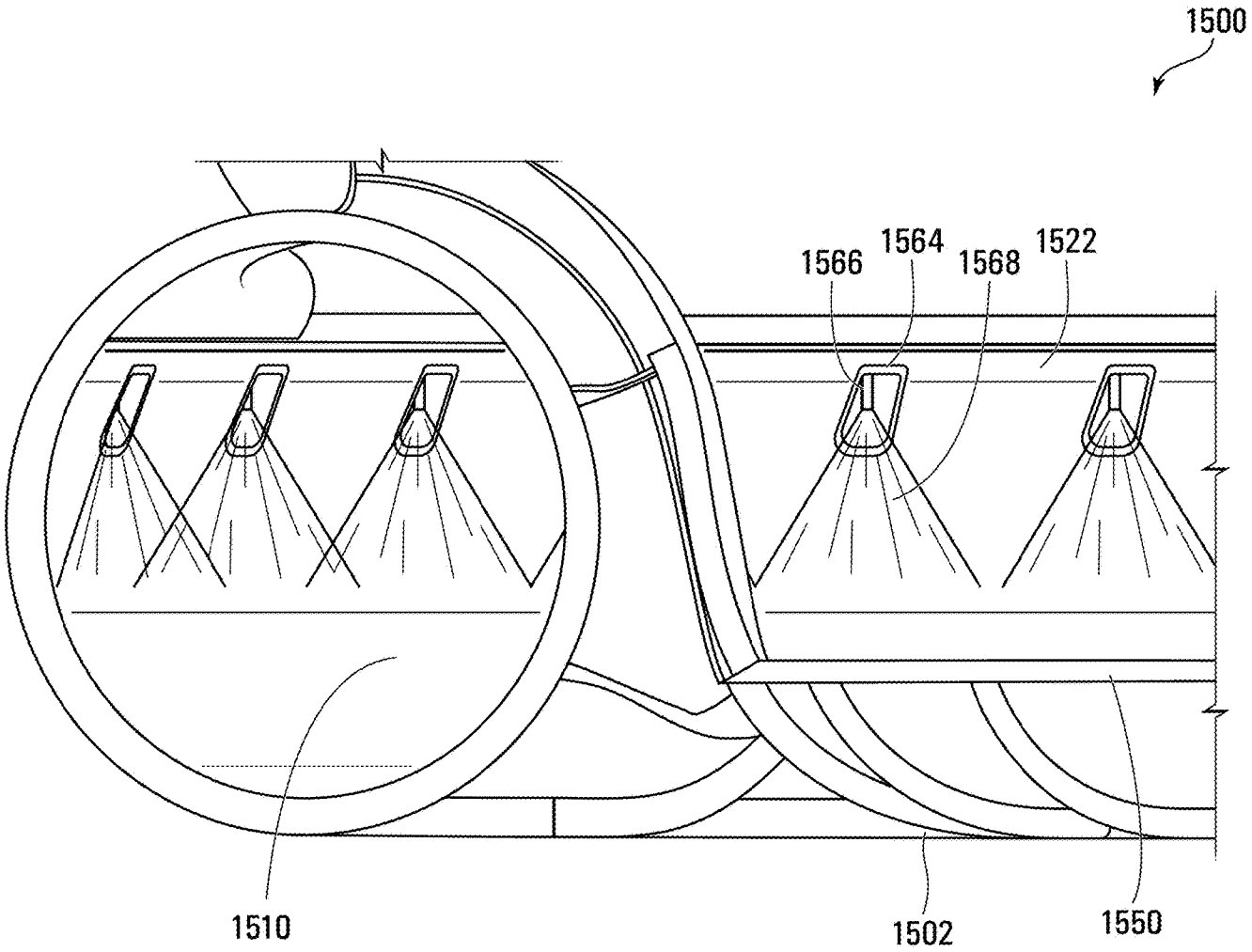

FIG. 15D is a cross-sectional view of a variation of slide feature 1502 taken along line 15D-15D in FIG. 15A. In the variation depicted in FIG. 15D, sprayers 1566 mounted inside indentations 1564 in the outer lip 1522 proximal to the inrun 1510 emit sprays of water 1568 for lubricating the slide feature 1502. It should be understood that the illustrated configuration of sprayers 1566 can be altered as necessary to provide lubrication, for example by providing a different number of sprayers, placing the sprayers in different locations, or employing other water delivery means that would be known to a person skilled in the art.

Figure 16A:
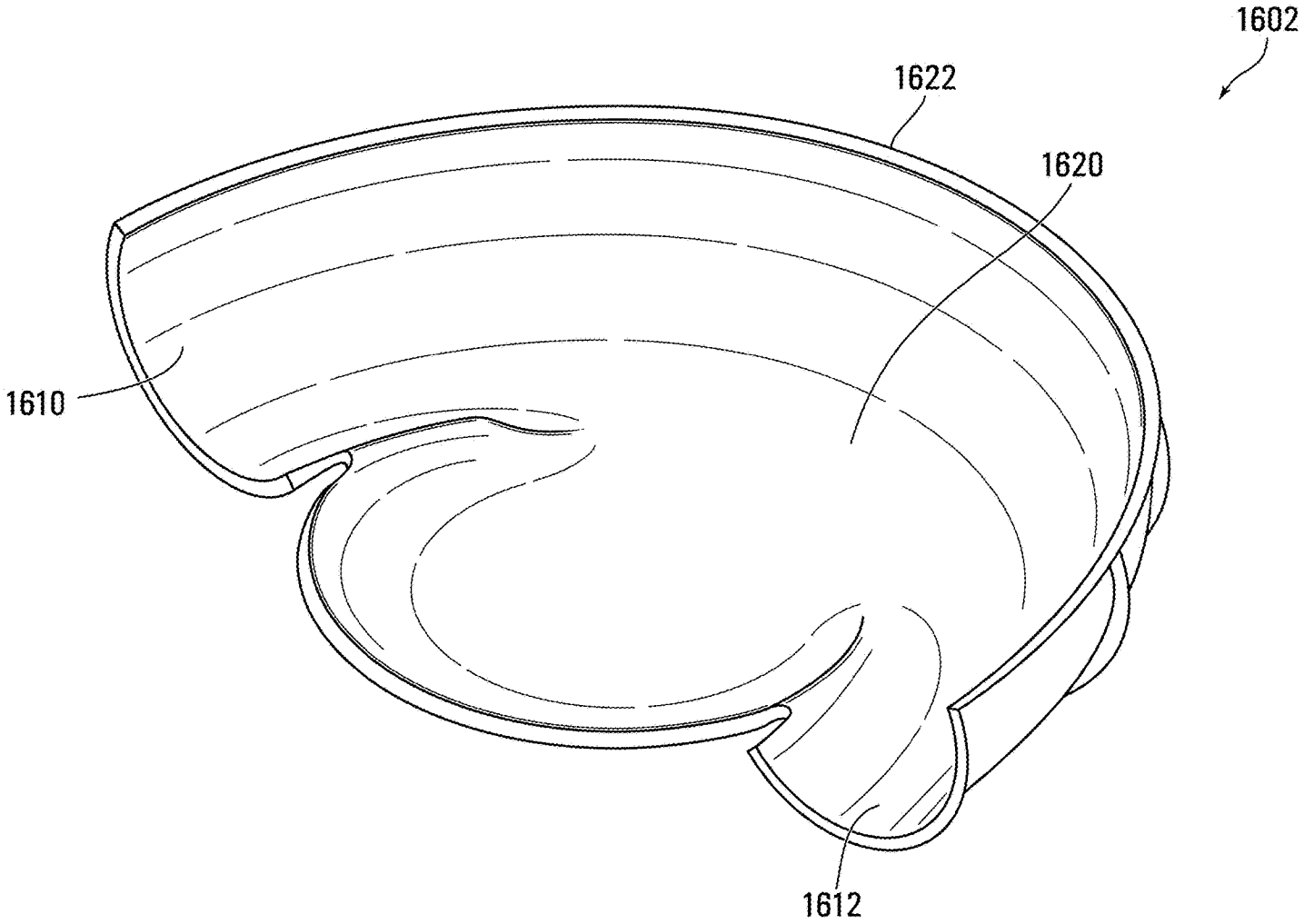
FIGS. 16A-16C show another embodiment of the slide feature for accommodating larger ride vehicles.
Figure 16B:
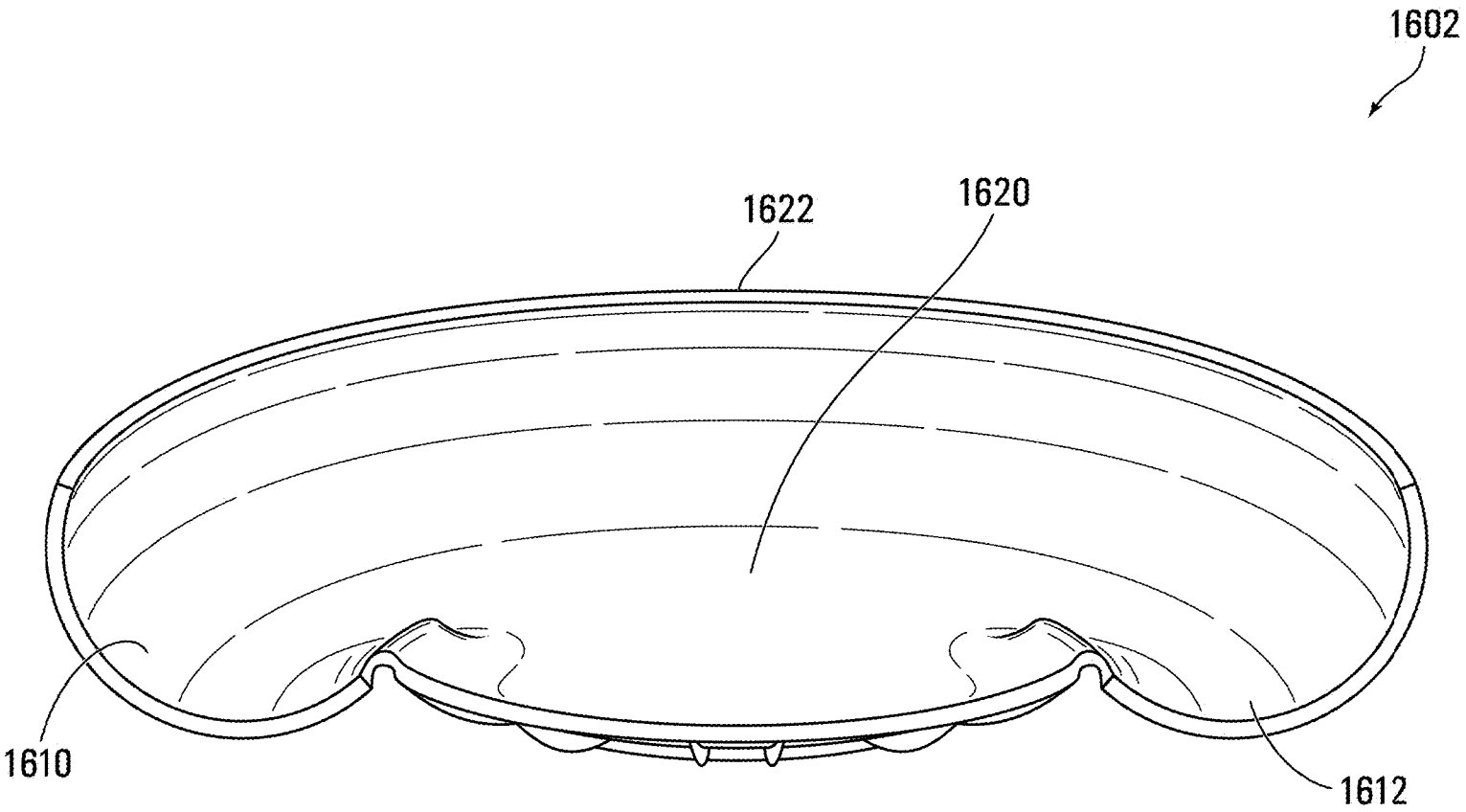
Figure 16C:
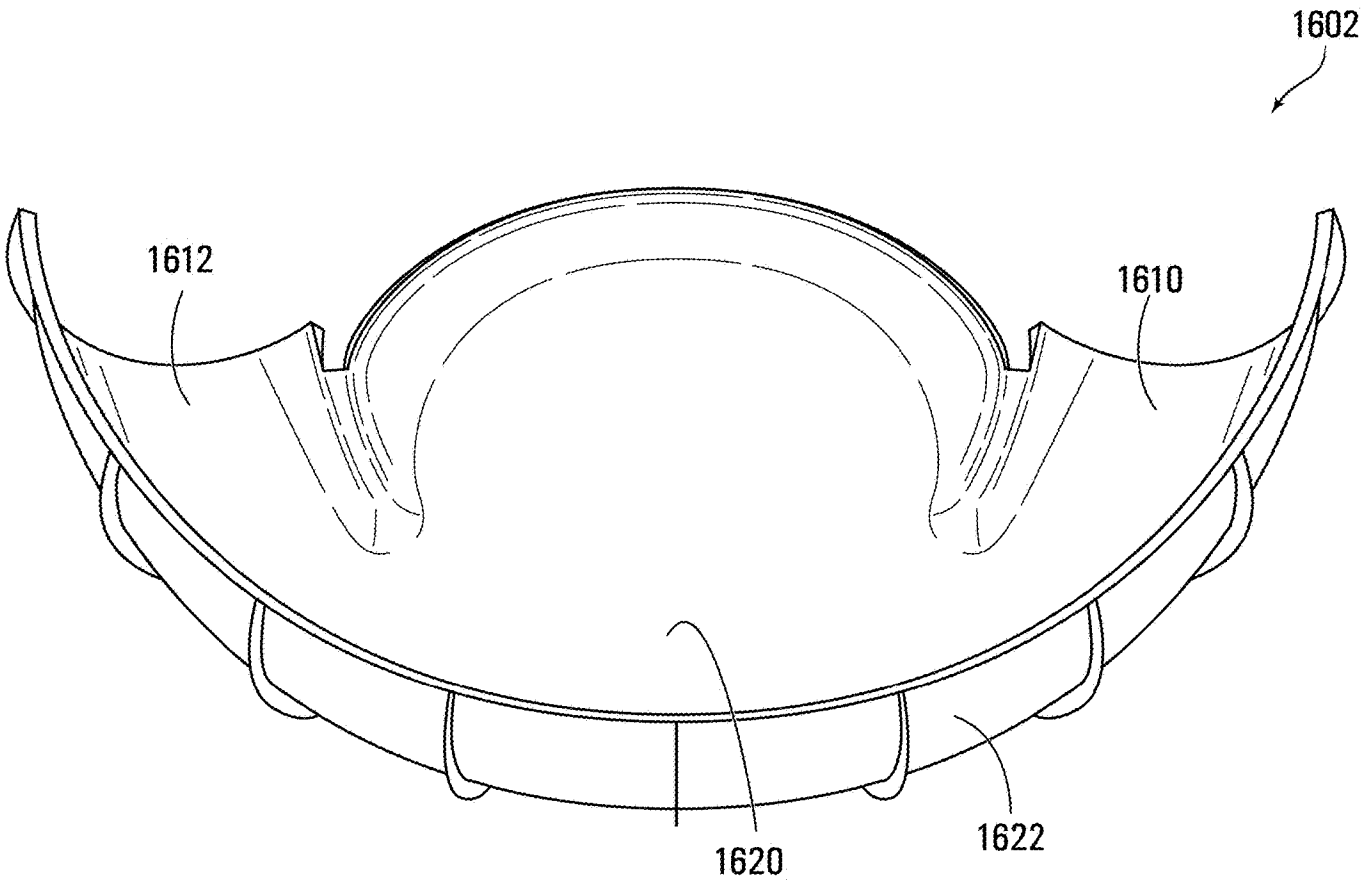

FIGS. 16A-16C illustrate in three different perspective views another embodiment of a slide feature 1602, the slide feature 1602 being configured to accommodate larger ride vehicles.

The slide feature 1602 comprises an inrun 1610 and an outrun 1612, an outer lip 1622 extending from the inrun 1610 to the outrun 1612, and a sliding surface 1620 between the inrun 1610 and the outrun 1612. In the illustrated embodiment, dimensions of some portions of the slide feature 1602 have been enlarged compared to some embodiments discussed previously, for example in comparison to the embodiment of FIG. 15A. The depicted embodiment may be capable of accommodating ride vehicles consisting of 4 to 6 person rafts. It should be understood, however, that other dimensions of slide feature 1602 are possible in order to accommodate other types of ride vehicles and/or other sizes and weights of riders.

Figure 17A:
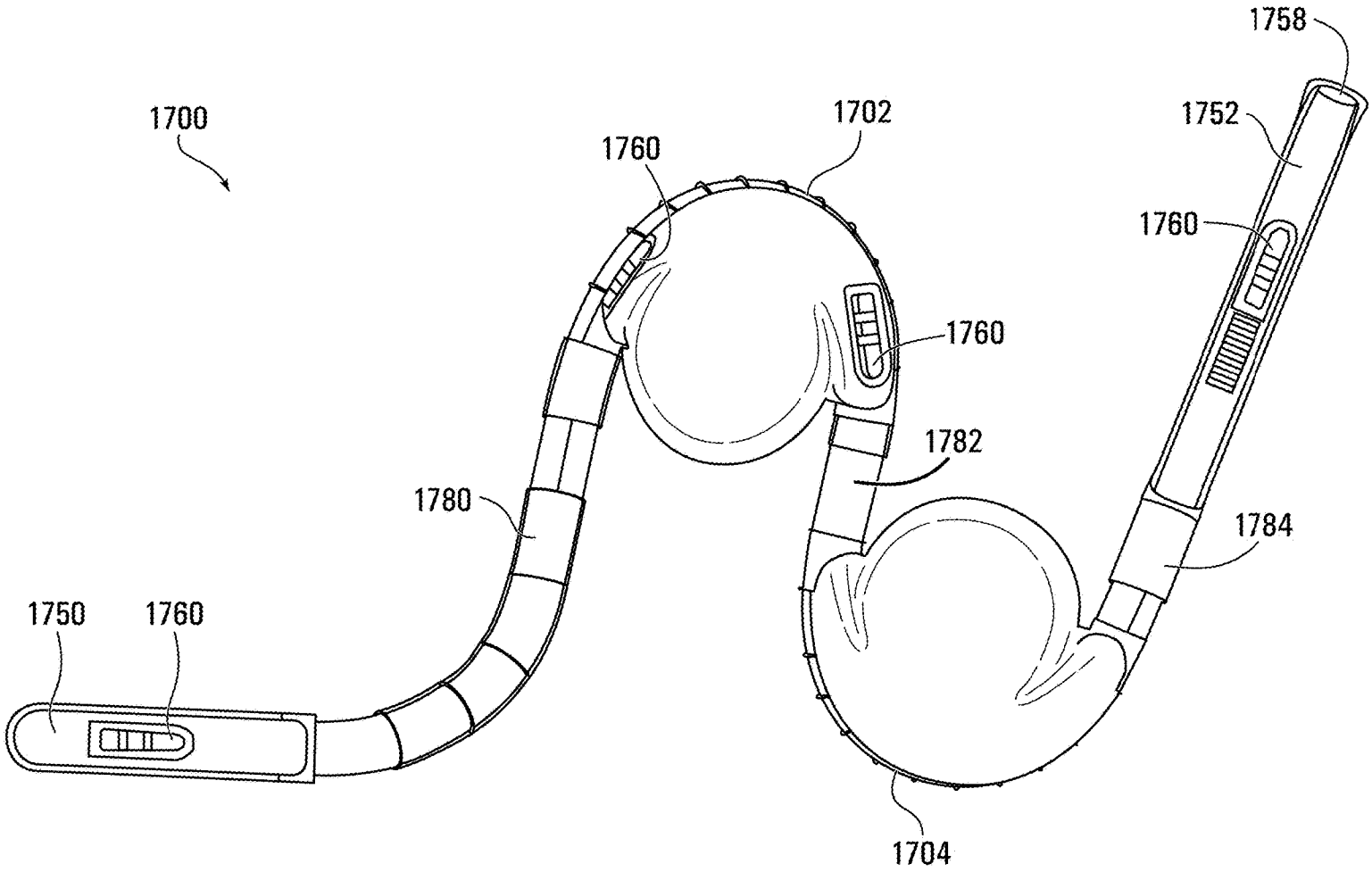
FIGS. 17A-17D show an embodiment of a water slide comprising two slide features.
Figure 17B:
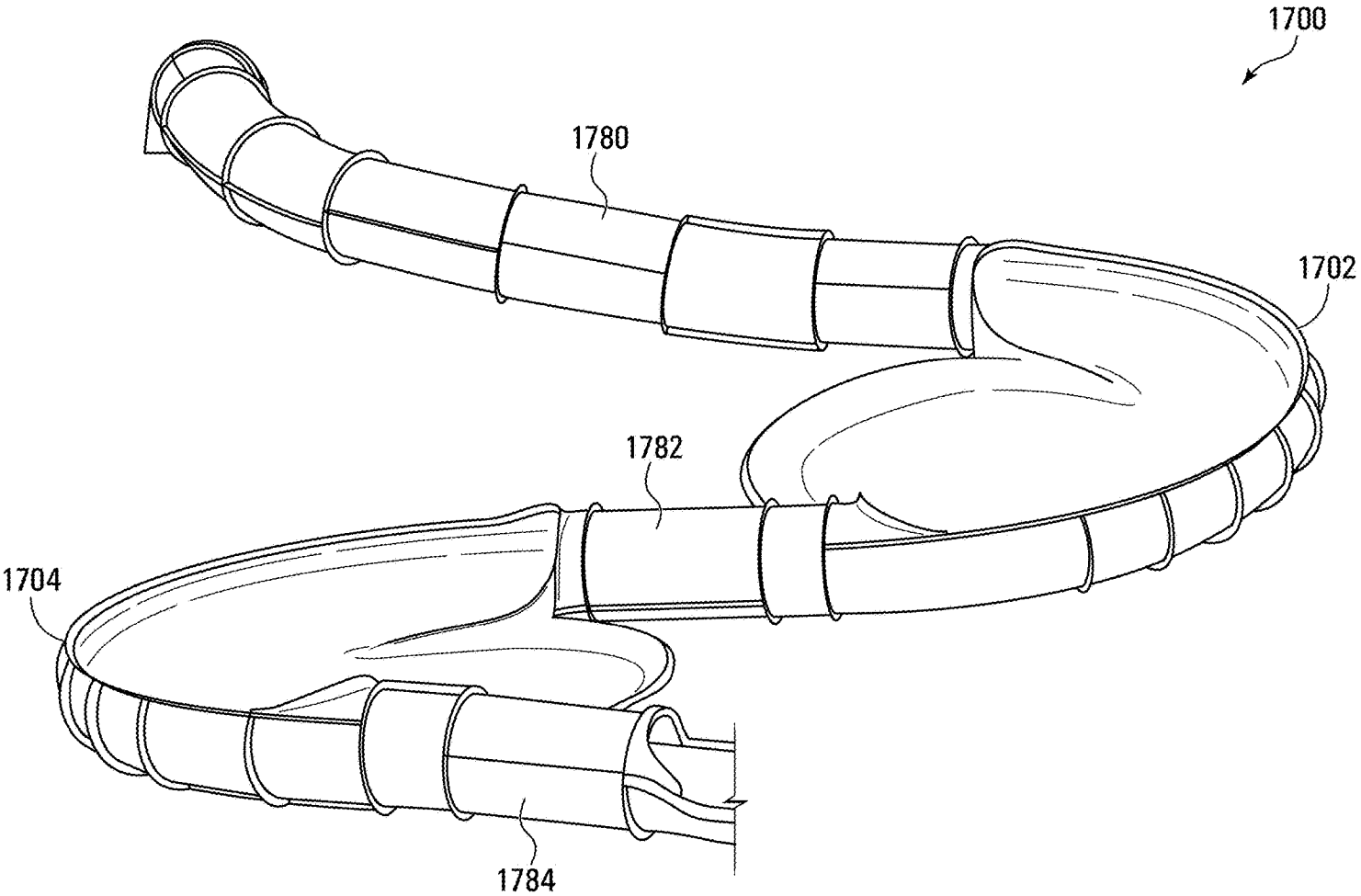
Figure 17C:
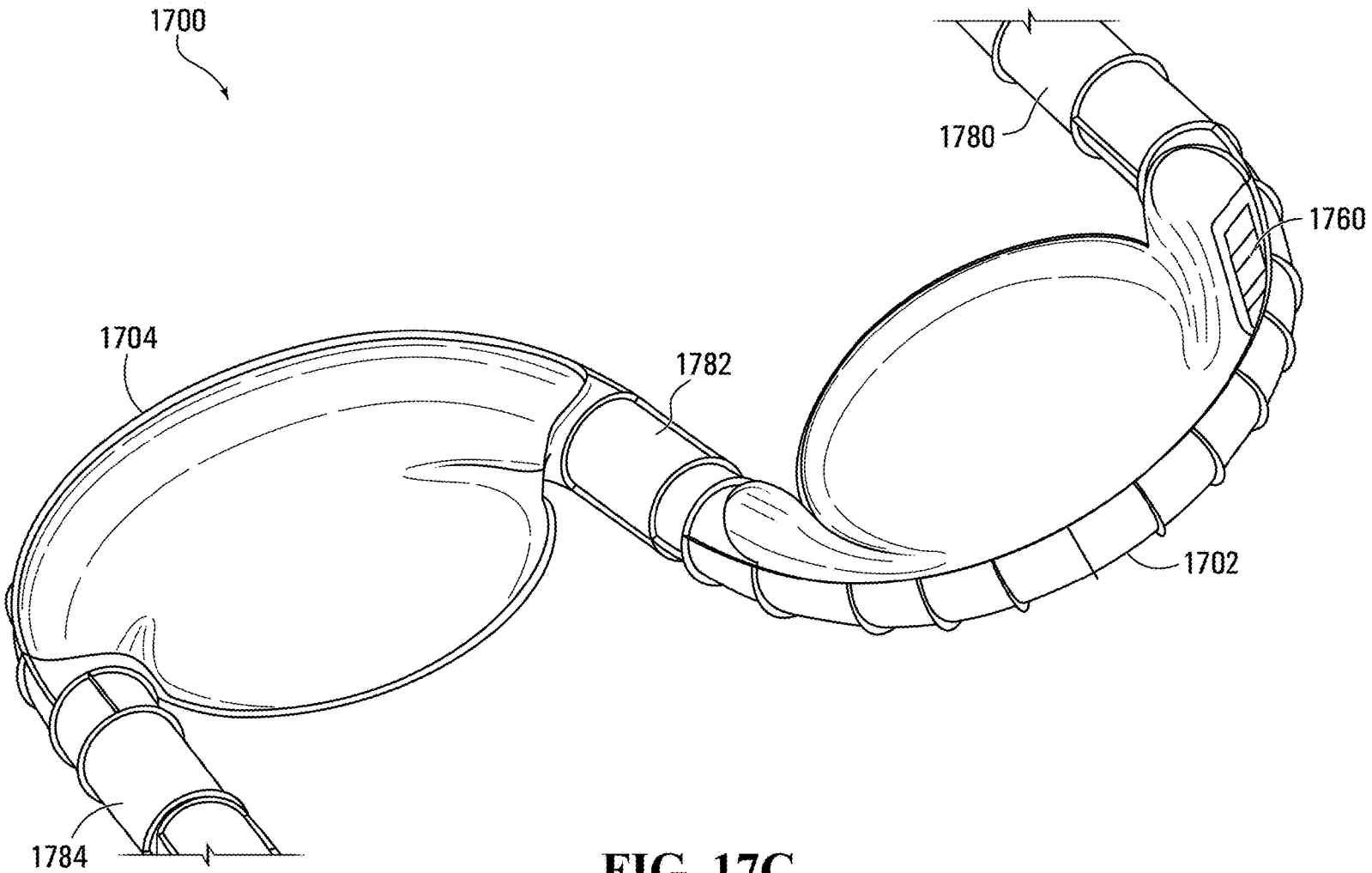
Figure 17D:
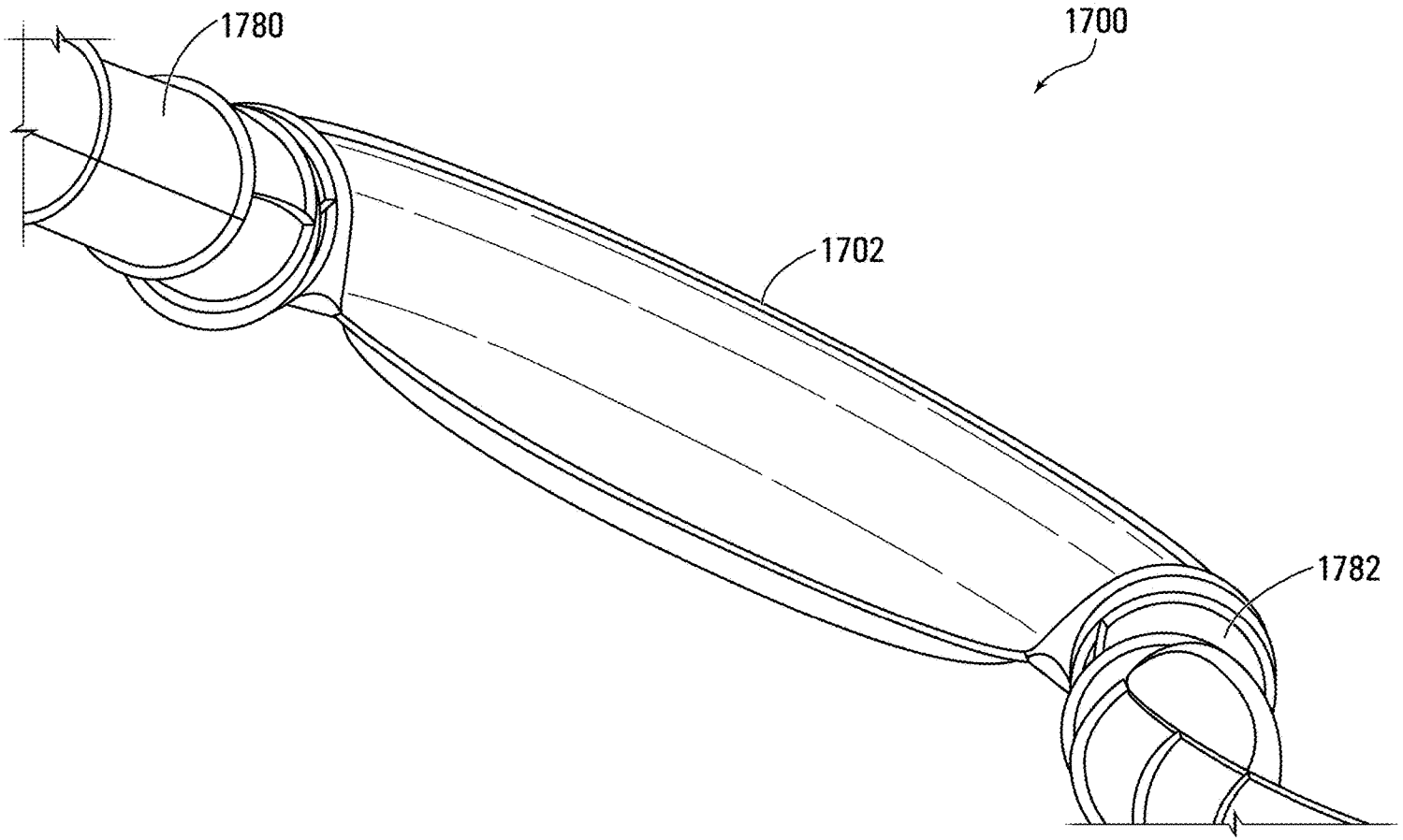

Referring now to FIGS. 17A-17D, illustrated is an embodiment of a water slide 1700 comprising two slide features 1702, 1704. FIG. 17A shows water slide 1700 in plan view, FIG. 17B shows water slide 1700 in side elevational view, and FIGS. 17C and 17D show water slide 1700 in perspective views. In the embodiment depicted, start tub 1750 is connected via a first flume 1780 to a first slide feature 1702. The first slide feature 1702 is connected via a second flume 1782 to a second slide feature 1704. An outrun of the second slide feature 1704 is connected to a third flume 1784. A portion of the third flume 1784 is closed and another portion of the third flume 1784 has an open top. Ride vehicles 1760 travel from start tub 1750 through the length of the water slide 1700 and then exit the water slide 1700 into a pool of water (not shown) through an exit opening 1758 of the third flume. It should be understood that many variations of water slide 1700 are possible. For example, some embodiments of water slide 1700 may comprise a different number of slide features or a different configuration of flumes. In some embodiments, slide features may be connected without intervening flumes, such as without intervening second flume 1782.

The previous description of some embodiments is provided to enable any person skilled in the art to make or use an apparatus, method, or processor readable medium according to the present disclosure. Various modifications to these embodiments will be readily apparent to those skilled in the art, and the generic principles of the methods and devices described herein may be applied to other embodiments. Thus, the present disclosure is not intended to be limited to the embodiments shown herein but is to be accorded the widest scope consistent with the principles and novel features disclosed herein.

What is claimed is:

1. A slide feature for an amusement ride adapted to carry a rider or ride vehicle sliding thereon, the slide feature comprising:

an inrun permitting ingress of the rider or ride vehicle at a first elevation, an outrun permitting egress of the rider or ride vehicle at a second elevation, wherein the first elevation is higher than the second elevation, a sliding surface in communication with the inrun and the outrun, wherein the sliding surface comprises a two-dimensional, planar surface portion substantially in the geometric shape of a sector of a closed curve, wherein the slide feature provides that the rider or ride vehicle, at least partially urged by gravity, slides along the sliding surface from the inrun to the outrun in an arcuate path, wherein the sliding surface is oriented at a pitch angle around a pitch axis, the pitch angle being measured relative to a horizontal plane, wherein the sliding surface is oriented at a roll angle around a roll axis, the roll angle being measured relative to the horizontal plane, wherein the pitch axis and the roll axis are mutually perpendicular, and wherein at least one of the pitch angle and the roll angle is nonzero.

2. The slide feature of claim 1, wherein the sliding surface is substantially planar.

3. The slide feature of claim 1, wherein the pitch angle and the roll angle are selected so that an elevation of the rider or ride vehicle increases along a first portion of the arcuate path and decreases along a second portion of the arcuate path.

4. The slide feature of claim 3, wherein each of the pitch angle and the roll angle is less than 45°.

5. The slide feature of claim 3, wherein at least one of the pitch angle and the roll angle is 11.25°.

6. The slide feature of claim 3, wherein each of the pitch angle and the roll angle are between 15° and 18°.

7. The slide feature of claim 3, wherein the roll angle is 11.25° and the pitch angle is 22.5°.

8. The slide feature of claim 1, wherein a diameter of the slide feature is between 15 feet to 25 feet.

9. The slide feature of claim 1, wherein a radius of the sliding surface is continuously reduced from the inrun to the outrun.

10. The slide feature of claim 9, wherein the radius of the sliding surface at the outrun is 75% of the radius of the sliding surface at the inrun.

11. The slide feature of claim 1, wherein a radius of the sliding surface is constant from the inrun to the outrun.

12. The slide feature of claim 1, wherein the sliding surface is uncovered.

13. The slide feature of claim 1, further comprising a cover over the sliding surface.

14. The slide feature of claim 13, wherein the cover has at least one of a hemispherical or domed shape.

15. The slide feature of claim 1, wherein the slide feature is adapted to carry a ride vehicle and the ride vehicle comprises a raft for seating one human or a raft for seating two humans in an inline configuration.

16. The slide feature of claim 1, wherein a shape of the inrun and a shape of the outrun each are adapted to interface with water slide chutes having a circular or semi-circular cross-section.

17. The slide feature of claim 1, wherein the sliding surface comprises a flexible material with a textured surface.

18. The slide feature of claim 1, wherein the outer lip has a substantially flat cross-section perpendicular to the sliding surface.

19. The slide feature of claim 1, wherein the outer lip has a curved cross-section.

20. The slide feature of claim 19, wherein an edge of the sliding surface is curved to provide a smooth transition to the outer lip.

21. The slide feature of claim 1, wherein an edge of the sliding surface is angled to meet the outer lip.

22. The slide feature of claim 21, wherein the edge of the sliding surface is angled at an angle between 10° and 45° relative to a central part of the sliding surface.

23. A water slide comprising a slide feature according to claim 1.

24. The water slide of claim 23, further comprising: a support structure supporting the slide feature, wherein the support structure is configured to dynamically impart movement to the slide feature.

25. The slide feature of claim 1, wherein the slide feature further comprises an outer lip extending from the inrun to the outrun and wherein the arcuate path is at least partially bounded by the outer lip.

26. The slide feature of claim 25, an edge of the sliding surface is curved to provide a smooth transition to the outer lip.

27. The slide feature of claim 1, wherein the rider or ride vehicle has a continuously decreasing elevation while sliding from the inrun to the outrun.

28. A slide feature for an amusement ride adapted to carry a rider or ride vehicle sliding thereon, the slide feature comprising:

an inrun permitting ingress of the rider or ride vehicle at a first elevation, an outrun permitting egress of the rider or ride vehicle at a second elevation, wherein the first elevation is higher than the second elevation, a sliding surface in communication with the inrun and the outrun, wherein the sliding surface is a substantially two-dimensional, planar surface, wherein the slide feature provides that the rider or ride vehicle, at least partially urged by gravity, slides along the sliding surface from the inrun to the outrun in an arcuate path, wherein the sliding surface is oriented so that an elevation of the rider or ride vehicle increases along a first portion of the arcuate path and decreases along a second portion of the arcuate path, wherein the sliding surface is oriented at a pitch angle around a pitch axis, the pitch angle being measured relative to a horizontal plane, wherein the sliding surface is oriented at a roll angle around a roll axis, the roll angle being measured relative to the horizontal plane, wherein the pitch axis and the roll axis are mutually perpendicular, and wherein at least one of the pitch angle and the roll angle is nonzero.

29. The slide feature of claim 28, wherein:

both the pitch angle and the roll angle are nonzero.

30. A water slide comprising a slide feature according to claim 28.

31. The slide feature of claim 28, wherein the slide feature further comprises an outer lip extending from the inrun to the outrun and wherein the arcuate path is at least partially bounded by the outer lip.

32. A slide feature for an amusement ride adapted to carry a rider or ride vehicle sliding thereon, the slide feature comprising:

an inrun permitting ingress of the rider or ride vehicle at a first elevation, an outrun permitting egress of the rider or ride vehicle at a second elevation, wherein the first elevation is higher than the second elevation, a sliding surface in communication with the inrun and the outrun, wherein the sliding surface comprises a two-dimensional, planar surface portion that is substantially circular or substantially elliptical, wherein the slide feature provides that the rider or ride vehicle, at least partially urged by gravity, slides along the sliding surface from the inrun to the outrun in an arcuate path, wherein the sliding surface is oriented at a pitch angle around a pitch axis, the pitch angle being measured relative to a horizontal plane, wherein the sliding surface is oriented at a roll angle around a roll axis, the roll angle being measured relative to the horizontal plane, wherein the pitch axis and the roll axis are mutually perpendicular, and wherein at least one of the pitch angle and the roll angle is nonzero.

33. The slide feature of claim 32, wherein the slide feature further comprises an outer lip extending from the inrun to the outrun and wherein the arcuate path is at least partially bounded by the outer lip.

34. The slide feature of claim 32, wherein the rider or ride vehicle has a continuously decreasing elevation while sliding from the inrun to the outrun.

* * * * *